US010161605B2

(12) United States Patent
May

(10) Patent No.: US 10,161,605 B2
(45) Date of Patent: Dec. 25, 2018

(54) LIGHTING ASSEMBLY

(71) Applicant: Michael W. May, Lakewood, IL (US)

(72) Inventor: Michael W. May, Lakewood, IL (US)

( * ) Notice: Subject to any disclaimer, the term of this patent is extended or adjusted under 35 U.S.C. 154(b) by 289 days.

(21) Appl. No.: 15/290,955

(22) Filed: Oct. 11, 2016

(65) Prior Publication Data

US 2017/0038040 A1 Feb. 9, 2017

Related U.S. Application Data

(63) Continuation of application No. 14/982,513, filed on Dec. 29, 2015, now Pat. No. 9,470,401, which is a
(Continued)

(51) Int. Cl.
*F21V 19/00* (2006.01)
*F21V 3/06* (2018.01)
(Continued)

(52) U.S. Cl.
CPC ..... *F21V 19/0085* (2013.01); *F21K 9/27* (2016.08); *F21K 9/272* (2016.08); *F21K 9/278* (2016.08);
(Continued)

(58) Field of Classification Search
CPC .. F21K 9/27; F21K 9/272; F21K 9/278; F21S 2/00; F21S 4/28; F21S 8/04; F21S 8/033;
(Continued)

(56) References Cited

U.S. PATENT DOCUMENTS 1,516,721 A 11/1924 Emery
1,941,079 A 12/1933 Exelmans
(Continued)

FOREIGN PATENT DOCUMENTS

CN 1690505 A 11/2005
CN 201448641 U 5/2010
(Continued)

OTHER PUBLICATIONS

Extended European search report issued in European Application No. 12873713.7-1757 dated Jan. 29, 2016 (9 pages).
(Continued)

*Primary Examiner* — Stephen F Husar
(74) *Attorney, Agent, or Firm* — Fitch Even Tabin & Flannery, LLP

(57) ABSTRACT

An elongate tubular lighting assembly having a body with a length between spaced first and second ends. The tubular lighting assembly has a source of illumination and first and second connectors respectively at the first and second body ends. The first connector has cooperating first and second parts having first and second surfaces. The first and second connector parts are configured so that the first and second surfaces are placed in confronting relationship to prevent separation of the first and second connector parts with the body in an operative state as an incident of the first connector part moving relative to the second connector part from a position fully separated from the second connector part in a substantially straight path that is transverse to the length of the body into an engaged position.

19 Claims, 70 Drawing Sheets

Related U.S. Application Data continuation of application No. 14/256,066, filed on Apr. 18, 2014, now Pat. No. 9,228,727, which is a continuation-in-part of application No. 13/440,423, filed on Apr. 5, 2012, now Pat. No. 8,702,265.

(51) Int. Cl.

| | |
|---|---|
| ***F21S 8/04*** | (2006.01) |
| ***F21V 5/04*** | (2006.01) |
| ***F21V 21/005*** | (2006.01) |
| ***F21V 29/70*** | (2015.01) |
| ***F21V 29/89*** | (2015.01) |
| ***F21V 23/00*** | (2015.01) |
| ***F21V 23/06*** | (2006.01) |
| ***F21S 9/02*** | (2006.01) |
| ***F21K 9/27*** | (2016.01) |
| ***F21S 2/00*** | (2016.01) |
| ***F21S 4/28*** | (2016.01) |
| ***F21K 9/278*** | (2016.01) |
| ***F21S 8/00*** | (2006.01) |
| ***F21V 23/02*** | (2006.01) |
| ***F21K 9/272*** | (2016.01) |
| *F21Y 101/00* | (2016.01) |
| *F21Y 103/10* | (2016.01) |
| *F21Y 115/10* | (2016.01) |
| *F21Y 113/00* | (2016.01) |
| *F21Y 105/16* | (2016.01) |
| *F21V 7/10* | (2006.01) |
| *H05B 33/08* | (2006.01) |

(52) U.S. Cl.

CPC . *F21S 2/00* (2013.01); *F21S 4/28* (2016.01); *F21S 8/033* (2013.01); *F21S 8/04* (2013.01); *F21S 8/046* (2013.01); *F21S 9/02* (2013.01); *F21S 9/022* (2013.01); *F21V 3/0625* (2018.02); *F21V 5/04* (2013.01); *F21V 21/005* (2013.01); *F21V 23/003* (2013.01); *F21V 23/004* (2013.01); *F21V 23/006* (2013.01); *F21V 23/009* (2013.01); *F21V 23/02* (2013.01); *F21V 23/06* (2013.01); *F21V 29/70* (2015.01); *F21V 29/89* (2015.01); *F21V 7/10* (2013.01); *F21Y 2101/00* (2013.01); *F21Y 2103/10* (2016.08); *F21Y 2105/16* (2016.08); *F21Y 2113/00* (2013.01); *F21Y 2115/10* (2016.08); *H05B 33/0845* (2013.01); *H05B 33/0887* (2013.01)

(58) Field of Classification Search

CPC ... F21S 8/046; F21S 9/02; F21S 9/022; F21V 3/0625; F21V 5/04; F21V 7/10; F21V 19/0085; F21V 21/005; F21V 23/02; F21V 23/06; F21V 23/003; F21V 23/004; F21V 23/006; F21V 23/009; F21V 29/70; F21V 29/89; F21Y 2101/00; F21Y 2103/10; F21Y 2105/16; F21Y 2113/00; F21Y 2115/10; H05B 33/0845; H05B 33/0887

See application file for complete search history.

(56) References Cited

U.S. PATENT DOCUMENTS

| | | | |
|---|---|---|---|
| 2,628,800 | A | 2/1953 | Kindorf et al. |
| 3,052,864 | A | 9/1962 | Gaynor |
| 3,087,982 | A | 4/1963 | Hayes |
| 3,131,871 | A | 5/1964 | Foulds |
| 3,404,268 | A | 10/1968 | Fowler |
| D246,930 | S | 1/1978 | Win |
| 4,115,230 | A | 9/1978 | Beckman |
| 4,156,553 | A | 5/1979 | Ammon et al. |
| 5,106,103 | A | 4/1992 | Fiore |
| 5,434,762 | A | 7/1995 | Shemitz |
| 5,457,905 | A | 10/1995 | Kaplan |
| 5,624,274 | A | 4/1997 | Lin |
| D397,481 | S | 8/1998 | Schafer |
| 5,855,487 | A | 1/1999 | Kunishi |
| 5,947,761 | A | 9/1999 | Pepe |
| D421,815 | S | 3/2000 | Herst et al. |
| D430,326 | S | 8/2000 | Littman |
| 6,107,572 | A | 8/2000 | Miyazaki |
| D438,326 | S | 2/2001 | Kan |
| 6,231,373 | B1 | 5/2001 | Daoud |
| 6,257,735 | B1 | 7/2001 | Baar |
| 6,283,612 | B1 | 9/2001 | Hunter |
| 6,350,158 | B1 | 2/2002 | Arnett et al. |
| D459,012 | S | 6/2002 | Shemitz et al. |
| D459,517 | S | 6/2002 | Shemitz et al. |
| 6,548,967 | B1 | 4/2003 | Dowling et al. |
| 6,561,828 | B2 | 5/2003 | Henrici |
| 6,577,080 | B2 | 6/2003 | Lys et al. |
| 6,578,979 | B2 | 6/2003 | Truttmann-Battig |
| 6,623,151 | B2 | 9/2003 | Pederson |
| 6,676,425 | B2 | 1/2004 | Lewis |
| D500,883 | S | 1/2005 | Herst et al. |
| D500,884 | S | 1/2005 | O'Rourke |
| D503,009 | S | 3/2005 | Salman |
| 6,969,954 | B2 | 11/2005 | Lys |
| 7,049,761 | B2 | 5/2006 | Timmermans et al. |
| D523,165 | S | 6/2006 | Schultz |
| 7,195,370 | B2 | 3/2007 | Riblett et al. |
| D543,305 | S | 5/2007 | Wang |
| 7,309,965 | B2 | 12/2007 | Dowling et al. |
| D565,785 | S | 4/2008 | Kerr |
| D574,105 | S | 7/2008 | Shuai et al. |
| D575,898 | S | 8/2008 | Tran et al. |
| D581,569 | S | 11/2008 | Levine |
| 7,448,892 | B2 | 11/2008 | Dowdle |
| 7,476,004 | B2 | 1/2009 | Chan |
| D589,199 | S | 3/2009 | Pedersen |
| 7,507,001 | B2 | 3/2009 | Kit |
| 7,510,299 | B2 | 3/2009 | Timmermans et al. |
| 7,513,637 | B2 | 4/2009 | Kelly et al. |
| 7,559,790 | B2 | 7/2009 | Boeck et al. |
| 7,587,289 | B1 | 9/2009 | Sivertsen |
| D605,343 | S | 12/2009 | Watt |
| D607,145 | S | 12/2009 | Yu |
| 7,637,636 | B2 | 12/2009 | Zheng et al. |
| D616,382 | S | 5/2010 | Lin et al. |
| 7,712,918 | B2 | 5/2010 | Siemiet et al. |
| 7,815,338 | B2 | 10/2010 | Siemiet et al. |
| D627,095 | S | 11/2010 | Miyairi et al. |
| D634,470 | S | 3/2011 | Hsieh |
| 7,918,580 | B2 | 4/2011 | Liu |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| D642,326 | S | 7/2011 | Leadford et al. |
| 7,976,185 | B2 | 7/2011 | Uang et al. |
| 7,976,187 | B2 | 7/2011 | Villard |
| 7,976,196 | B2 | 7/2011 | Ivey et al. |
| 7,989,827 | B2 | 8/2011 | Hsu |
| 8,011,794 | B1 | 9/2011 | Sivertsen |
| D649,282 | S | 11/2011 | McDonald et al. |
| 8,052,295 | B2 | 11/2011 | Kim et al. |
| 8,093,823 | B1 | 1/2012 | Ivey et al. |
| D654,208 | S | 2/2012 | Marquardt et al. |
| 8,118,447 | B2 | 2/2012 | Simon et al. |
| 8,164,281 | B2 | 4/2012 | Warton |
| 8,186,847 | B2 | 5/2012 | Hu et al. |
| 8,203,260 | B2 | 6/2012 | Li et al. |
| 8,214,084 | B2 | 7/2012 | Ivey et al. |
| 8,235,539 | B2 | 8/2012 | Thomas et al. |
| 8,247,985 | B2 | 8/2012 | Timmermans et al. |
| 8,251,544 | B2 | 8/2012 | Ivey et al. |
| 8,256,924 | B2 | 9/2012 | Simon et al. |
| 8,282,247 | B2 | 10/2012 | Ivey et al. |

(56) References Cited

U.S. PATENT DOCUMENTS

| | | | |
|---|---|---|---|
| 8,287,144 | B2 | 10/2012 | Pedersen et al. |
| 8,324,817 | B2 | 12/2012 | Ivey et al. |
| 8,330,381 | B2 | 12/2012 | Langovsky |
| 8,344,641 | B1 | 1/2013 | Isaacson et al. |
| 8,360,599 | B2 | 1/2013 | Ivey et al. |
| 8,382,327 | B2 | 2/2013 | Timmermans et al. |
| 8,398,253 | B2 | 3/2013 | Sivertsen |
| 8,408,742 | B2 | 4/2013 | Tran |
| D682,463 | S | 5/2013 | Bernard |
| 8,434,891 | B1 | 5/2013 | Ham |
| 8,444,292 | B2 | 5/2013 | Ivey et al. |
| 8,454,193 | B2 | 6/2013 | Simon et al. |
| 8,523,394 | B2 | 9/2013 | Simon et al. |
| 8,534,873 | B1 | 9/2013 | Soderman et al. |
| D691,750 | S | 10/2013 | Mackiewicz |
| D692,597 | S | 10/2013 | Simon et al. |
| 8,547,036 | B2 | 10/2013 | Tran |
| 8,556,452 | B2 | 10/2013 | Simon et al. |
| 8,558,413 | B1 | 10/2013 | Lepard |
| 8,560,261 | B1 | 10/2013 | Sivertsen |
| 8,571,716 | B2 | 10/2013 | Ivey et al. |
| 8,573,813 | B2 | 11/2013 | Ivey et al. |
| 8,596,813 | B2 | 12/2013 | Ivey |
| 8,616,720 | B2 | 12/2013 | Carney et al. |
| D698,075 | S | 1/2014 | Klus |
| 8,628,216 | B2 | 1/2014 | Ivey et al. |
| 8,643,298 | B2 | 2/2014 | Palazzolo et al. |
| 8,653,984 | B2 | 2/2014 | Ivey et al. |
| D701,639 | S | 3/2014 | Maxik et al. |
| 8,664,880 | B2 | 3/2014 | Ivey et al. |
| 8,674,626 | B2 | 3/2014 | Siemiet et al. |
| 8,678,610 | B2 | 3/2014 | Simon et al. |
| 8,702,265 | B2 | 4/2014 | May |
| 8,710,759 | B1 | 4/2014 | Isaacson et al. |
| 8,742,680 | B2 | 6/2014 | Cowburn |
| 8,807,785 | B2 | 8/2014 | Ivey et al. |
| 8,827,486 | B2 | 9/2014 | Lai |
| 8,830,080 | B2 | 9/2014 | Ivey et al. |
| 8,836,476 | B2 | 9/2014 | Campbell et al. |
| 8,866,414 | B2 | 10/2014 | Maxik et al. |
| 8,915,756 | B2 | 12/2014 | Schumacher et al. |
| 8,919,991 | B2 | 12/2014 | Lee et al. |
| 8,941,330 | B2 | 1/2015 | Ng et al. |
| 8,956,005 | B2 | 2/2015 | Thomas et al. |
| 8,956,019 | B2 | 2/2015 | Swedberg |
| 8,967,825 | B2 | 3/2015 | Fukui |
| 9,080,760 | B1 | 7/2015 | Soderman et al. |
| 9,101,028 | B2 | 8/2015 | Isaacson et al. |
| 9,155,171 | B1 | 10/2015 | Hughes et al. |
| 9,215,755 | B2 | 12/2015 | Saur et al. |
| 9,228,727 | B2 | 1/2016 | May |
| 9,247,623 | B2 | 1/2016 | Recker et al. |
| 9,285,085 | B2 | 3/2016 | Carney et al. |
| 9,295,142 | B1 | 3/2016 | Leinen et al. |
| 9,295,144 | B2 | 3/2016 | Bora et al. |
| 9,307,621 | B1 | 4/2016 | Parello et al. |
| 9,328,882 | B2 | 5/2016 | Spiro |
| 9,338,860 | B2 | 5/2016 | Radermacher |
| 9,464,791 | B2 | 10/2016 | May |
| 9,464,792 | B2 | 10/2016 | May |
| 9,464,793 | B2 | 10/2016 | May |
| 9,470,401 | B2 | 10/2016 | May |
| 9,671,072 | B1 * | 6/2017 | May ..... F21V 7/00 |
| 2002/0047646 | A1 | 4/2002 | Lys |
| 2002/0096347 | A1 | 7/2002 | Pyron |
| 2004/0095078 | A1 | 5/2004 | Leong |
| 2006/0012981 | A1 | 1/2006 | Noh |
| 2007/0159828 | A1 | 7/2007 | Wang |
| 2007/0246714 | A1 | 10/2007 | Koike et al. |
| 2007/0258202 | A1 | 11/2007 | Cooley |
| 2008/0197790 | A1 | 8/2008 | Mangiaracina |
| 2010/0003860 | A1 | 1/2010 | Mateo Ferrus et al. |
| 2010/0039813 | A1 | 2/2010 | Sloan et al. |
| 2010/0072921 | A1 | 3/2010 | Weatherley |
| 2010/0079075 | A1 | 4/2010 | Son |
| 2010/0112845 | A1 | 5/2010 | Lam et al. |
| 2010/0190455 | A1 | 7/2010 | Hashizume |
| 2010/0254148 | A1 | 10/2010 | Huang et al. |
| 2010/0327768 | A1 | 12/2010 | Kong et al. |
| 2011/0019421 | A1 | 1/2011 | Lai |
| 2011/0199005 | A1 | 8/2011 | Bretschneider et al. |
| 2011/0199769 | A1 | 8/2011 | Bretschneider et al. |
| 2011/0235321 | A1 | 9/2011 | Ivey et al. |
| 2011/0280020 | A1 | 11/2011 | Chen et al. |
| 2011/0292647 | A1 | 12/2011 | Chang |
| 2012/0049739 | A1 | 3/2012 | Clough |
| 2012/0069557 | A1 | 3/2012 | Bolscher |
| 2012/0147598 | A1 | 6/2012 | Ivey |
| 2012/0201022 | A1 | 8/2012 | Van De Ven et al. |
| 2012/0229025 | A1 | 9/2012 | Edwards, Jr. et al. |
| 2012/0307524 | A1 | 12/2012 | Schapira |
| 2013/0119896 | A1 | 5/2013 | Fukano |
| 2013/0135851 | A1 | 5/2013 | Ham, II |
| 2013/0141906 | A1 | 6/2013 | Wang et al. |
| 2013/0147367 | A1 | 6/2013 | Cowburn |
| 2013/0258668 | A1 | 10/2013 | Dellian et al. |
| 2013/0264942 | A1 | 10/2013 | Kuang |
| 2013/0265746 | A1 | 10/2013 | May |
| 2013/0279160 | A1 | 10/2013 | Myers et al. |
| 2013/0343037 | A1 | 12/2013 | Alexander |
| 2014/0009926 | A1 | 1/2014 | Simon |
| 2014/0056009 | A1 | 2/2014 | Swedberg |
| 2014/0133400 | A1 | 5/2014 | Ruan et al. |
| 2014/0218905 | A1 | 8/2014 | Ono et al. |
| 2014/0226322 | A1 | 8/2014 | Chan |
| 2014/0268752 | A1 | 9/2014 | Werr et al. |
| 2014/0293595 | A1 | 10/2014 | May |
| 2015/0049475 | A1 | 2/2015 | Pan et al. |
| 2015/0351205 | A1 | 12/2015 | Clark et al. |
| 2016/0227629 | A1 | 8/2016 | Conner et al. |
| 2017/0023193 | A1 | 1/2017 | Thosteson et al. |
| 2017/0198896 | A1 * | 7/2017 | May ..... F21V 29/74 |

FOREIGN PATENT DOCUMENTS

| | | | |
|---|---|---|---|
| CN | 101936469 | A | 1/2011 |
| CN | 102032534 | A | 4/2011 |
| EP | 2418422 | A2 | 2/2012 |
| JP | S6144785 | | 3/1986 |
| JP | 2007165051 | A | 6/2007 |
| JP | 200884856 | | 4/2008 |
| JP | 2012230864 | | 11/2012 |
| JP | 3185411 | | 8/2013 |
| WO | 2009143047 | A2 | 11/2009 |
| WO | 2013121580 | A1 | 8/2013 |
| WO | 2013151565 | | 10/2013 |

OTHER PUBLICATIONS

Extended European search report issued in European Application No. 15779891.9-1757 dated Jan. 23, 2018 (11 pages).

Notice of Restriction issued in related Chinese Application No. 201580031681.0 dated Jun. 30, 2017 and English translation (8 pages).

Notification Concerning Transmittal of International Preliminary Report on Patentability and Written Opinion of the International Searching Authority from the International Bureau of WIPO issued in International Application No. PCT/US2015/026409, dated Oct. 27, 2016 (15 pages).

Notification of Transmittal of the International Search Report and the Written Opinion of the International Searching Authority, or the Declaration from the International Bureau of WIPO for International Application No. PCT/US15/26409, dated Jul. 30, 2015, 17 pages.

Notification of Transmittal of the International Search Report and the Written Opinion of the International Searching Authority, or the Declaration from the International Bureau of WIPO for International Application No. PCT/US17/17151, dated Jun. 7, 2017 (12 pages).

Notification of Transmittal of the International Search Report and the Written Opinion of the International Searching Authority, or the

(56) References Cited

OTHER PUBLICATIONS

Declaration from the International Bureau of WIPO for International Application No. PCT/US17/17189, dated Jun. 7, 2017 (13 pages).
Notification of Transmittal of the International Search Report and the Written Opinion of the International Searching Authority, or the Declaration from the International Bureau of WIPO for International Application No. PCT/US2012/037242, dated Aug. 13, 2012, 13 pages.
Office Action including Search Report issued in Chinese Application No. 2012800737587 dated Jan. 28, 2016 (8 pages).
Office Action including Search Report issued in Chinese Application No. 2015800316810 dated Jan. 19, 2018 (9 pages).
Partial Supplementary European search report issued in European Application No. 15779891.9-1757 dated Sep. 18, 2017 (13 pages).
Notification of Transmittal of the International Search Report and the Written Opinion of the International Searching Authority, for International Application No. PCT/US2017/12700, dated Jul. 19, 2018.
Office Action issued in Japanese Application No. 2017-506639 dated Jun. 12, 2018 (19 pgs.).

* cited by examiner

Fig. 47
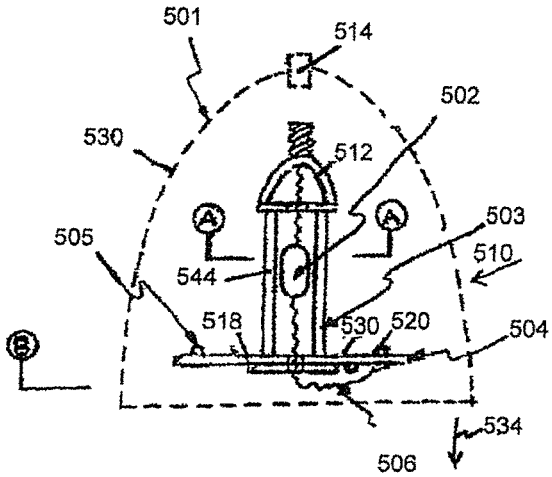
Fig. 48
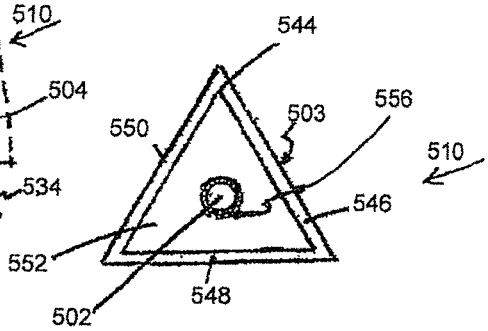
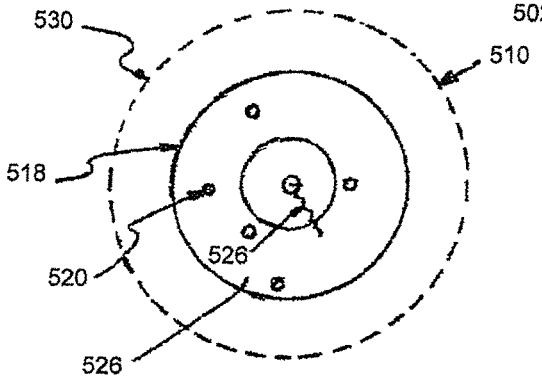
Fig. 49

LIGHTING ASSEMBLY

CROSS-REFERENCE TO RELATED APPLICATION

This application is a continuation of U.S. application Ser. No. 14/982,513, filed Dec. 29, 2015, now U.S. Pat. No. 9,470,401 , which is a continuation of U.S. application Ser. No. 14/256,066, filed Apr. 18, 2014, now U.S. Pat. No. 9,228,727 , which is a continuation-in-part of U.S. application Ser. No. 13/440,423, filed Apr. 5, 2012, now U.S. Pat. No. 8,702,265 ,which are all hereby incorporated by reference as if fully set forth herein.

FIELD OF THE INVENTION

This invention relates to lighting and, more particularly, to light emitting diode (LED) illumination as well as tubular lighting assemblies.

BACKGROUND ART

Over the years various types of illuminating assemblies and devices have been developed for indoor and/or outdoor illumination, such as torches, oil lamps, gas lamps, lanterns, incandescent bulbs, neon signs, fluorescent bulbs, halogen lights, and light emitting diodes. These conventional prior art illuminating assemblies and devices have met with varying degrees of success.

Incandescent light bulbs create light by conducting electricity through a thin filament, such as a tungsten filament, to heat the filament to a very high temperature so that it glows and produces visible light. Incandescent light bulbs emit a yellow or white color. Incandescent light bulbs, however, are very inefficient, as over 98% of its energy input is emitted and generated as heat. A standard 100 watt light bulb emits about 1700 lumens, or about 17 lumens per watt. Incandescent lamps are relatively inexpensive and have a typical lifespan of about 1,000 hours.

Fluorescent lamps (light bulbs) conduct electricity through mercury vapor, which produces ultraviolet (UV) light. The ultraviolet light is then absorbed by a phosphor coating inside the lamp, causing it to glow, or fluoresce. While the heat generated by fluorescent lamps is much less than its incandescent counterpart, energy is still lost in generating the UV light and converting UV light into visible light. If the lamp breaks, exposure to mercury can occur. Linear fluorescent lamps are often five to six times the cost of incandescent bulbs but have life spans around 10,000 and 20,000 hours. Lifetime varies from 1,200 hours to 20,000 hours for compact fluorescent lamps. Some fluorescent lights flicker and the quality of the fluorescent light tends to be a harsh white due to the lack of a broad band of frequencies. Most fluorescent lights are not compatible with dimmers.

Light emitting diode (LED) lighting is particularly useful. Light emitting diodes (LEDs) offer many advantages over incandescent light sources, including: lower energy consumption, longer lifetime, improved robustness, smaller size, faster switching, and excellent durability and reliability. LEDs emit more light per watt than incandescent light bulbs. LEDs can be tiny and easily placed on printed circuit boards. LEDs activate and turn on very quickly and can be readily dimmed. LEDs emit a cool light with very little infrared light. LEDs come in multiple colors which are produced without the need for filters. LEDs of different colors can be mixed to produce white light. Other advantages of LEDs include: high efficiency; low energy consumption; higher outputs at higher drive currents; shock resistant with no filament, glass or tube to break, contain no toxic substances, hazardous mercury or halogen gases.

The operational life of some white LED lamps is 100,000 hours and 11 years of continuous operation. The long operational life of an LED lamp is much longer than the average life of an incandescent bulb, which is approximately 5000 hours. If the lighting device needs to be embedded into a very inaccessible place, using LEDs would minimize the need for regular bulb replacement. With incandescent bulbs, the cost of replacement bulbs and the labor expense and time needed to replace them can be significant especially where there are a large number of incandescent bulbs. For office buildings and high rise buildings, maintenance costs to replace bulbs can be expensive and can be substantially decreased with LED lighting.

An important advantage of LED lighting is reduced power consumption. An LED circuit will approach 80% efficiency, which means 80% of the electrical energy is converted to light energy; the remaining 20% is lost as heat energy. Incandescent bulbs, however, operate at about 20% efficiency with 80% of the electrical energy is lost as heat. Repair and replacement savings can be significant, as most incandescent light bulbs burn out within a year and require replacements whereas LED light bulbs can be used easily for a decade without burning out.

LED light (lighting) bars are considered to be much better than incandescent lights. Incandescent light bulbs do not last for a long time and the filament burns out. An LED light bar consumes less energy and has a longer life. LED light output is much brighter than that of an incandescent light bulb.

An assortment of colors and flash patterns are available with LED light bars for emergency vehicles such as police cars, fire trucks and ambulances. Emergency vehicles such as ambulances and police cars prefer mounting a LED light bar on the top for easy recognition and visibility. LED light bars can be used on the interior as well as on the exterior of the emergency vehicles as it emits sufficient light even in the darkest of areas. Furthermore, since the heat produced by LED light bars is small, it won't adversely affect the interior of the vehicle.

LEDs are used in applications as diverse as aviation lighting, traffic signals and automotive lighting such as for brake lights, turn signals and indicators. LEDs have a compact size, fast switching speed and good reliability. LEDs are useful for displaying text and video and for communications. Infrared LEDs are also used in the remote control units of many commercial products including televisions, DVD players and other domestic appliances.

Solid state devices such as LEDs have excellent wear and tear if operated at low currents and at low temperatures. LED light output actually rises at colder temperatures (leveling off depending on type at around −30 C. °). Consequently, LED technology may be a good replacement for supermarket freezer lights and will often last longer than other types of lighting.

Large-area LED signs and displays are used as stadium displays and as decorative displays. LED message displays are used at airports and railway stations, and as destination displays for trains, buses, trams, and ferries.

With the development of efficient high power LEDs, it has become more advantageous to use LED lighting and illumination. High power white light LED lighting is useful for illumination and for replacing incandescent and/or fluorescent lighting. LED street lights are used on posts, poles and in parking garages. LED's are now used in stores, homes, stage and theaters, and public places. Furthermore, color LED's are useful in medical and educational applications such as for mood enhancement. In many countries incandescent lighting for homes and offices is no longer available and building regulations require new premises to use LED lighting.

Conventional prior art LED lighting which is powerful enough for room lighting, however, is relatively expensive and requires more precise current and heat management than fluorescent lamp sources of comparable output. Furthermore, conventional LED lighting can have a higher capital cost than other types of lighting and LED light tends to be directional with small areas of illumination. Moreover, conventional LED luminaries suffer from drawbacks due to a lack of lumen output and less than desirable light dispersion. Individually and combined, these aspects of conventional LED lighting can detract from efficient utilization of LED luminaries.

One problem that has plagued the lighting industry is associated with how conventional, elongate, tubular lighting components are operatively mounted through end connectors. As described in greater detail below, conventional tubular lighting, having a source of illumination that is an LED, a gas-discharge lamp that uses fluorescence to produce visible light, or another known source on, or within, a tubular body, typically utilizes a bi-pin/2-pin means on the tubular body that mechanically supports the body in an operative state and effects electrical connection of the illumination source to a power supply.

Typically, the body has a cylindrical shape with a central axis. The pins making up the bi-pin means project in cantilever fashion from the body ends. The body must be situated in a first angular orientation to direct the pins into spaced connectors on a support/reflector and is thereafter turned to effect mechanical securement and electrical connection.

Installation requires a precise initial angular orientation of the body and subsequent controlled repositioning thereof to simultaneously seat the pins at the opposite ends of the body. Often one or more of the pins are misaligned during this process so that electrical connection is not established. The same misalignment may cause a compromised mechanical connection whereupon the body may escape from the connectors and drop so that it is damaged or destroyed.

Further, the connectors on the support/reflector are generally mounted in such a fashion that they are prone to flexing. Even a slight flexing of the connectors on the support might be adequate to release the pins at one body end so that the entire body becomes separated. Furthermore, the conventional bi-pin means for mechanically holding the body in place, while also allowing power to be distributed to the illumination source, was created for very lightweight fluorescent lighting and not designed for LED tubular lighting that has additional weight due to the required heat sink and PCB boards. The weight of the body by itself may produce horizontal force components that wedge the connectors on the support/reflector away from each other so that the body becomes precariously situated or fully releases.

A still further problem with this type of lighting configuration, particularly with an LED illumination source, is that the end connectors joined to the body are by their nature difficult to consistently assemble. Typically, the manufacturing process will involve steps of soldering conductive components on, and cooperating between, the end connectors and illumination source. Wires are commonly used in these designs, with the ends thereof soldered during the assembly process. If the conductive components are not properly connected, the system may be inoperable. Soldered connections are also prone to failing when subjected to forces in use. Generally, it is difficult to maintain a high level of quality control, regardless of the care taken in assembling these types of components. Aside from the quality issue, the assembly steps that involve the electrical connection of the conductors are inherently time consuming and may require relatively skilled labor, and/or expensive automated systems. Disassembly of such lamps presents similar difficulties and expense. As a result of these difficulties associated with assembly and disassembly, refurbishing such lamps to replace defective or worn out components is difficult to justify economically. In most cases, the entire lamp assembly will simply be discarded and replaced with a new lamp assembly, and as a result, lamp components that have significant useful life remaining are wasted.

Still another problem in the lighting industry are the difficulties and costs associated with proper design and control of emergency lighting circuits. Emergency lighting systems are required by a myriad of municipal, state, federal or other codes and standards. These systems are intended to automatically supply illumination to designated areas and equipment in the event of failure of the normal power supply, to protect people and allow safe egress from a building, and to provide lighting to areas that would aid rescuers or repair crews. These systems are typically required by regulation to be available within a short time (e.g. 10 seconds) after failure of normal power, and emergency circuits must be physically separated from all other circuits all the way to the terminations and the source. Other standby systems, although not legally required, may be desirable to provide lighting to prevent discomfort or serious damages to a product or process.

The proper design and control of emergency lighting circuits in compliance with the many standards and codes that may apply to a given site installation has long presented difficult challenges for manufacturers, systems integrators and electricians and engineers. As a result, a number of approaches to the designing emergency or standby lighting circuits have been attempted. One known approach involves providing a number of emergency-only luminaires dedicated to providing minimum illumination levels and powered by a dedicated emergency breaker panel fed from a generator or uninterruptable power supply (UPS). An uninterruptible power supply is an electrical apparatus that provides emergency power to a load when the input power source, typically mains power, fails. A UPS differs from an auxiliary or emergency power system or standby generator in that it will provide near-instantaneous protection from input power interruptions, by supplying energy stored in batteries or a flywheel. Regardless of the source of back-up power, the emergency fixtures remain dark when normal power is present, and are energized when the control circuit detects failure of the normal power supply. This approach entails the potentially high cost of the emergency system equipment and may be visually unappealing as result of excess luminaries which are not illuminated during normal conditions.

Another approach involves self-contained battery pack emergency lights, which contain a battery, a charger, and a load control relay. These units are connected to normal power, which provides a constant charging current for the battery. During a power failure, the load control relay energizes the emergency lights. This approach avoids the need to deploy physically separated emergency circuits, but is typically implemented in aesthetically unpleasing forms resembling a car headlight battery pack unit.

Still another approach uses the same light fixture for both normal an emergency use. The lights are fed using the normal breaker panel and wall mounted switch during normal operation. When power fails, an emergency transfer circuit transfers the breaker panel feed to an emergency power source, and bypasses the wall switch to force the load on the lights regardless of the wall switch position. Although such systems offer aesthetic advantages, they are expensive and complex to design and install. Other known approaches suffer similar drawbacks.

It is, therefore, desirable to provide an improved LED illuminating assembly, which overcomes some, if not all, of the preceding problems and disadvantages.

SUMMARY OF THE INVENTION

The disclosure of U.S. patent application Ser. No. 13/440,423 is hereby incorporated by reference as if fully set forth herein. An improved light emitting diode (LED) illuminating assembly is provided with a novel multiple sided LED lighting bar, also referred to as a multi-sided LED light bar, comprising a non-curvilinear LED luminary for enhanced LED lighting. Advantageously, the inventive LED illuminating assembly with the novel multi-sided light bar is efficient, effective, economical, convenient and safe. Desirably, the user friendly LED illuminating assembly with the compact multi-sided light bar produces outstanding illumination, is easy to manufacture and install, and has a long life span. The improved LED illuminating assembly and attractive multi-sided light bar are also reliable, durable and impact and breakage resistant.

The improved LED illuminating assembly can feature: a multi-sided light bar, such as with two, three, four or five sides; an internal non-switching driver; a scalable length; and an emitter count optimized for efficiency. The improved LED luminary assembly can also feature: parallel-series wiring; a no-wire design using a unique end cap design; a lens cover cap per design requirements to modify the beam angle; and redundancy in the driver.

There are many advantages of the inventive LED illuminating assembly with a novel multi-sided LED lighting bar comprising a non-curvilinear LED luminary versus conventional LED lighting.

1. The use of a multi-sided light bar allows for a much wider distribution of light. A standard solution has about 100-110 degree light beam to half brightness. The inventive LED illuminating assembly with the novel multi-sided LED lighting bar, however, can reach a full 360 degrees with little or no loss of brightness. Furthermore, the illustrated two-sided design can reach over 180 degrees to half-brightness. Another advantage is near-field use; lighting something just a few inches from the light source.

2. The internal driver of the improved LED illuminating assembly with the multi-sided lighting bar is less expensive, uses less labor, is simpler and has lower chance of failure over conventional lighting.

3. The non-switching driver of the improved LED illuminating assembly with the multi-sided lighting bar provides a boost of efficiency on the scale of 4-7 magnitude. A typical switching driver which is used on conventional LED lighting bars has a typical efficiency of 80-85% or 15-20% loss. In contrast, the improved LED illuminating assembly with the multi-sided lighting bar can have an efficiency of 95-97% (3-5% loss), and is four to seven times more efficient than conventional lighting. This improvement results in about 20% overall efficiency gain. Since much of the power is spent on the LEDs it takes an increase of 5 times improvement in driver efficiency to net a 20% gain in overall efficiency. Desirably, the improved LED illuminating assembly with the multi-sided lighting bar can achieve greater than 90% efficiency, an impossibility with conventional switching drivers.

The improved LED illuminating assembly with the multi-sided lighting bar desirably can optimize the emitter count to the voltage source and can advantageously utilize wiring of the emitters in a parallel-series arrangement in the appropriate numbers.

In the improved LED illuminating assembly with the novel multi-sided lighting bar, the diffuser comprising the lens can be modified to change the output of the beam. By use of this arrangement, dark spots can be eliminated so that a much higher illuminating output can be attained. The improved LED illuminating assembly with the multi-sided lighting bar example can emit a 360 degree beam without visible hot or cold spots.

The improved LED illuminating assembly with the multi-sided lighting bar can also have scalable length since there is no theoretical limit to the length of the novel arrangement and design. The length may be governed, however, by customer needs, costs, available space, and production capabilities.

The improved LED illuminating assembly with the multi-sided lighting bar further has driver redundancy using parallel and multiple driver sub-circuits for even better reliability. This achieves two other important goals:

1. The improved LED illuminating assembly with the multi-sided lighting bar attains even, accurate power levels to all emitters. In contrast, conventional LED designs do not control the current to all the emitters evenly, but apply a metered amount of current to all parallel circuits, typically as many as three to eight of them, and the current can vary on each parallel circuit because there is no control per sub-circuit. The improved LED illuminating assembly with the multi-sided lighting bar can control each sub-circuit independently so that every emitter in the entire light assembly gets exactly the same current.

2. The improved LED illuminating assembly with the multi-sided lighting bar achieves reliability of output even in the event of sub-circuit failure.

In a conventional LED design with output 300 mA to three branches or sub-circuits, when one fails, then two sub-circuits will share that same 300 mA so they will go from 100 mA to 150 mA, which is a huge change in current that is not desirable and is likely to cause a cascading failure. In the improved LED illuminating assembly with the multi-sided lighting bar, if one sub-circuit has a failure, the remaining circuits operate exactly as they were, and can operate like that indefinitely.

Furthermore, in the improved LED illuminating assembly with the multi-sided lighting bar, the sub-circuits can be spread out so that no one portion of the light assembly goes completely dark, but will just dim. This can be very important when lighting up a sign so that although it may be a little darker in one spot, the sign will still be lit up and readable.

In conventional LED illumination, all the emitters are in series with each other so in the event of a single LED failure that entire row blinks out (think of Christmas tree lights) and that entire portion of the light assembly will go dark. In the improved LED illuminating assembly with the multi-sided lighting bar, the strings or set of emitters are aligned and connected in parallel with every other emitter so that in the event of failure of one sub-circuit, the LED lamp of the LED illuminating assembly goes to 50% brightness but is evenly lit from edge to edge.

The improved LED illuminating assembly with the multi-sided lighting bar also achieves efficiency over initial capital costs. Conventional LED designs attempt to maximize lumens per emitter and are designed according to the specification ("spec") of the emitter. Emitters operating 'at spec' tend to net about 80 Lumen/watt total.

The improved LED illuminating assembly with the multi-sided lighting bar can be specifically under-driven to achieve some very valuable goals:

1. Longer life span. For example, an emitter operating at 70% of rated capacity will last 70-80,000 hours when specified at 50,000 hours. That's a difference of 8.6 to 5.7 years when run 24 hours per day at seven days a week.

2. Higher efficacy. The improved LED illuminating assembly with the multi-sided lighting bar can achieve over 100 L/W system total by de-tuning the current drive of the emitter. The improved LED illuminating assembly with the multi-sided lighting bar can achieve the same total output by adding more emitters. This may make the initial cost higher but the operational cost will be much lower. This is shown in the illustrated operational costs chart which compares the high output 3600 L LED light bar to the high efficiency 3000 L LED light bar with the exact same design just set to different drive operating levels because the LEDs that are more efficient and last longer when driven below spec.

3. Higher reliability. Within their expected lifespan, LED emitters will maintain lumen longer and maintain color temperature longer when they are cooler, if the temperature is directly proportional to LED drive current. An over-driven LED will lose color temp accuracy quicker than one driven at 'spec'. An under-driven LED can maintain lumen and color temperature longer than even one driven to 'spec'.

The improved LED illuminating assembly can have a no-wire design such that the novel light bar of the improved LED luminary assembly has no electrical wires. This arrangement can decrease assembly problems and lower failure rate associated with complexity in a manual labor portion of the assembly. A conventional LED light bar can have at least twelve hand-made solder joints. The new design can include only two hand-made solder joints as well as eliminating 100% of the electrical wiring. Elimination of standard electrical wires can increase both initial and long term reliability.

The improved light emitting diode (LED) illuminating assembly can comprise a multiple sided modular LED lighting bar, which is also referred to as a multi-sided modular LED light bar, comprising a non-curvilinear LED luminary with a multi-sided elongated tubular array having multiple, server, numerous or many sides comprising modular boards which can define panels with longitudinally opposite ends. The tubular array preferably has a non-curvilinear cross-sectional configuration (cross-section) without and in the absence of a circular cross-sectional configuration, oval configuration, elliptical cross-sectional configuration and a substantially curved or round cross-sectional configuration. Each of the sides of the multi-sided tubular array can have a generally planar flat surface as viewed from the ends of the array, and adjacent sides can intersect each other and converge at an angle of inclination. Operatively positioned and connected to the multi-sided array can be an internal non-switching printed circuit board (PCB) driver comprising a driver board. The driver, which is optional, as described below, can be an interior or inner diver board positioned within an interior of the tubular array or can be an exterior or outer driver board comprising and providing one of the sides of the tubular array. Desirably, at least two or some of the sides comprise modular LED emitter boards which can provide elongated LED PCB panels. The internal drive comprising the driver board can drive the LED emitter boards and can comprise one or more modular driver boards that are connected in series and/or parallel to each other.

The improved LED illuminating assembly comprising a multi-sided light bar providing a non-curvilinear (LED) luminary can have an optimal count of LED emitters comprising a group, set, matrix, series, multitude, plurality or array of light emitting diodes (LEDs) securely positioned, mounted and arranged on each of the emitter boards for emitting and distributing light outwardly from the emitter boards in a light distribution pattern for enhanced LED illumination and operational efficiency.

One or more end cap PCB connectors providing connector end boards which are also referred to as end cap boards can be positioned at one or both of the ends of the tubular array and connected to the internal driver board and the emitter boards. The connector end boards can have connector pins which can extend longitudinally outwardly for engaging at least one light socket. One or more end caps can be positioned about the end cap PCB connectors. The end caps can have bracket segments which provide clamps that can extend longitudinally inwardly for abuttingly engaging and clamping the emitter boards.

The boards can have matingly engageable male and female connectors such that the connectors on the connector end boards matingly engage, connect and plug into matingly engageable female and male connectors on the driver board and on the emitter boards.

The boards comprising the emitter boards and driver board can be generally rectangular. Each of the sides of the multi-sided array comprising emitter boards can comprise a single emitter board or a set, series, plurality, or multiple elongated emitter boards that are longitudinally connected end to end. The sides comprising emitter boards can include all of the sides of the tubular array or all but one of the sides of the tubular array with the one other side comprising the driver board. The driver board can comprise a single driver board or multiple driver boards that are longitudinally connected end to end.

A multiple sided tubular heat sink comprising multiple metal sides can be positioned radially inwardly of the multi-sided tubular array for supporting and dissipating heat generated from the emitter boards and drive board. The heat sink can have a tubular cross-section which is generally complementary or similar to the cross-sectional configuration of the multi-sided tubular array. The cross-section of the heat sink preferably can have a non-curvilinear cross-section without and in the absence of a circular cross-section, oval cross-section, elliptical cross-section and a substantially or round curved cross-section.

The improved LED illuminating assembly comprising a multi-sided light bar providing a non-curvilinear (LED) luminary can have emitter traces for connecting the LED emitters in parallel and/or in series and can have alternating current (AC) and/or direct current (DC) lines. The emitters can comprise at least one row of substantially aligned aliquot uniformly spaced LED emitters. Desirably, the multi-sided light bar provides a no-wire design in the absence of electrical wires.

The improved LED illuminating assembly comprising a multi-sided light bar providing anon-curvilinear (LED) luminary can also have a diffuser comprising an elongated light diffuser cover which provides a light transmissive lens positioned about and covering the LED emitters for reflecting, diffusing and/or focusing light emitted from the LED emitters.

In one embodiment, the lighting bar comprises: a two sided lighting bar; the array comprises a two sided array; the heat sink comprise a heat sink with at least two sides; the emitter boards are arranged in a generally V-shaped configuration at an angle of inclination ranging from less than 180 degrees to an angle more than zero degrees; and the driver is positioned in proximity to an open end of the V-shaped configuration.

In another embodiment, the lighting bar comprises: a three sided lighting bar; the array comprises a three sided delta or triangular array; the heat sink comprises a tubular three sided heat sink with a delta or triangular cross-section; and the angle of inclination can range from less than 180 degrees to an angle more than zero degrees, and is preferably about 120 degrees. The driver can be positioned within the interior of the delta or triangular cross-section of the three sided heat sink.

In a further embodiment, the lighting bar comprises: a four sided lighting bar; the array comprises a square or rectangular array; the heat sink comprises a tubular four sided heat sink with a square or rectangular cross-section; and the angle of inclination can be a right angle of about 90 degrees.

In still another embodiment, the lighting bar comprises: a five sided lighting bar; the array comprises a pentagon array; the heat sink comprises a tubular five sided heat sink with a pentagon cross-section; and the angle of inclination of the intersecting sides of the pentagon can comprise an acute angle, preferably at about 72 degrees.

Light bars, arrays and heat sinks with more than five sides can also be used.

The improved LED illuminating assembly can comprise an illuminated LED sign, such as an outdoor sign or an indoor sign. The outdoor sign can comprise an outdoor menu board, such as for use in a drive-through restaurant. The indoor sign can comprise an indoor menu board such as for use in an indoor restaurant. The indoor signs can also be provided for other uses. The illuminated LED sign can comprise: a housing with light sockets; at least one light transmissive panel providing an illuminated window connected to the housing; multiple sided LED lighting bars, which are also referred to as multi-sided light bars, of the type previously described, connected to the light sockets for emitting light through the illuminated window; and the illuminated window can be movable from a closed position to an open position for access to the LED lighting bars. The lighting bars can extend vertically, horizontally, longitudinally, transversely or laterally along portions of the housing. The illuminated window can be covered by a diffuser.

The improved LED illuminating assembly can also comprise an overhead LED lighting assembly providing overhead ceiling lighting with: translucent ceiling panels comprising light transmissive ceiling tiles; at least one drop ceiling light fixture comprising light sockets; and at least one multiple sided LED lighting bar (multi-sided light bar) of the type previously described, connected to the light sockets and positioned above the ceiling panels for emitting light downwardly through the translucent ceiling panels into a room. At least one concave light reflector can be positioned above the LED lighting bar.

In a preferred aspect of the present invention, the luminary is provided in a non-curvilinear or rectilinear shape. In a more preferred aspect, the luminary has a triangular elongated shape. The individual LEDs, a power source, and a mount board are capable of being within or along any of the elongate sides of the luminary.

Advantageously, the improved LED illuminating assembly with a novel multi-sided LED lighting bar comprising a non-curvilinear LED luminary as recited in the patent claims produced unexpected surprisingly good results.

The term "non-curvilinear" as used in this application means that the sides are generally flat or planar even if portions of the end caps, end cap connectors or heat sink are curved or rounded.

In one form, the invention is directed to an elongate tubular lighting assembly having a body with a length between spaced first and second ends. The term "tubular" encompasses elongate forms of any cross sectional shape having an interior that is at least partially hollow. The tubular lighting assembly has: a source of illumination on or within the body; and first and second connectors respectively at the first and second body ends that are configured to maintain the body in an operative state on a support for the tubular lighting assembly. The first connector has cooperating first and second parts. The first connector part is at the first end of the body. The second connector part is configured to be on a support for the tubular lighting assembly. The first and second connector parts respectively have first and second surfaces. The first and second connector parts are configured so that the first and second surfaces are placed in confronting relationship to prevent separation of the first and second connector parts with the body in the operative state as an incident of the first connector part moving relative to the second connector part from a position fully separated from the second connector part in a substantially straight path that is transverse to the length of the body into an engaged position.

In one form, the source of illumination is at least one of: a) an LED; and b) a gas-discharge lamp that uses fluorescence to produce visible light.

In one form, the second connector has third and fourth connector parts that are respectively structurally the same as the first and second connector parts and interact with each other at the second end of the body in the same way that the first and second connector parts interact with each other at the first end of the body.

In one form, the first and second connector parts are configured so that the first connector part moves against the second connector part as the first connector part moves toward the engaged position, thereby causing a part of at least one of the first and second connector parts to reconfigure to allow the first and second surfaces to be placed in confronting relationship.

In one form, the first connector part has an opening bounded by an edge. The second connector part has a first bendable part on which the second surface is defined. The second connector part is configured so that the first bendable part: a) is engaged by the edge of the opening and progressively cammed from a holding position, in which the first bendable part resides with the first connector part in the fully separated position, towards an assembly position as the first connector part is moved up to and into the engaged position; and b) moves from the assembly position back towards the holding position with the first connector part in the engaged position.

In one form, the first bendable part is joined to another part of the second connector part through a live hinge.

In one form, the first connector part has a wall through which the opening is formed. The first surface is defined by the wall. The wall has a third surface facing oppositely to each of the first surface and a fourth surface on the second connector part. The wall resides captively between the second and fourth surfaces with the first connector part in the engaged position.

In one form, the second connector part has an actuator. The second connector part is configured so that with the first connector part in the engaged position, the actuator can be repositioned to thereby move the first bendable part towards its assembly position to allow the first connector part to be separated from the second connector part.

In one form, the edge extends fully around the opening.

In one form, the opening and second connector part are configured so that the edge and a surface on the second connector part cooperate to consistently align the second connector part with the opening as the second connector part is directed into the opening as the first connector part is changed between the fully separated position and the engaged position.

In one form, the second connector part has a second bendable part that is configured the same as the first bendable part and cooperates with the edge in the same way that the first bendable part cooperates with the edge in moving between corresponding holding and assembly positions. The first and second bendable parts are movable towards each other in changing from their holding positions into their assembly positions.

In one form, the first connector part is part of a first end cap assembly that is at the first end of the body.

In one form, the first end cap assembly has a first cup-shaped component which defines a first receptacle opening towards the second end of the body into which the first end of the body extends.

In one form, the first end cap assembly further includes at least a first connector board. The source of illumination and at least first connector board are configured to be electrically connected (i.e., connected through a conductive path over which current may flow when the assembly is connected to a power supply) as an incident of the first end of the body and first end cap assembly being moved towards each other in a direction substantially parallel to the length of the body into a connected relationship.

In one form, the first end cap assembly includes a first cup-shaped component which defines a first receptacle opening towards the second end of the body into which the first end of the body extends with the first end of the body and first end cap assembly in the connected relationship.

In one form, the elongate tubular lighting assembly is provided in combination with a power supply electrically connected to the second connector part. There are electrical connector components on the at least first connector board and the second connector part that are configured to be electrically connected as an incident of the first connector part moving from the fully separated position into the engaged position.

In one form, the elongate tubular lighting assembly is provided in combination with a support for the body that has a reflector on which the second connector part is located.

In one form, the second connector part is a component separate from the reflector. The second connector part and reflector are configured so that the second connector part and reflector can be press connected.

In one form, the source of illumination consists of at least one LED emitter panel.

In one form, the first connector part is part of a first end cap assembly that is at the first end of the body. The first end cap assembly includes a first cup-shaped component which defines a first receptacle opening towards the second end of the body into which the first end of the body extends. The third connector part is part of a second end cap assembly that is at the second end of the body. The second end cap assembly has a second cup-shaped component which defines a second receptacle opening towards the first end of the body into which the second end of the body extends.

In one form, the first end cap assembly includes at least a first connector board. The second end cap assembly includes at least a second connector board. The source of illumination and at least first connector board are configured to be electrically connected as an incident of the first end of the body and first end cap assembly being moved towards each other in a direction substantially parallel to the length of the body into a connected relationship. The source of illumination and at least second connector board are configured to be electrically connected as an incident of the second end of the body and second end cap assembly being moved towards each other in a direction substantially parallel to the length of the body into a connected relationship.

In one form, the elongate tubular lighting assembly is provided in combination with a support, on which the second and fourth connector parts are located, and a power supply. The end cap assemblies and first and third connector parts are configured so that as an incident of the first connector part moving from the separated position into the engaged position and the third connector part moving relative to the fourth connector part from a corresponding fully separated position into an engaged position, the second and fourth connector parts secure each of the first and second end cap assemblies and the body in connected relationship.

In one form, the elongate tubular lighting assembly is provided in combination with a light diffuser cover for reflecting, diffusing, and/or focusing light from the source of illumination.

In one form, the invention is directed to an elongate tubular lighting assembly having a body with a length between spaced first and second ends. The tubular lighting assembly has: a source of illumination on or within the body; and first and second connectors respectively at the first and second body ends that are configured to maintain the body in an operative state and the illumination source operatively connected to a power supply. The first connector has cooperating first and second connector parts, one each on the body and a support for the body. Conductive connector components on the first and second connector parts are configured to electrically connect between the source of illumination and a power supply. The first and second connector parts are configured to be held together independently of the conductive connector components to thereby maintain the body in the operative state.

In one form, the elongate tubular lighting assembly is provided in combination with a power supply for the source of illumination.

In one form, the first and second connector parts are configured to be snap-connected to each other and held together as an incident of relatively moving the first and second connector parts towards and against each other.

In one form, the second connector includes third and fourth connector parts that are respectively structurally the same as the first and second connector parts and interact with each other at the second end of the body in the same way that the first and second connector parts interact with each other at the first end of the body.

In one form, the third and fourth connector parts are configured to be snap-connected to each other and held together as an incident of relatively moving the third and fourth connector parts towards and against each other.

In one form, the first and second connector parts and third and fourth connector parts are configured to be snap-connected as an incident of the body with the first and third connector thereon moved transversely to the length of the body.

In one form, the first and second connector parts are configured so that the conductive connector components on the first and second connector parts are electrically connected to each other as an incident of the first and second connector parts being snap-connected to each other.

In one form, the first connector part is part of a first end cap assembly. The first end cap assembly and illumination source are configured so that one of the conductive components on the first connector part is electrically connected to the source of illumination as an incident of the first connector part and first end of the body being moved against and relative to each other in a direction substantially parallel to the length of the body.

In one form, the first end cap assembly has a first cup-shaped component into which the first end of the body extends.

In one form, the invention is directed to an elongate tubular lighting assembly having a body with a length between spaced first and second ends. The tubular lighting assembly has: a source of illumination on or within the body; and first and second connectors respectively at the first and second body ends that are configured to maintain the body in an operative state on a support for the tubular lighting assembly. The first connector has cooperating first and second parts. The first connector part is at the first end of the body. The second connector part is configured to be on a support for the tubular lighting assembly. At least one conductive component on each of the first and second connector parts is configured to electrically connect to each other and between the illumination source and a power supply. The illumination source has at least one conductive component. The first connector part, body, and illumination source are configured so that the at least one conductive component on the illumination source is electrically connected to the at least one conductive component on the first connector part as an incident of the first connector part and first end of the body moved from an initially fully separated state towards and against each other.

In one form, the second connector has third and fourth connector parts that are respectively structurally the same as the first and second connector parts and interact with each other at the second end of the body in the same way that the first and second connector parts interact with each other at the first end of the body.

In one form, the first and second connector parts, body, and illumination source are configured so that: a) the at least one conductive component on the illumination source is electrically connected to the at least one conductive component on the first connector part; and b) at least another conductive component on the illumination source is electrically connected to at least another conductive component on the third connector part as an incident of the body and first and third connector parts being moved towards and against each other in a direction substantially parallel to the length of the body.

In one form, the first connector part is part of a first end cap assembly having a first cup-shaped component opening towards the second end of the body into which the first end of the body extends.

In one form, the third connector part is part of a second end cap assembly having a second cup-shaped component opening towards the first end of the body into which the second end of the body extends.

In one form, the elongate tubular lighting assembly is provided in combination with a support on which the second and fourth component parts are located. With the body in the operative state, the first and second cup-shaped components reside captively between the second and fourth connector parts so that the first and second cup-shaped components are blocked from being separated respectively from the first and second ends of the body.

BRIEF DESCRIPTION OF THE DRAWINGS

FIG. 47 is a schematic diagram of another prototype non-curvilinear LED luminary in accordance with principles of the present invention;

FIG. 48 is an enlarged cross-sectional view of a prototype delta three sided noncurvilinear LED luminary in accordance with principles of the present invention and taken along line A-A of FIG. 47;

FIG. 49 is a bottom view of the non-curvilinear LED taken along line B of FIG. 48;

A more detailed explanation of the principles of the invention is provided in the following detailed descriptions of example embodiments thereof, taken in conjunction with the accompanying drawings, briefly described above.

DETAILED DESCRIPTION OF THE PREFERRED EMBODIMENTS

The following is a detailed description and explanation of the preferred embodiments of the invention and best modes for practicing the invention.

Figure 1:
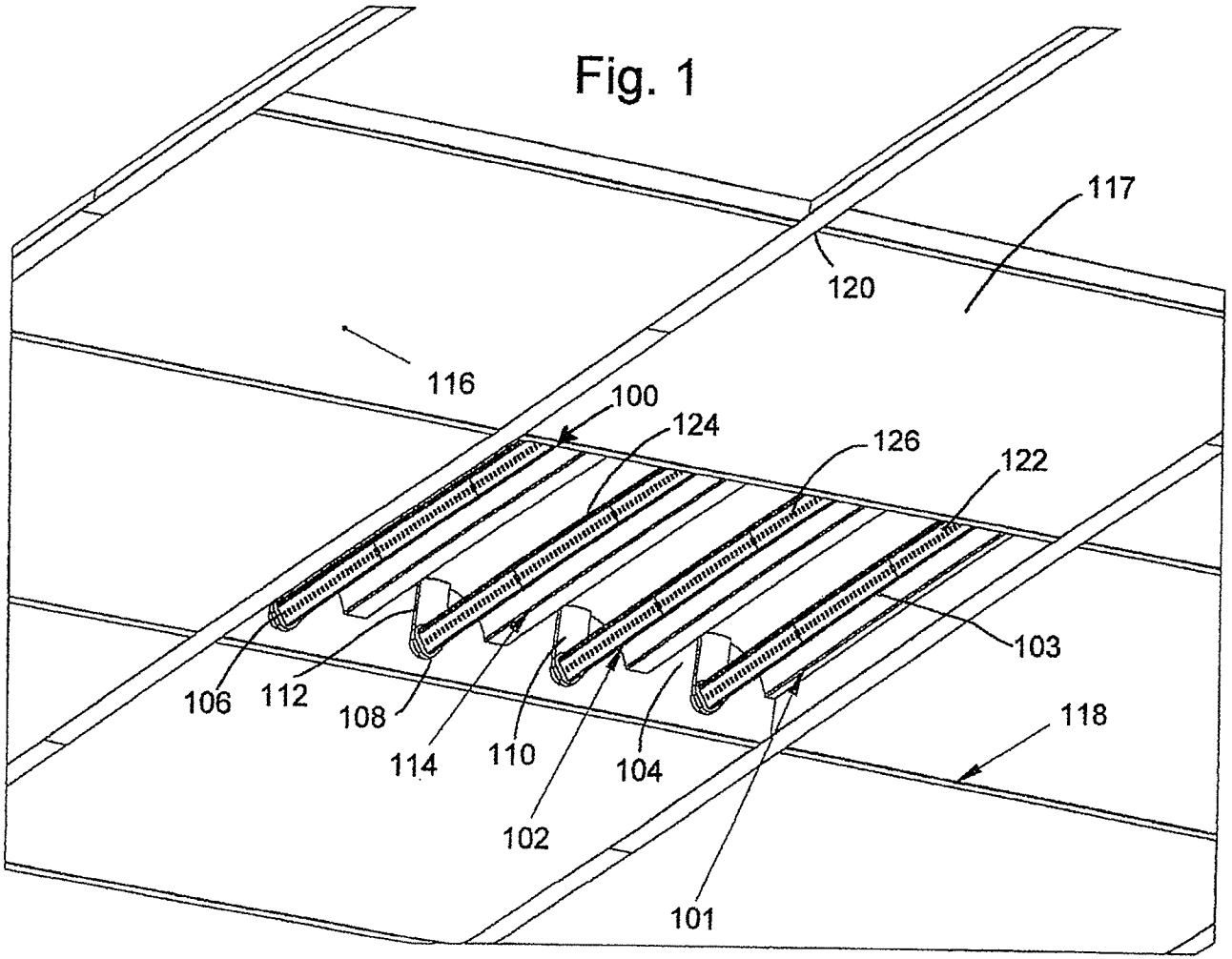
FIG. 1 is a perspective view of an LED drop ceiling fixture with three sided delta non-curvilinear LED luminaries mounted to a ceiling above ceiling panels in accordance with principles of the present invention.
Figure 2:
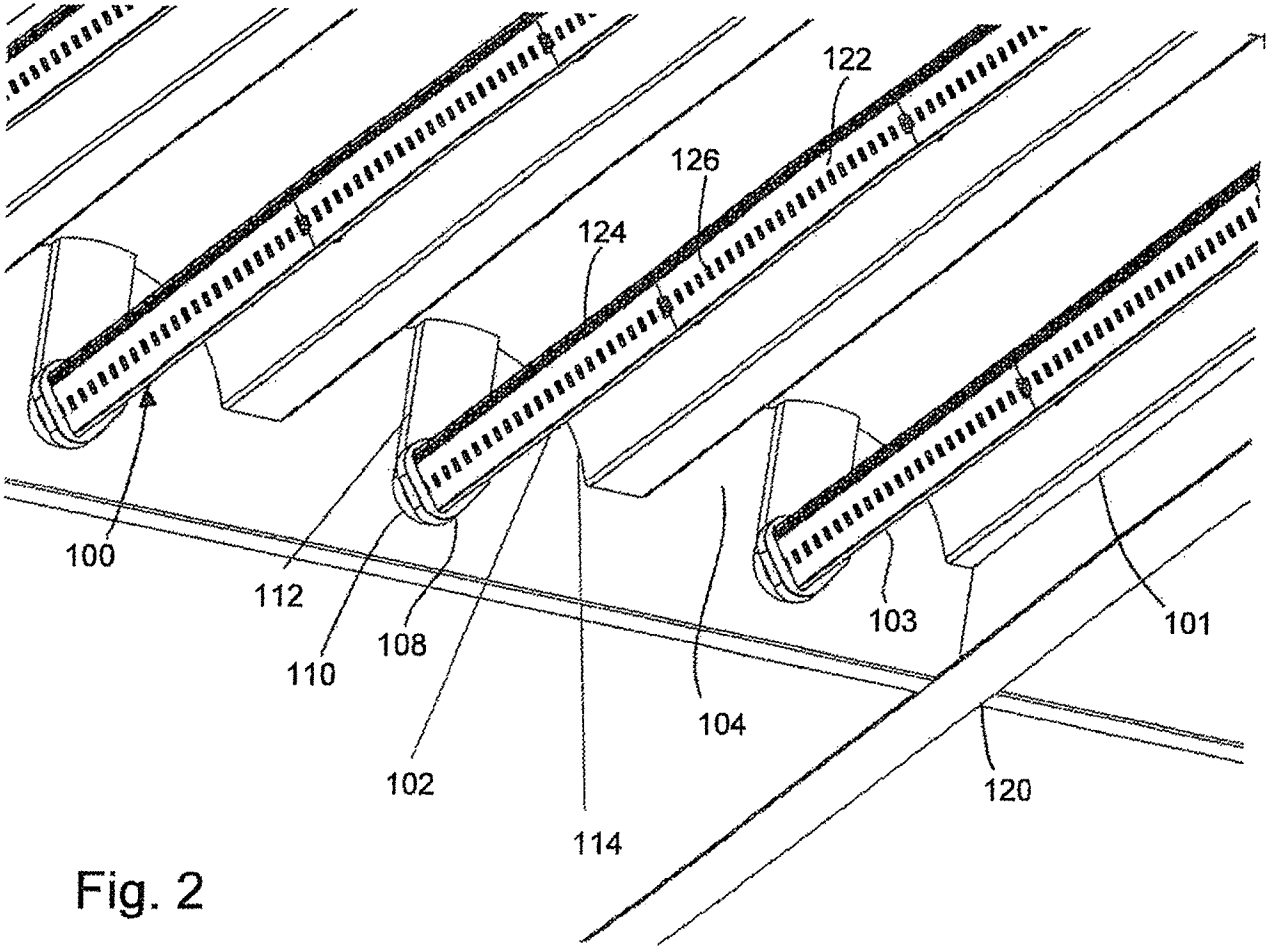
FIG. 2 is an enlarged view of portions of the LED drop ceiling fixture with three sided delta non-curvilinear LED luminaries of FIG. 1.
Figure 3:
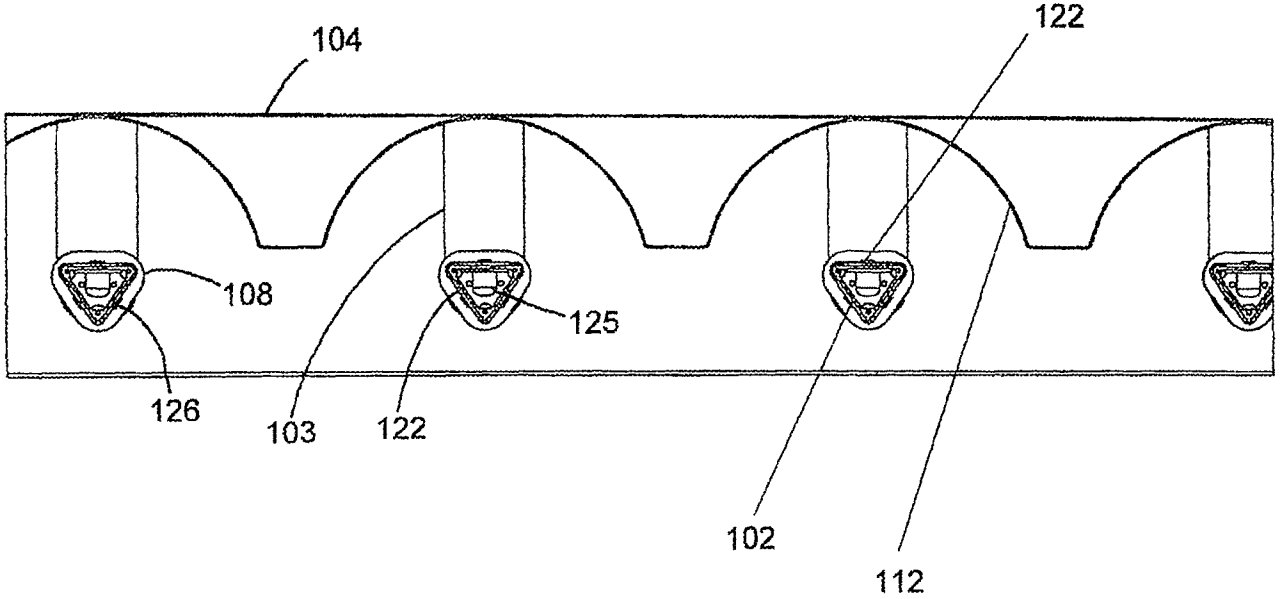
FIG. 3 is a cross-section view of the LED drop ceiling fixture with three sided delta LED non-curvilinear luminaries of FIG. 1.
Figure 4:
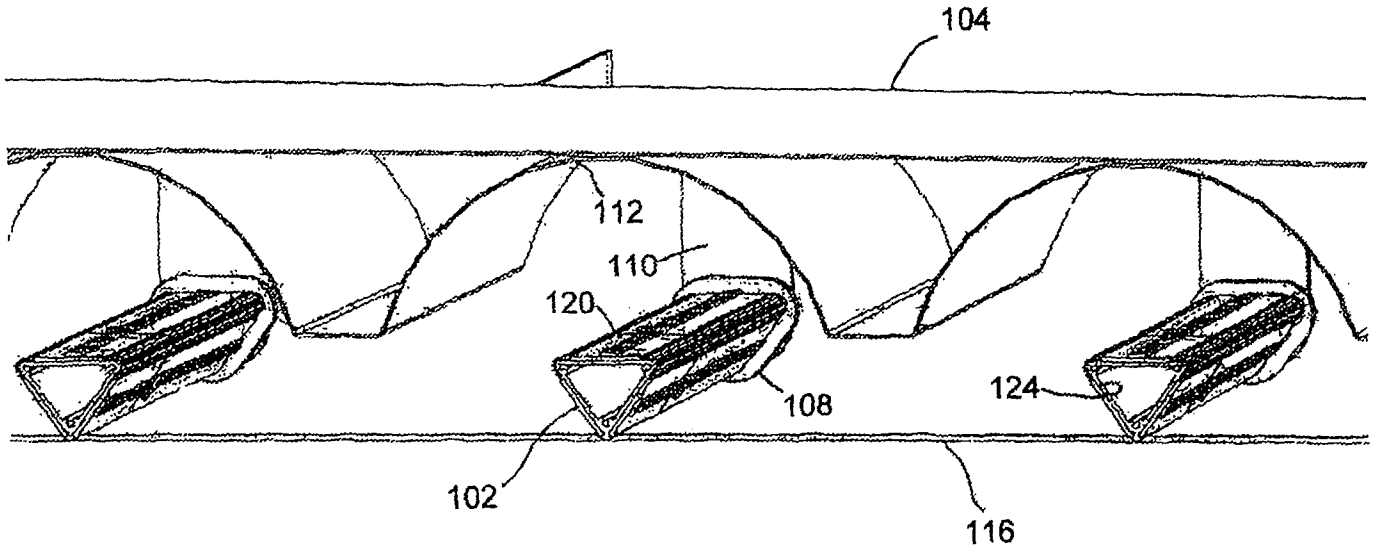
FIG. 4 is an enlarged perspective view of the three sided delta LED luminaries of FIG. 1.

Referring to the drawings, FIG. 1 is a perspective view of a light emitting diode (LED) light illuminating assembly 100 comprising an overhead LED lighting assembly providing overhead ceiling lighting with a two by four (2×4) LED drop ceiling fixture 101 with a multiple sided modular LED lighting bars 102, which are also referred to a multi-sided LED light bars. The lighting bars can comprise three sided delta triangular shaped non-curvilinear light emitting diode (LED) luminaries 103 which can be mounted to a ceiling 104, such as by power connector pins 106 extending from three sided delta triangular shaped end caps 108 which can securely engage light sockets 110. FIG. 2 is an enlarged view of portions of the multi-sided LED lighting bar comprising a LED drop ceiling fixture with three sided delta non-curvilinear LED luminaries of FIG. 1. Upright metal side members 112 can provide a bracket which can integrally extend between and connect the light sockets to overhead metal concave light reflectors 114. The light reflectors can be positioned above the three sided delta non-curvilinear LED luminaries to reflect light downwardly towards a floor. The three sided delta non-curvilinear LED luminaries, sockets and reflectors can be positioned above light transmissive translucent ceiling panels 116 (FIG. 1) providing light transmissive ceiling tiles arranged in a grid or pattern. The ceiling tiles can comprise an elongate light diffuser 117 providing a light transmissive lens for diffusing and/or focusing light emitted from the LED emitted on towards the floor. The ceiling panels can be connected by a ceiling grid 118 of longitudinal and lateral rows of ceiling panel-connectors 120. FIG. 3 is a cross-section view of the LED drop ceiling fixture with three sided delta LED non-curvilinear luminaries and illustrating elongated LED emitter printed circuit board (PCB) panels 122, which are also referred to as modular LED emitter boards. The LED PCB panels can be mounted or otherwise secured upon and/or positioned radially outwardly of the sides of an elongated three sided, delta or triangular tubular metal heat sink 124 (FIG. 1) to form a three sided delta or triangular array or set of emitter boards. The intersecting sides of the three sided heat sink can provide corners and apexes of the heat sink which sink can be raised, rounded, or chamfered, if desired. An internal non-switching PCB 125 comprising a driver board can be positioned in the interior of the array to drive the emitter boards. FIG. 4 is an enlarged perspective view of the three sided delta LED luminaries. Each of the three sided LED emitter PCB panels can contain a set, matrix or array of one or more rows of aligned, aliquot, uniformly spaced LED emitters 126. The heat sink can comprise an aluminum extrusion and can dissipate heat generated by the LED emitters and driver.

Figure 5:
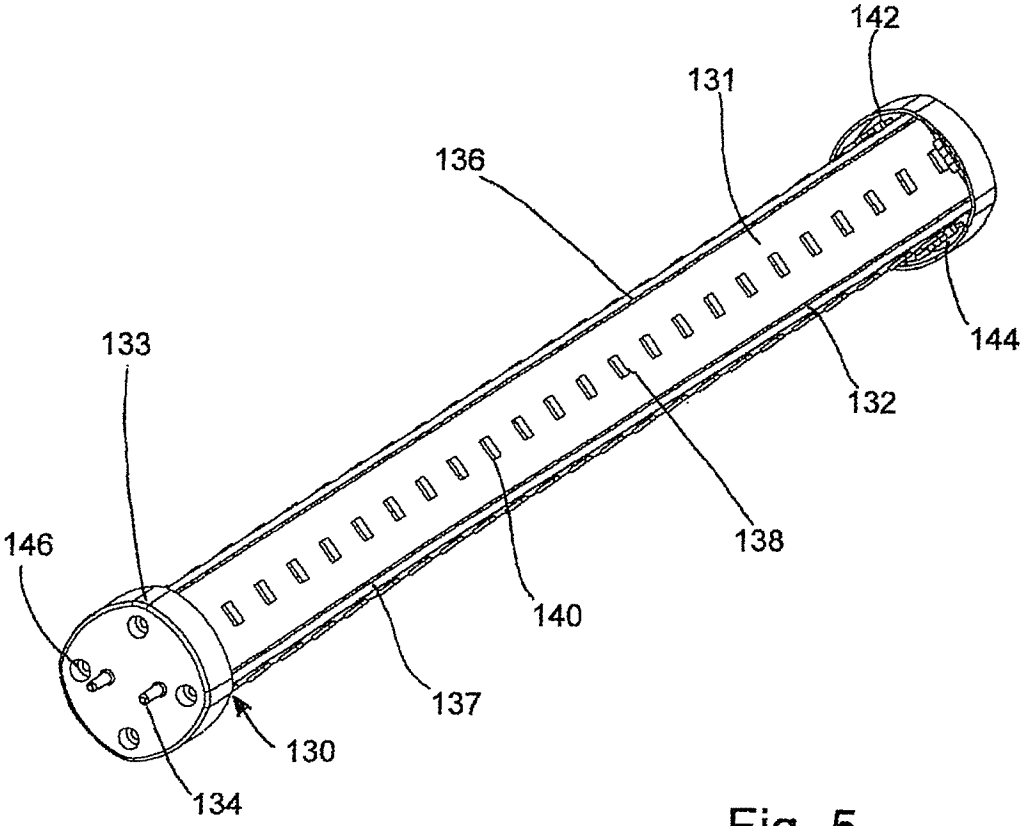
FIG. 5 is a perspective view of a four sided rectangular or square non-curvilinear LED luminary in accordance with principles of the present invention.

FIG. 5 is a perspective view of a LED illuminating light assembly 130 comprising a four sided modular LED lighting bar 131 (LED light bar) providing a four sided rectangular or square non-curvilinear LED luminary 132 which can have end caps 133 and outwardly extending power connector pins 134 for securely engaging a light socket. The four sided LED luminary can have an elongated four sided tubular metal heat sink 136, such as formed from an aluminum extrusion.

The intersecting side of the four sided heat sink can provide corners and apexes 137 of the heat sink which can be raised, rounded, curved or chamfered, if desired. Elongated LED emitter PCB panels 138 providing modular emitter boards can be mounted or otherwise secured upon and/or positioned radially outwardly of the heat sink in a generally rectangular shaped array. Each of the LED emitter PCB panels can be rectangular and can contain one or more rows of aligned, aliquot, uniformly spaced LED emitters 140. The heat sink can dissipate heat generated by the LED emitters. Terminals 142 can be connected to an end cap printed circuit board (PCB) connector 144 comprising a connector end board which is also referred to as an end cap board that can be fastened by screws 146 to the end cap. An internal non-switching PCB driver comprising a driver board can be positioned in the interior of the array to drive the emitter boards.

Figure 6:
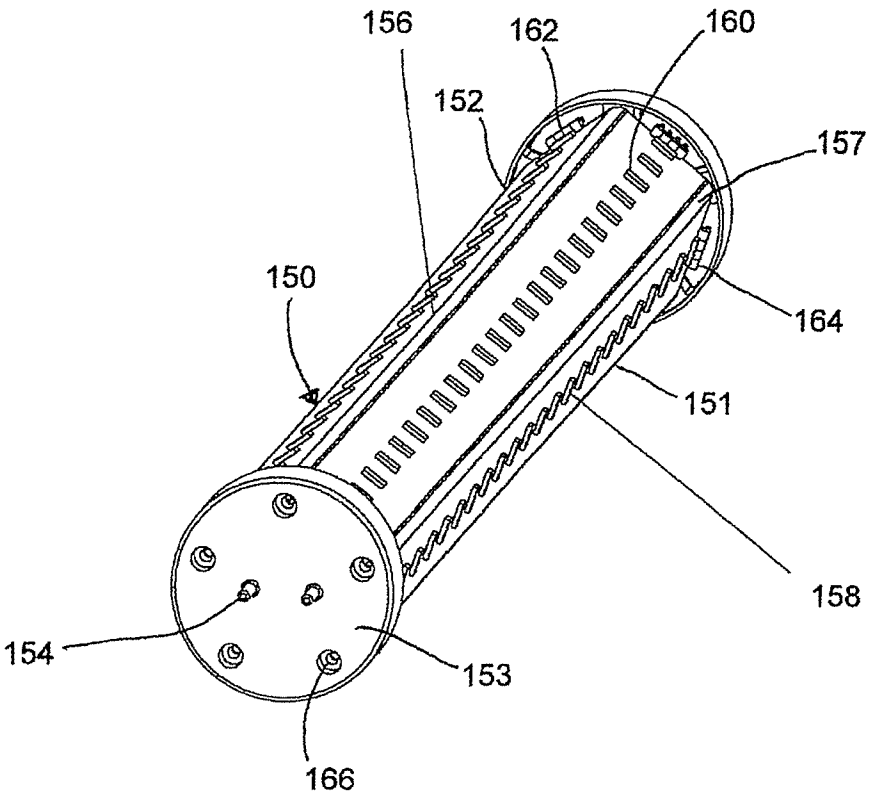
FIG. 6 is a perspective view of a five sided pentagon non-curvilinear LED luminary in accordance with principles of the present invention.
Figure 7:
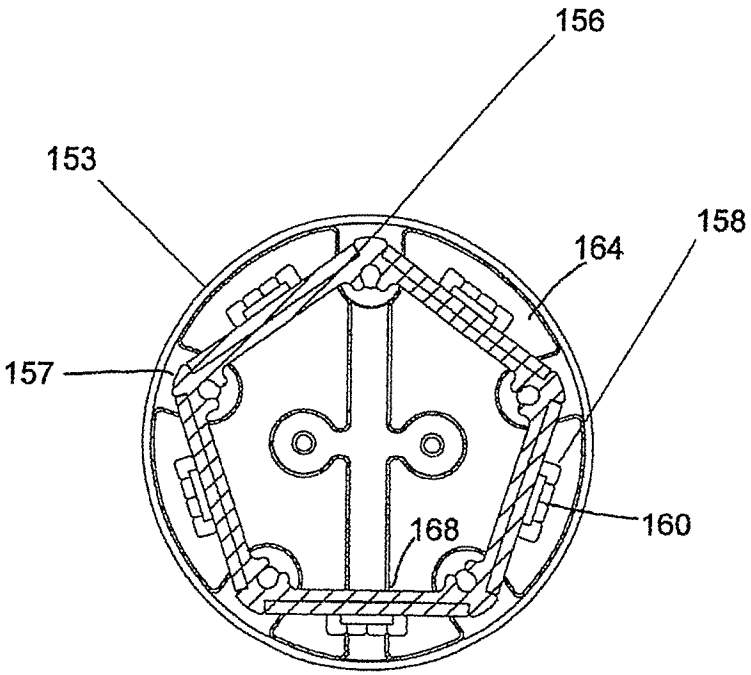
FIG. 7 is an enlarged cross-sectional view of the five sided pentagon noncurvilinear LED luminary of FIG. 6.

FIG. 6 is a perspective view of a LED illuminating assembly 150 comprising a five sided modular LED lighting bar 151 (LED light bar) providing a five sided pentagon shaped non-curvilinear LED luminary 152. The luminary can have end caps 153 and outwardly extending power connector pins 154 for securely engaging a light socket. The five sided LED luminary can have an elongated five sided pentagon shaped tubular metal heat sink 156, such as formed from an aluminum extrusion. The intersecting sides of the pentagon heat sink provides corners and apexes 157 of the heat sink which can be raised, rounded, curved or chamfered, if desired. Elongated LED emitter PCB panels 158, also referred to as modular LED emitter boards, can be mounted or otherwise secured upon and/or radially outwardly of the heat sink to form a five sided pentagon array of LED emitter PCB panels. Each of the five sided LED emitter PCB panels can be rectangular and contain one or more rows of aligned, aliquot, uniformly spaced LED emitters 160. Terminal(s) 162 can be connected to an end cap PCB connector 164 comprising a connector end board which is also referred to as an end cap board which can be fastened by screws 166 to the end cap. FIG. 7 is an enlarged cross-sectional view of the five sided pentagon non-curvilinear LED luminary. An internal non-switching PCB driver 168 comprising a driver board can be positioned in the interior of the array to drive the emitter boards. The heat sink can dissipate heat generated by the LED emitters and driver.

Figure 8:
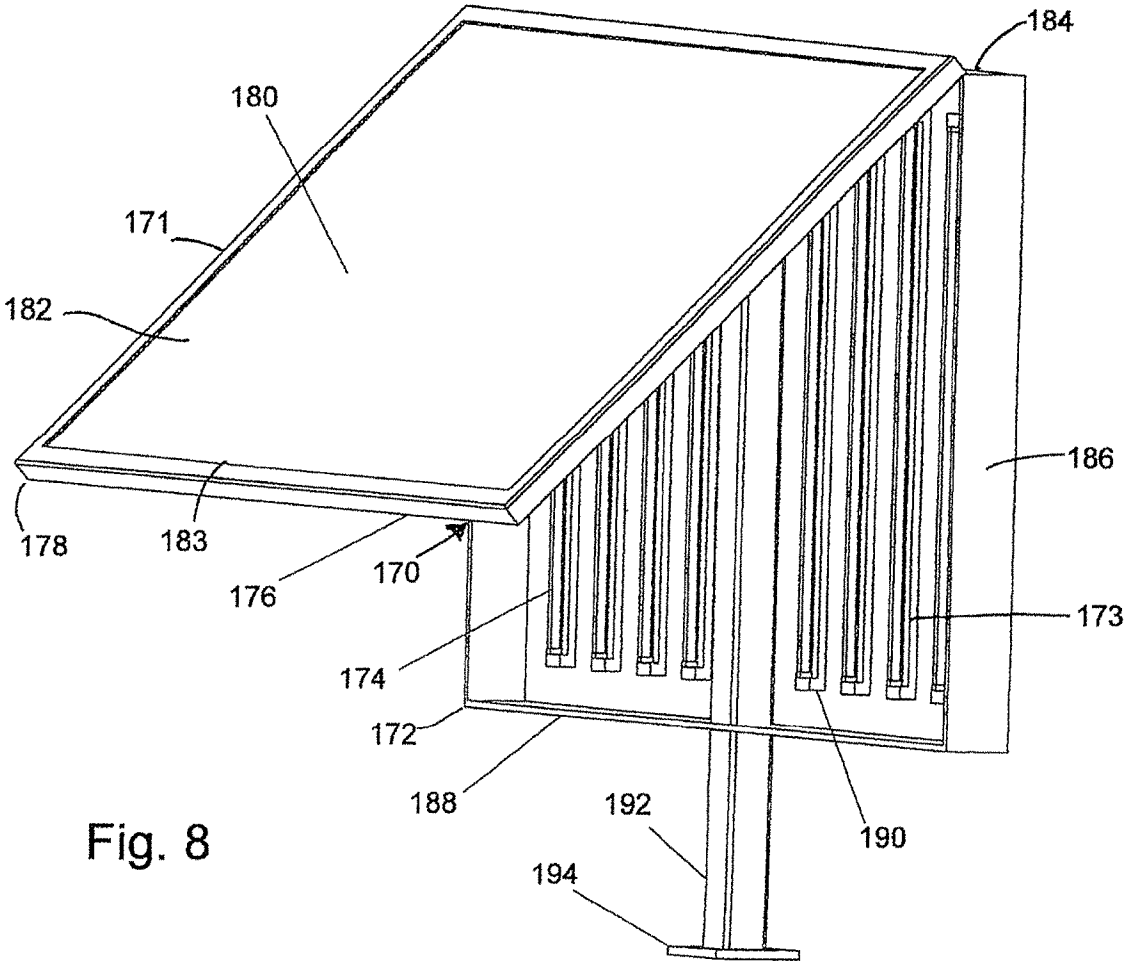
FIG. 8 is a perspective view of an outdoor menu board providing an outdoor sign with two sided delta non-curvilinear LED luminaries such as for drive through menu board applications and illustrating the menu board door partially open in accordance with principles of the present invention.
Figure 9:
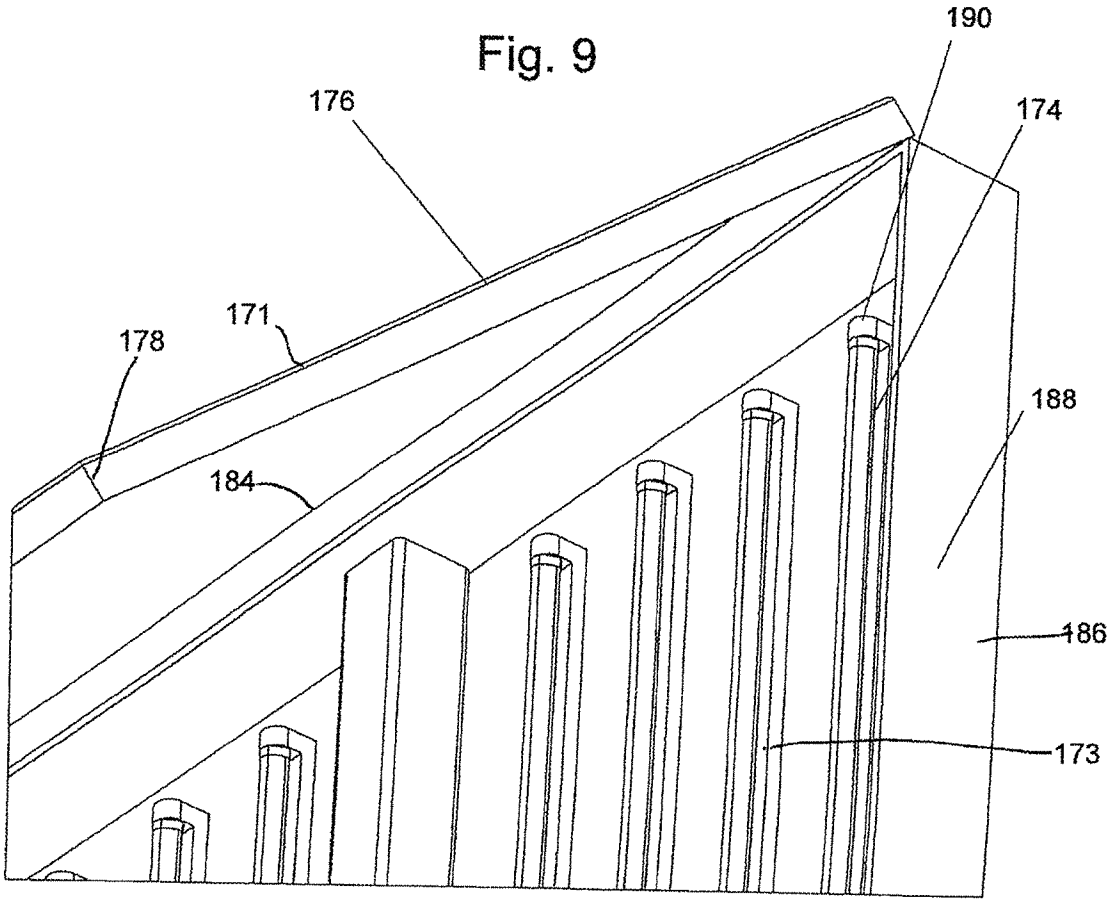
FIG. 9 is an enlarged view of portions of the outdoor menu board of FIG. 8.

FIG. 8 is a perspective view of an LED illuminating assembly 170 comprising an elongated outdoor menu board 171 which can provide an outdoor sign 172 with two sided modular LED lighting bars 173 (LED light bars) comprising two sided or delta non-curvilinear LED luminaries 174 such as to drive through menu board applications. FIG. 8 also illustrates the front menu board door 176 partially open. The front menu board can comprise a rectangular frame 178 to peripherally surround and secure light transmissive panel(s) 180 which can provide a door plex comprising an illuminated menu window 182. The menu window can provide illuminated signage which can comprise an elongated light diffuser 183 that can provide a light transmissive lens for diffusing and/or focusing light emitted from the LED outwardly. The front menu board door can be pivotally hinged or removably attached to the top 184 or one of the sides 186 of the outdoor menu board housing 188. The back of the housing can also have a light transmissive panel(s), if it is desired to illuminate both the front and back of the outdoor menu board. The two sided delta non-curvilinear LED luminaries can be connected, such as by power connector pins, to light socket assemblies 190. The two sided delta non-curvilinear LED luminaries can be positioned vertically, longitudinally, laterally, transversely, or horizontally in the interior of the outdoor menu board housing. A menu board vertical upright support post 192, which can have a rectangular, square, or rounded cross section, can be mounted on a base plate and connected to the top of the menu board housing along the vertical centerline of the housing, to support and elevate the outdoor menu board housing, door and illuminated menu window. FIG. 9 is an enlarged view of portions of the outdoor illuminated menu board.

Figure 10:
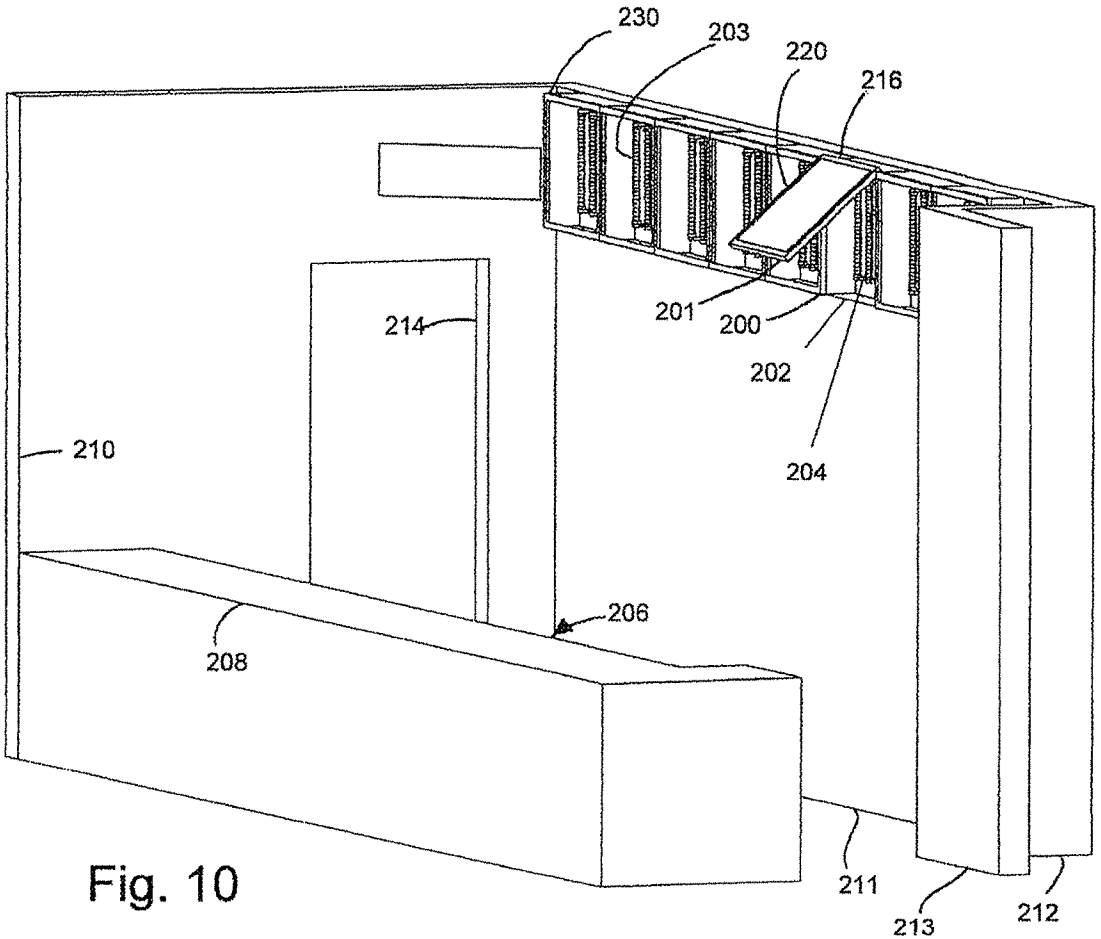
FIG. 10 is a perspective view of an indoor menu board providing an indoor sign with three sided delta non-curvilinear LED luminaries such as for a restaurant, and illustrating one of the panel doors in a partially open position in accordance with principles of the present invention.
Figure 11:
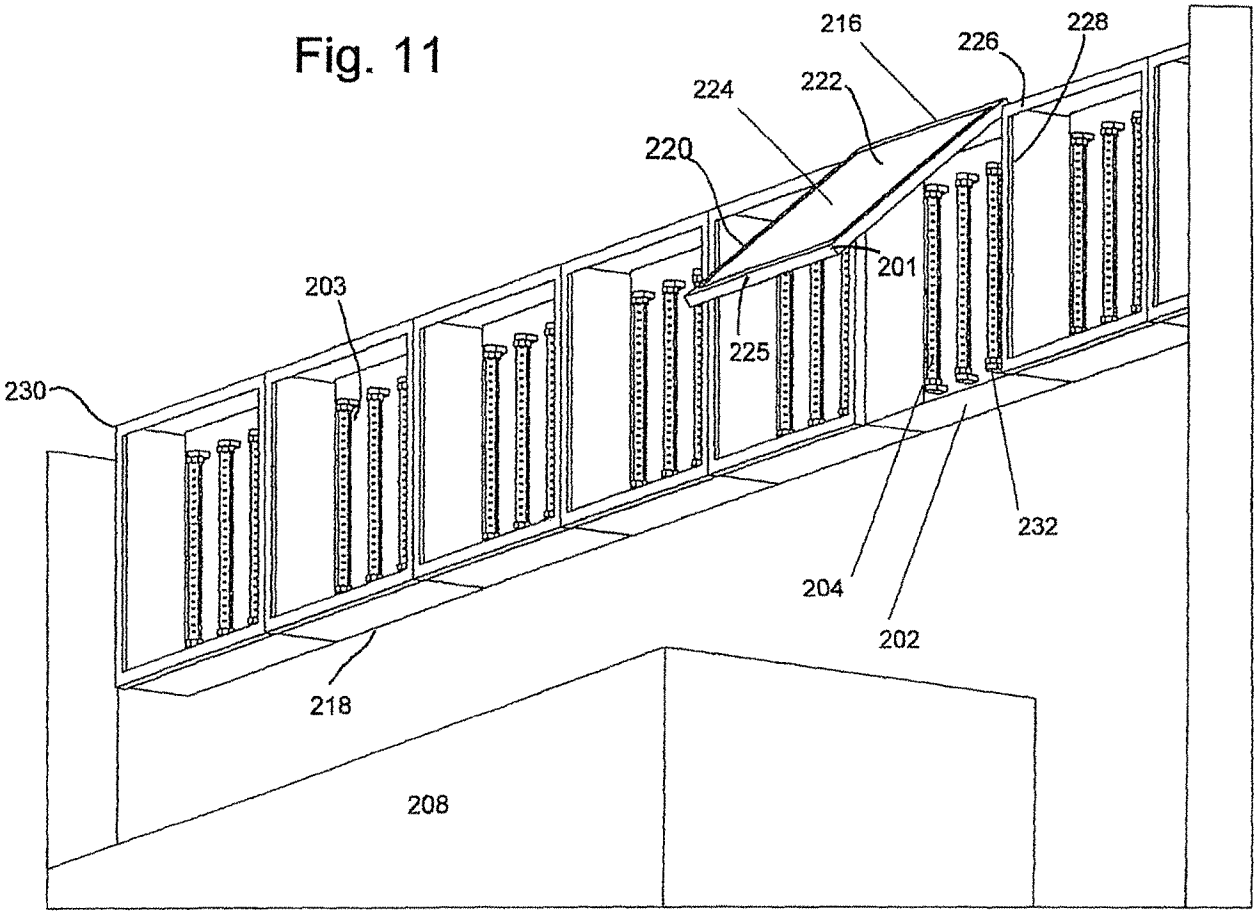
FIG. 11 is an enlarged view of portions of the indoor menu board of FIG. 10.

FIG. 10 is a perspective view of LED illuminating assembly 200 comprising an elongated indoor menu board 201 providing a wall mounted indoor sign 202 with two or three sided modular LED lighting bars 203 (LED light bars) comprising two or three sided delta non-curvilinear LED luminaries 204 for use such as in, but not limited to a restaurant 206 with a counter 208, walls 210-213, exit and/or entrance door 214 and a counter 214 and illustrating one of the menu panel doors 216 in a partially open position. FIG. 11 is an enlarged view of portions of the indoor menu board. The back 218 of the menu board can be securely mounted on a wall. The front of the menu board can comprise one or more menu panel doors such as a set or array of horizontally aligned menu panel doors. Each menu panel door can comprise a rectangular frame 220 to peripherally surround and secure a light transmissive panel 222 which can provide a door apex comprising an illuminated menu window 224. The menu window can provide illuminated signage which can comprise an elongated light diffuser 225 that can provide a light transmissive lens for diffusing and/or focusing light emitted from the LED outward into the room or interior of the restaurant. Each menu board panel door can be pivotally hinged or removably attached to the top 226 or one of the sides 228 of the menu board housing 230. The two or three sided delta non-curvilinear LED luminaries can be connected, such as by power connector pins, to light socket assemblies 232. The two sided delta non-curvilinear LED luminaries can be positioned vertically, longitudinally, laterally, transversely or horizontally in the interior of the outdoor menu board housing.

Figure 12:
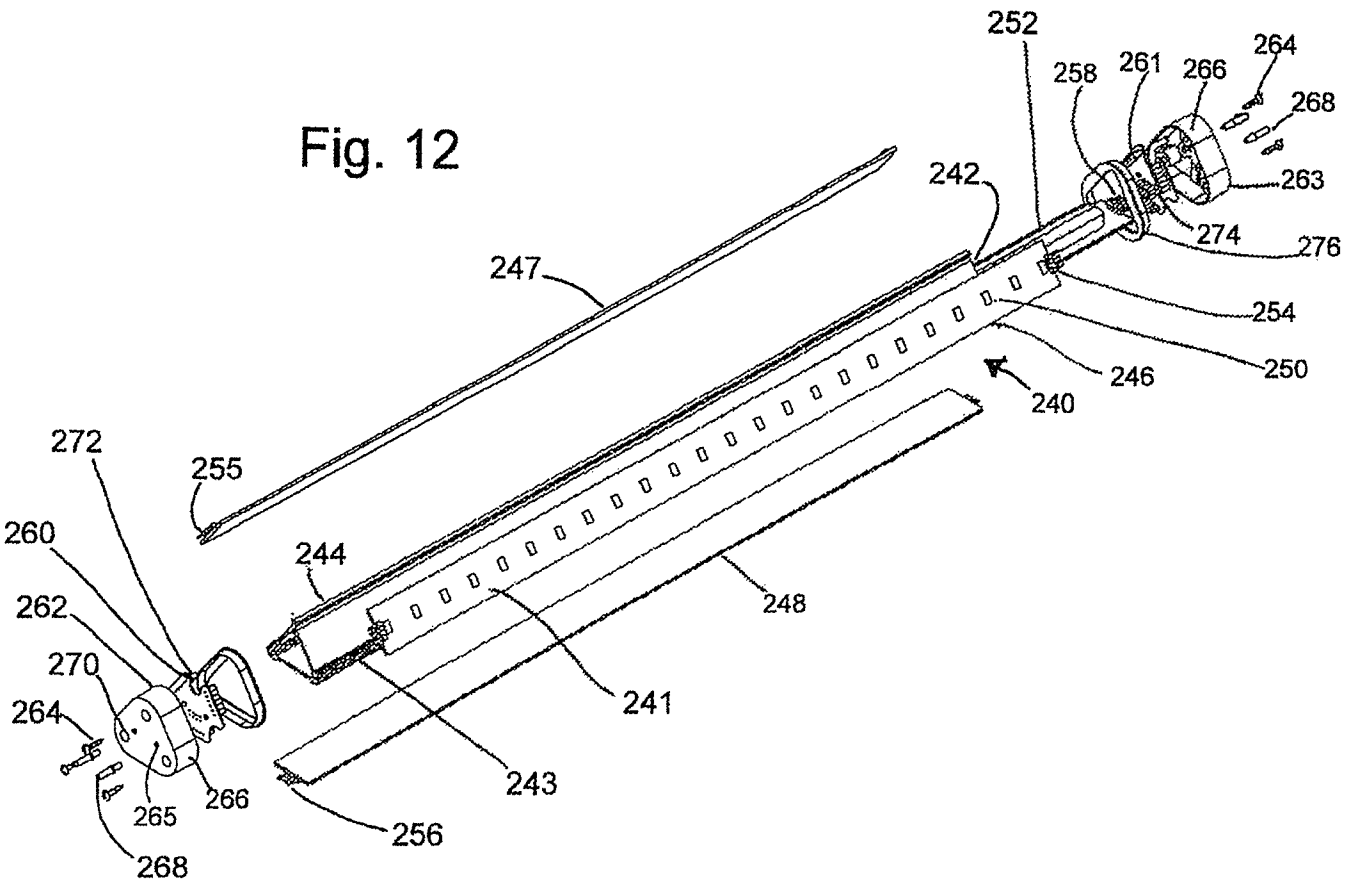
FIG. 12 is an exploded assembly view of a three sided delta non-curvilinear LED luminary in accordance with principles of the present invention.
Figure 13:
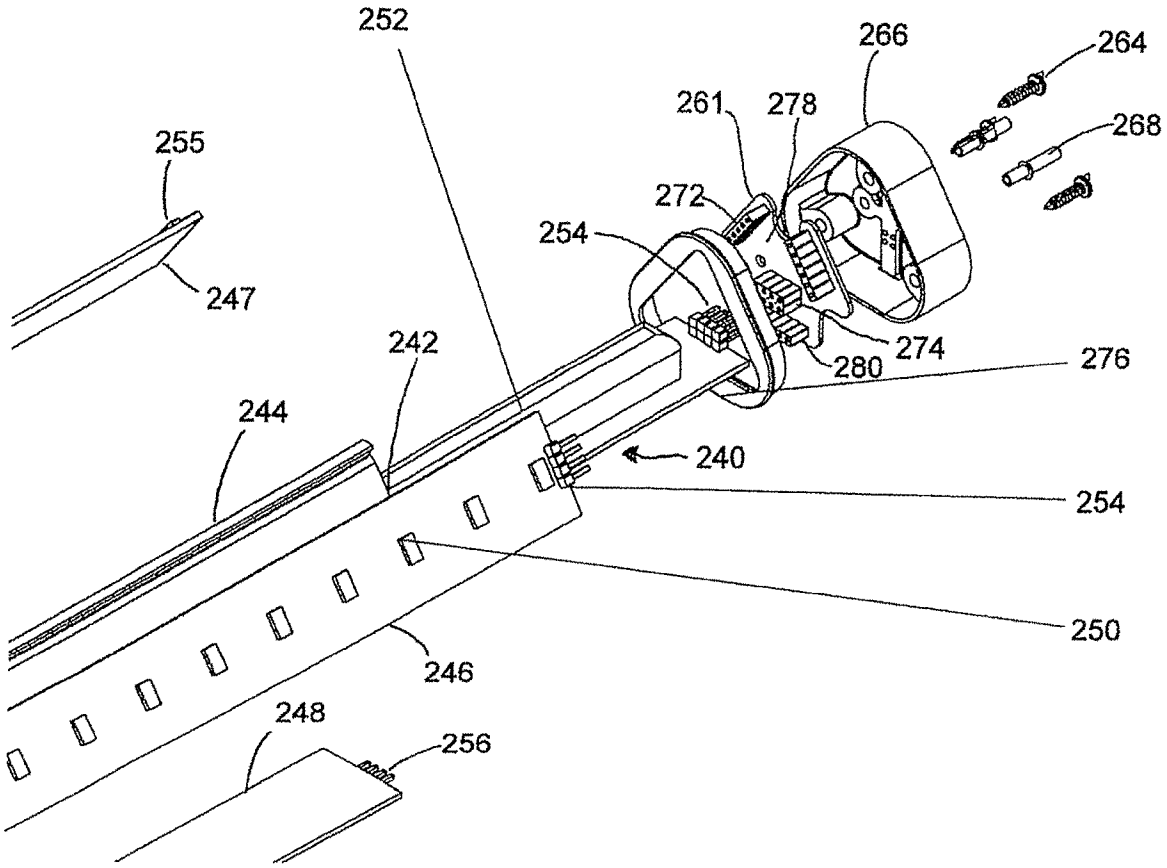
FIG. 13 is an enlarged view of the right portions of the three sided delta noncurvilinear LED luminary of FIG. 12.
Figure 14:
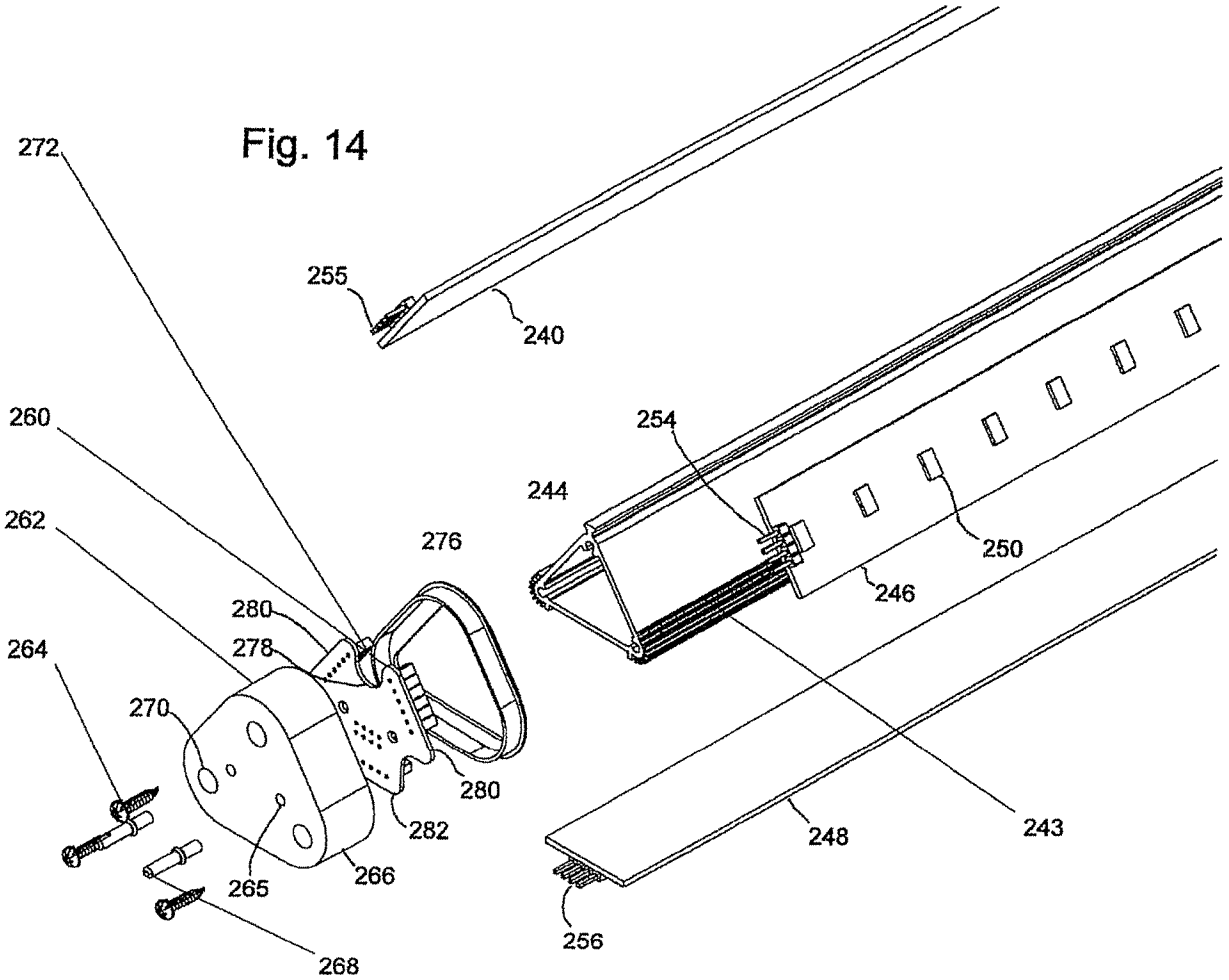
FIG. 14 is an enlarged view of the left portions of the three sided delta noncurvilinear LED luminary of FIG. 12.

FIG. 12 is an exploded assembly view of LED illuminating assembly 240 comprising a three sided modular LED lighting bar 241 (LED light bar) providing a three sided delta or triangular shaped non-curvilinear LED luminary 242. FIG. 13 is an enlarged view of the right portions of the three sided delta non-curvilinear LED luminary of FIG. 12. FIG. 14 is an enlarged view of the left portions of the three sided delta non-curvilinear LED luminary of FIG. 12. The three sided delta non-curvilinear LED luminary can have a three sided delta triangular shaped metal heat sink 243, such as formed from extruded aluminum. The intersecting corners 244 providing apexes of the heat sink can be raised, rounded or chamfered, if desired. Elongated LED emitter PCB panels 246-248 can be mounted or otherwise secured upon and/or positioned radially outwardly of the heat sink in a generally triangular or delta shape. Each of the LED emitter PCB panels can be rectangular and can contain one or more rows of aligned, aliquot, uniformly spaced modular LED emitters 250. An internal non-switching elongated printed circuit board 9 PCB) driver 252, also referred to as a driver board, can be positioned along the length of and within the interior area bounded by the heat sink. The heat sink can dissipate heat generated by the LED emitters and PCB driver. Emitter board terminals 254-256 can extend longitudinally outwardly from the LED emitter boards. Driver board terminals 258 can be extended longitudinally outwardly from the PCB driver. The three sided delta triangular shaped non-curvilinear LED luminary can have three sided delta end cap PCB connectors 260-261 comprising connector end boards which are also referred to as end cap boards that can be secured to three sided delta or triangular shaped end caps 262-263, respectively, by fasteners 264, such as screws, through screw holes 265 in the end caps. The end caps can have rounded corners 266 or apexes. Power connector pins 268 can extend laterally outwardly from the connector end boards through connector pin-receiving holes 270 in the end caps for secure engagement with a light socket. The connector end boards can have end cap board terminals 272 which extend longitudinally inwardly along its three sides which can connect to the emitter board terminals. The connector end boards can also have a driver board connecting terminals 274 which extends longitudinally inwardly from central portions of the connector end boards and can be connected to the drive board terminals. A three sided delta or triangular shaped covers 276 can provide rims for positioning about the end caps. As best shown in FIG. 14, the connector end boards can each have a central U-shaped concave notched portion 278 between two of the sides 280 and 282 and can have a lower third side 284 which extends below the lower portions of the other two sides. The sides 280-284 can be straight, flat and planar.

Figure 15:
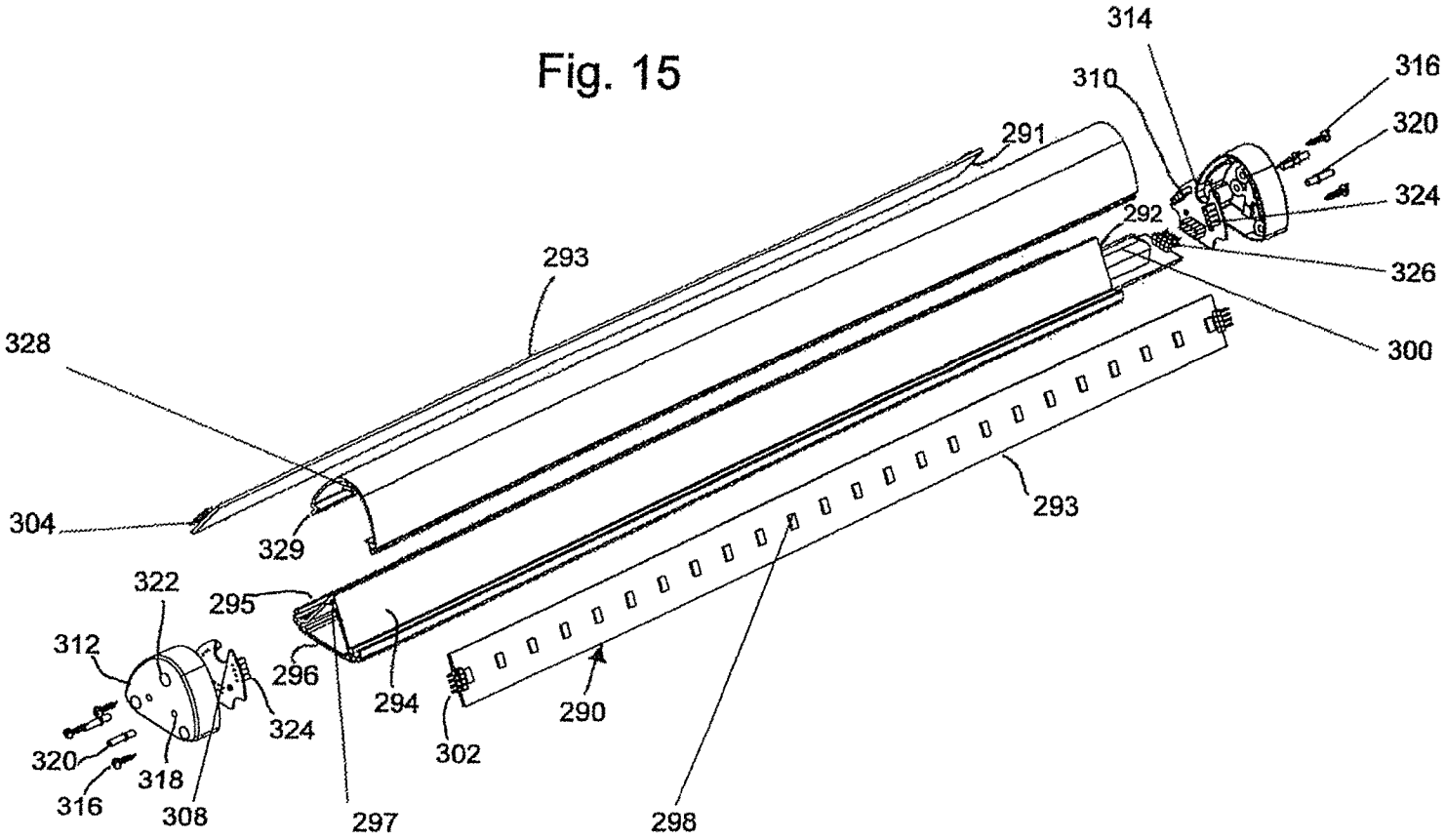
FIG. 15 is an exploded assembly view of a two sided non-curvilinear LED luminary in accordance with principles of the present invention.
Figure 16:
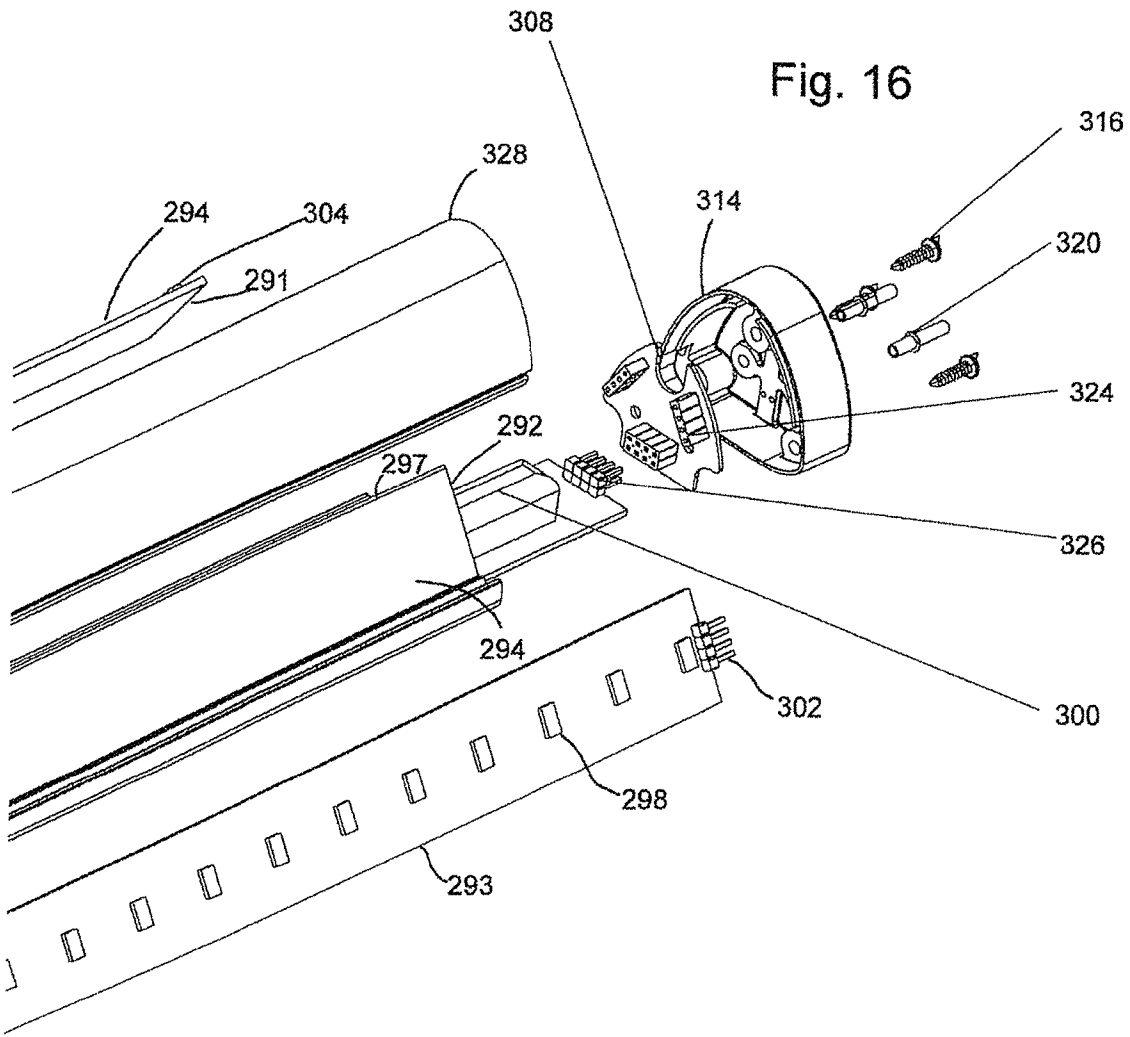
FIG. 16 is an enlarged view of the right portions of the two sided noncurvilinear LED luminary of FIG. 15.

FIG. 15 is an exploded assembly view of a LED illuminating assembly 290 comprising a two sided modular LED lighting bar 291 (LED light bar) providing a two sided elongated non-curvilinear LED luminary 292 which is similar to the three sided delta or triangular shaped non-curvilinear LED luminary of FIGS. 12-14 except there are only two elongated LED emitter PCB panels 293 comprising modular LED emitter boards which can be mounted or otherwise secured upon and/or positioned radially outwardly of the two sides 294 and 295 of the three sides 294-296 of the three sided delta or triangular shaped metal heat sink 297. The two LED emitter panels can be positioned in a generally V shape. FIG. 16 is an enlarged view of the right portions of the two sided non-curvilinear LED luminary of FIG. 15. Each of the LED emitter PCB panels can be rectangular and can contain one or more rows of aligned, aliquot, uniformly spaced LED emitters 298. An internal non-switching elongated printed circuit board (PCB) driver 300 can be positioned along the length of and within the interior area bounded by the heat sink. The heat sink can dissipate heat generated by the LED emitters and PCB driver. Emitter board terminals 302 and 304, which are also referred to as emitter board connectors, can extend longitudinally outwardly from the LED emitter boards. Driver board terminals 306 can extend longitudinally outwardly from the PCB driver. The two sided delta triangular shaped non-curvilinear LED luminary can have three sided delta or triangular connector end boards 308 and 310 comprising connector end boards which can be secured to three sided delta or triangular shaped end caps 312 and 314, respectively, by fasteners 316, such as screws, through screw holes 318 in the end caps. Power connector pins 320 can extend laterally outwardly from the connector end boards through connector pin-receiving holes 322 in the end caps for secure engagement with a light socket. The connector end boards can have end cap board terminals 324, which are also referred to as surface mount connectors, that can extend longitudinally inwardly along two of its three sides and can be aligned with and connect to the emitter board terminals. The connector end boards can also have a driver board connecting terminals 326 which extends longitudinally inwardly from central portions of the PCB end cap connector boards and can be connected to the driver board terminals. An elongated light diffuser cover 328 comprising a concave translucent or transparent light transmissive lens can cover the LED emitter boards for reflecting, diffusing and/or focusing light emitted from the LED emitters. The lens can be formed of plastic or glass and can be rounded, semicircular and positioned radially outwardly of the LED emitters. The lens can have inward facing feet 329 which can snap fit about the heat sink.

Figure 17:
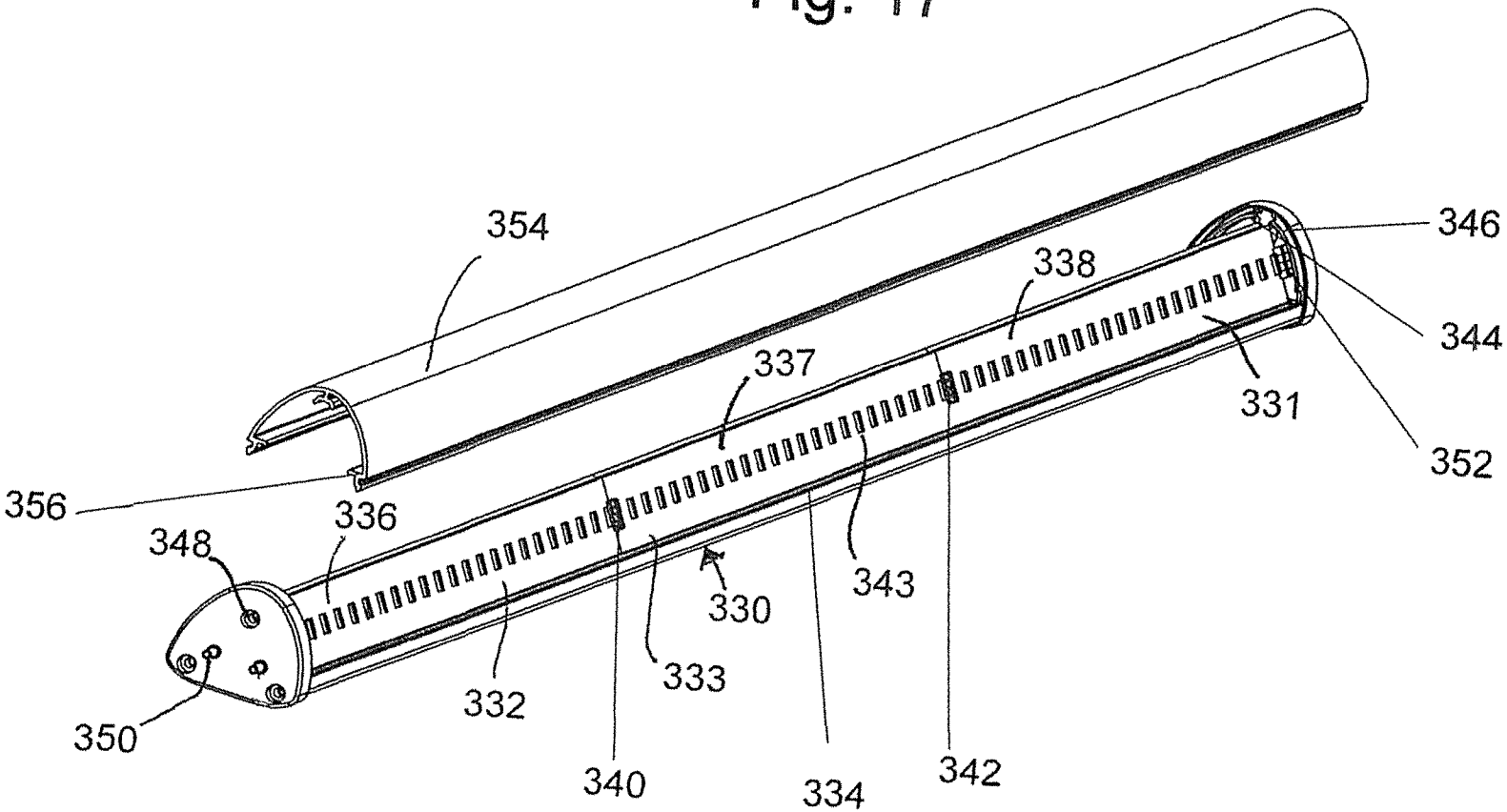
FIG. 17 is an exploded assembly view of another two sided non-curvilinear LED luminary in accordance with principles of the present invention.
Figure 18:
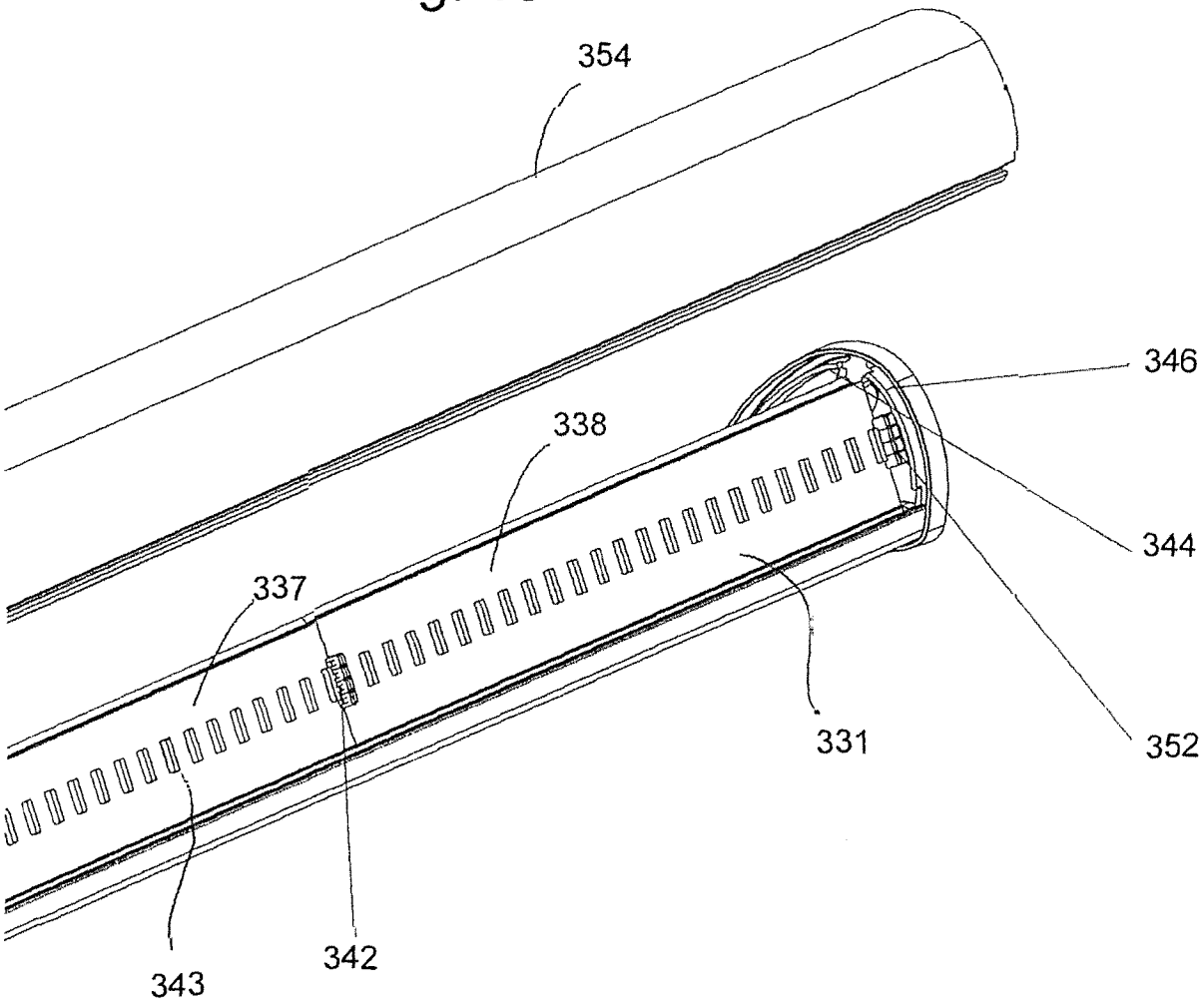
FIG. 18 is an enlarged view of the right portions of the two sided noncurvilinear LED luminary of FIG. 17.

FIG. 17 is an exploded assembly view of a LED illuminating assembly 330 comprising a two sided modular light bar 331 providing another two sided non-curvilinear LED luminary 332 which is similar to the two sided non-curvilinear LED luminary of FIGS. 15-16 except that there are two sets or arrays 333 of elongated LED emitter PCB panels comprising modular LED emitters which can be mounted or otherwise secured upon and/or positioned radially outwardly of the two sides of the three sided delta or triangular shaped metal heat sink 334. FIG. 18 is an enlarged view of the right portions of the two sided non-curvilinear LED luminary of FIG. 17. Each of the sets or arrays of modular LED emitter PCB panels have more than one LED emitter PCB panel, such as but not limited to, three elongated LED emitter PCB panels 336-338 providing modules which extend and are aligned and connected, lengthwise and longitudinally end to end via emitter PCB panel terminal connectors 340 and 342. Each of the LED emitter PCB panels can be rectangular and can contain one or more rows of aligned, aliquot, uniformly spaced LED emitters 343. The LED luminary can have three sided delta or triangular end cap connectors 344 which comprise connector end boards that can be secured to three sided delta or triangular shaped end caps 346 by screws or other fasteners through screw holes 348 in the end caps. Power connector pins 350 can extend laterally outwardly from the connector end boards through connector pin-receiving holes in the end caps for secure engagement with end plugging into a light socket. The connector end boards can have end cap board terminals 352 which can extend longitudinally inwardly along two of its three sides and can connect to the emitter board terminals. An elongated translucent or transparent light transmissive plastic lens 354 comprising a diffuser cover of diffuser can cover the LED emitter boards. The lens can be rounded, semicircular and positioned radially outwardly of the LED emitters. The lens can have inward facing feet 356 which can snap fit about the heat sink.

Figure 19:
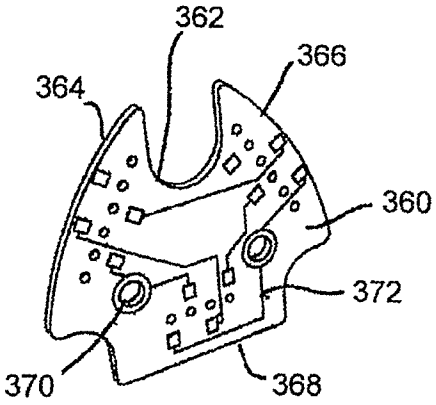
FIG. 19 is a perspective view of an end cap connector board for a two sided delta non-curvilinear LED in accordance with principles of the present invention.
Figure 20:
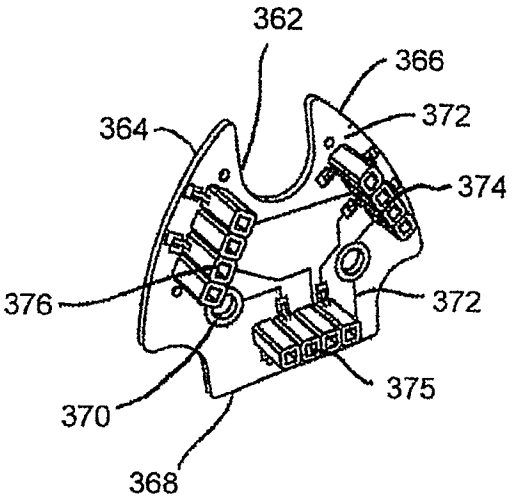
FIG. 20 is a perspective view of surface mount connectors connected to the end cap connector board of FIG. 19.
Figure 21:
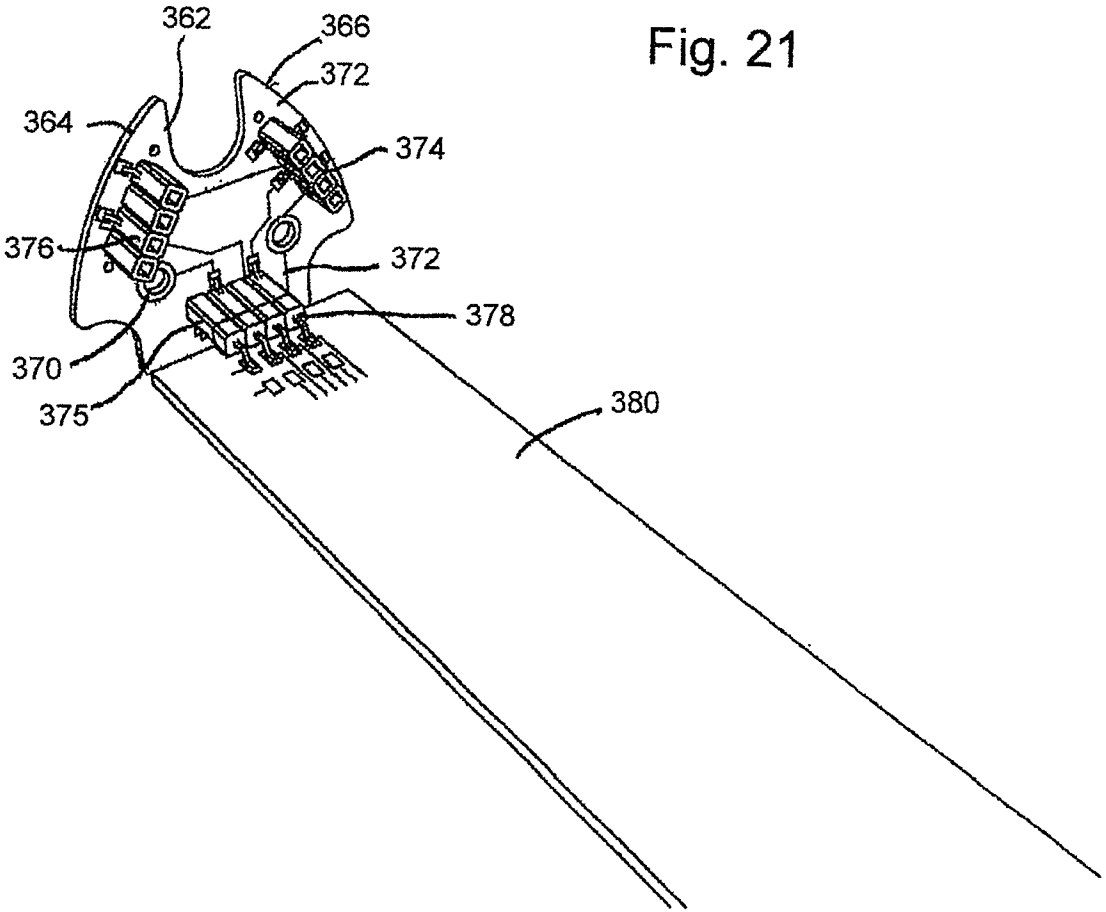
FIG. 21 is a perspective view of a portion of a driver board connected to the surface mount connectors connected of FIG. 20.
Figure 22:
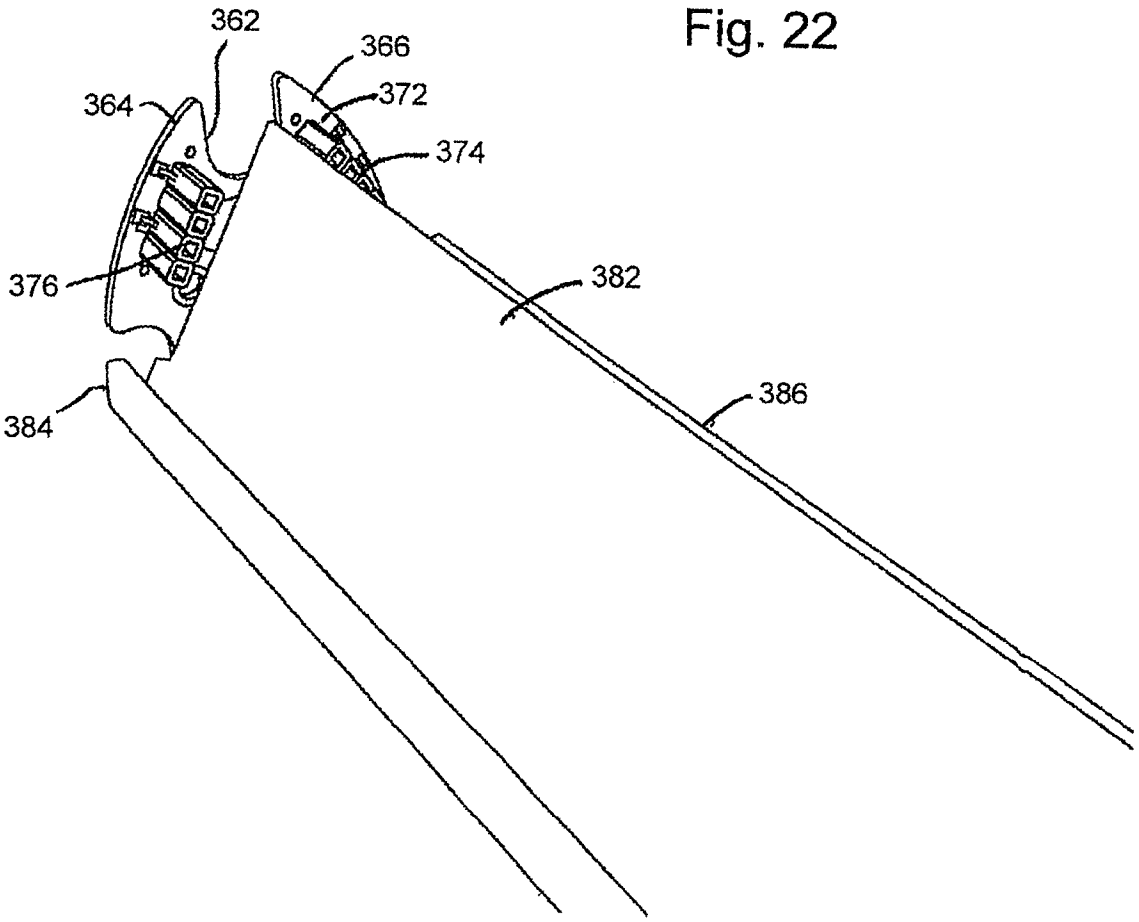
FIG. 22 is a perspective view of a portion of a three sided delta heat sink tube positioned peripherally about the driver board and against the end cap connector board of FIG. 21.
Figure 23:
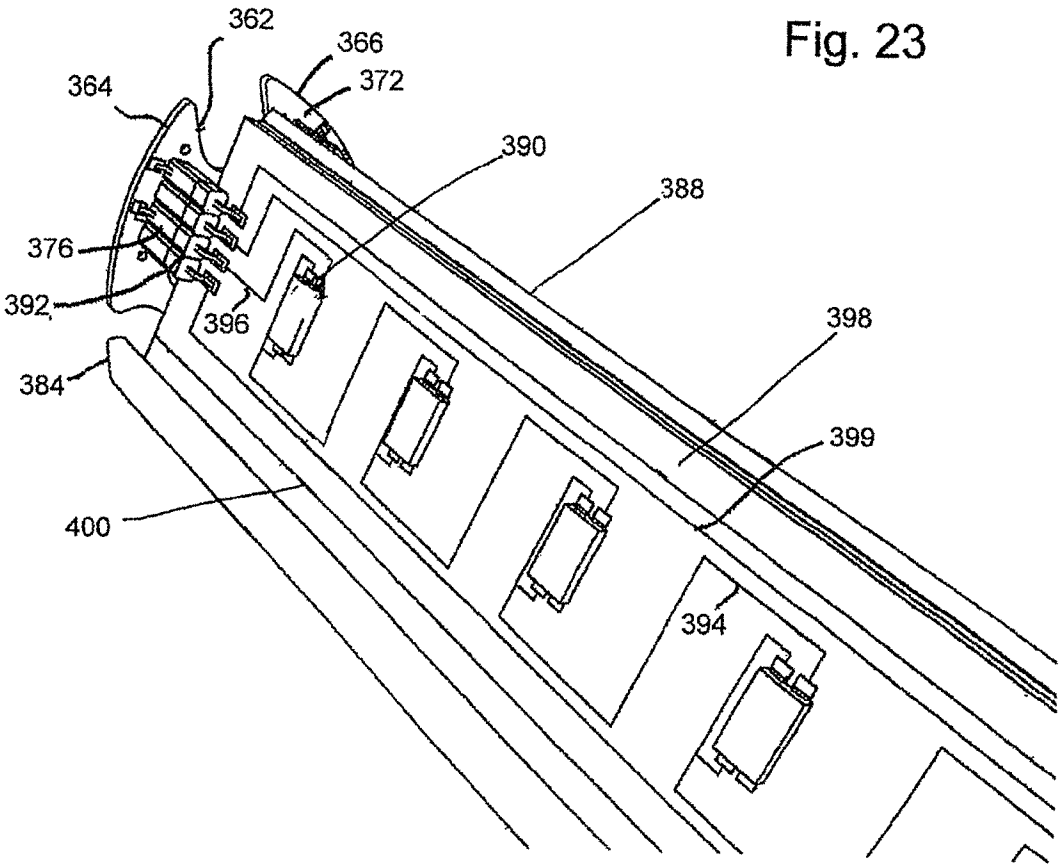
FIG. 23 is a perspective view of emitters on an emitter board with AC and DC power traces connected to the surface mount connectors and positioned about the heat sink tube of FIG. 22.
Figure 24:
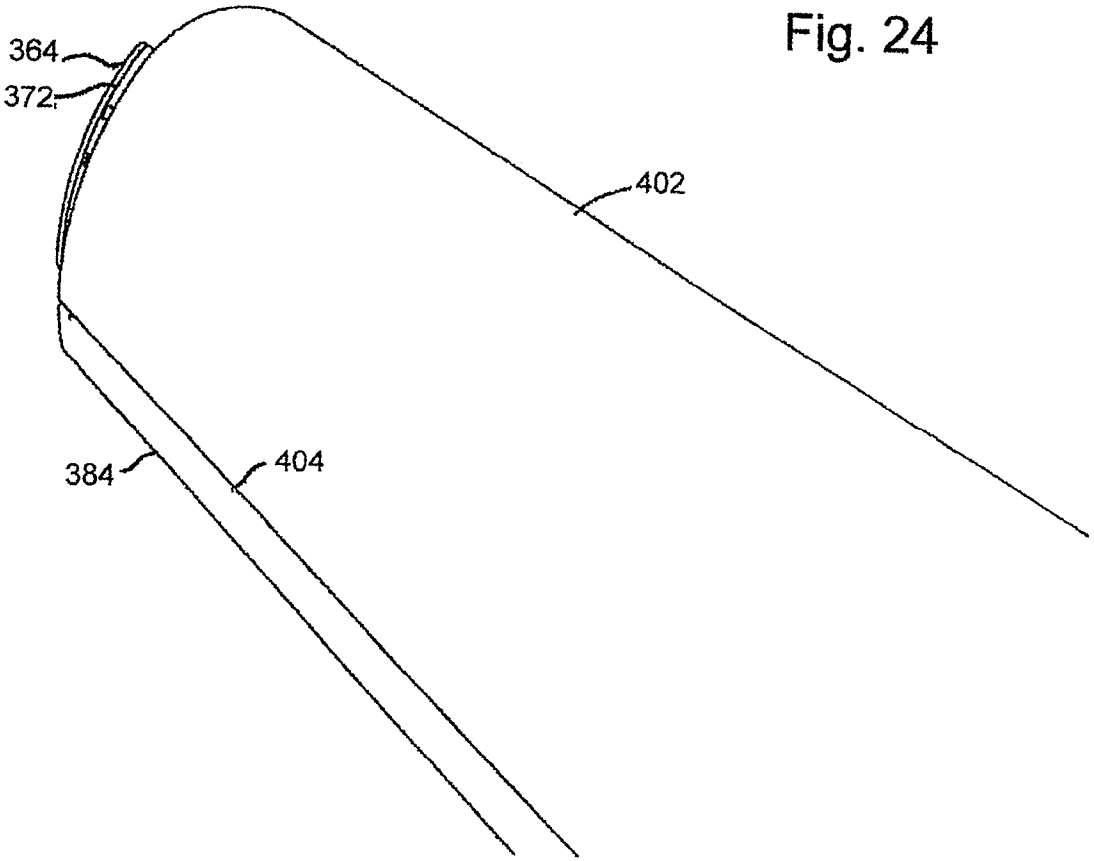
FIG. 24 is a perspective view of a portion of a lens about the emitters of FIG. 23.
Figure 25:
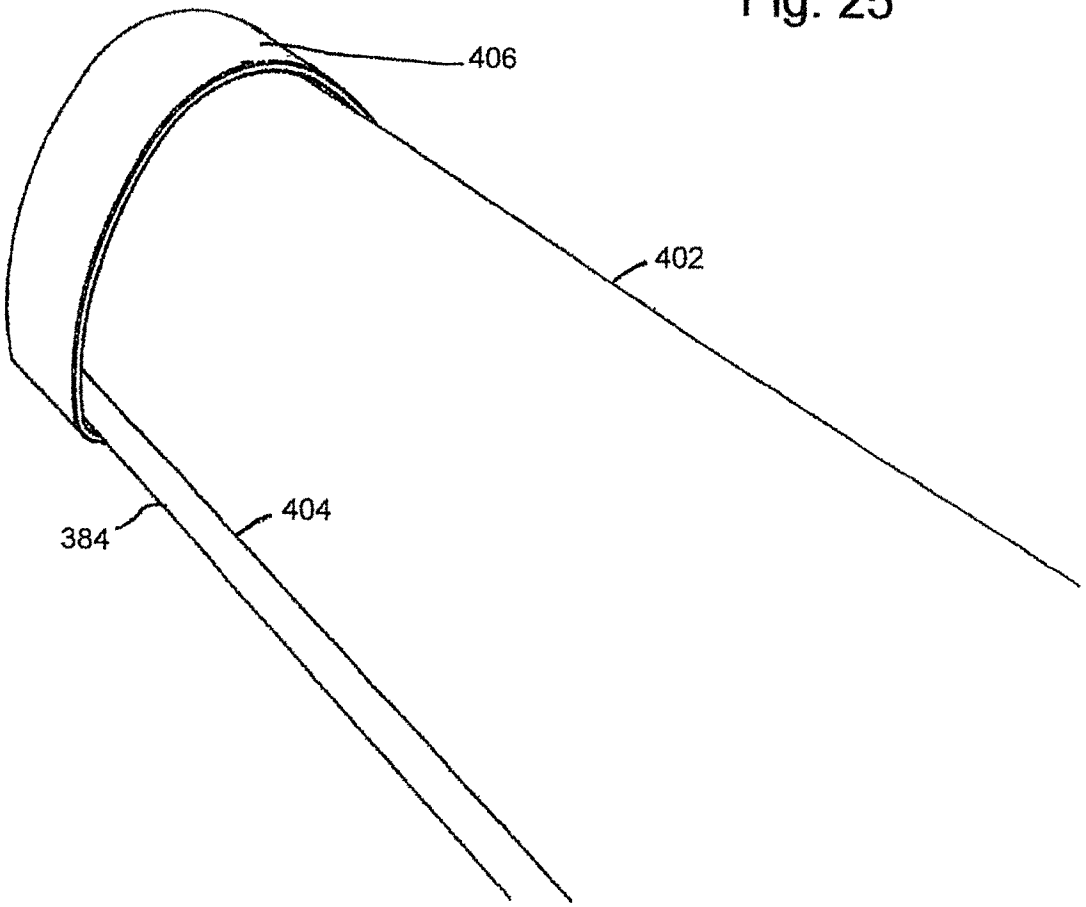
FIG. 25 is a perspective view of a portion of an end cap at the left end of the lens of FIG. 24.
Figure 26:
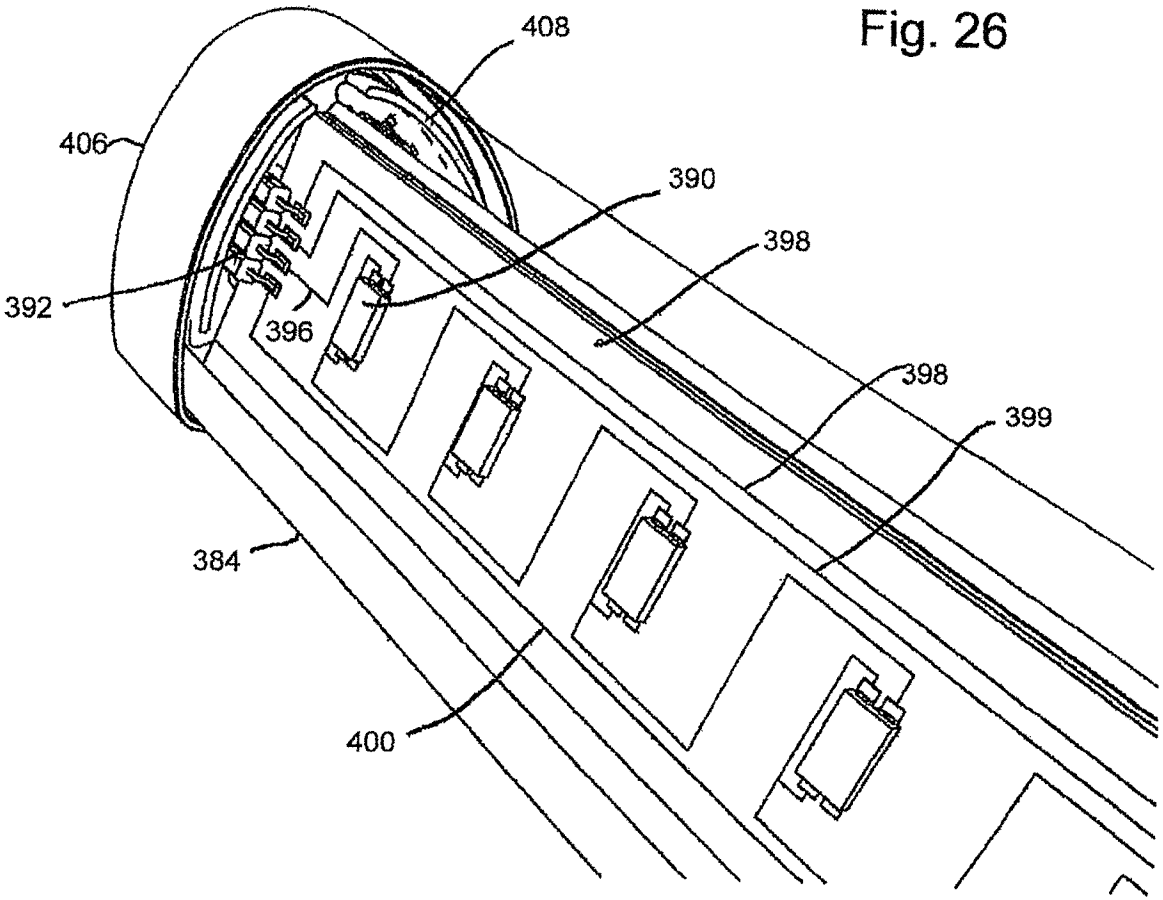
FIG. 26 is a perspective view of the two sided delta non-curvilinear LED luminary with the end cap and showing portions of the lens removed to illustrate the emitters on the emitter board and the AC and DC power traces connected to the surface mount connectors.

FIG. 19 is a perspective view of an end cap PCB connector 360, also referred to as a connector end board or end cap board, for a LED illuminating assembly comprising a two sided LED bar providing a two sided delta or triangular non-curvilinear LED luminary, such as shown in FIGS. 15-16. The end cap PCB connector can have a central U-shaped concave notched portion 362 between two of the sides comprising convex curved arcuate sides 364 and 366 and can have a lower third side, comprising a straight flat planar side 368 which can extend below the lower portions of the two convex sides. The PCB connector can have connector pin-holes 370, also referred to as AC power pin connectors or AC hot pin connector, as well as electrical traces 372 for connecting the electrical components on the end cap PCB connector. As shown in FIG. 20, surface mount connectors 374-376, which are also referred to as emitter board connectors or end cap board terminals, can be connected alongside portion of the connector end board in proximity to the sides of the connector end board. The surface mount connectors of the end cap PCB connector can be connected to drive board connectors 378 (FIG. 21), also referred to as PCB driver connectors, of an internal non-switching elongated driver board 380 comprising a driver. A three sided delta or triangular shaped metal heat sink tube 382 (FIG. 22), also referred to as a tubular heat sink, can be positioned peripherally about the driver board and against the cap connector end board. The heat sink can have upwardly facing emitter board-supporting channels 384 and 386 along its bottom edges to support elongated LED emitter PCB panels 388 (FIG. 23), which are also referred to as modular LED emitter boards. The LED emitter PCB panels can be mounted or otherwise secured upon and/or be positioned radially outwardly of the heat sink to form a V-shaped array. Each of the LED emitter PCB panels can contain one or more rows of aligned, aliquot, uniformly spaced LED emitters 390. The heat sink can dissipate heat generated by the LED emitters and driver board. Emitter board connectors 392, which are also referred to as emitter board terminals, can extend from the ends of the emitter boards and connect to the surface mount connectors comprising end cap board terminals of the end cap PCB connector. Emitter traces 394 can connect the LED emitters in series while end traces 396 can connect the emitters to the emitter board connectors. An alternating current (AC) power trace 398 can be positioned in parallel to an extra trace 399 and a direct current (DC) trace 400 on the emitter board. An elongated translucent or transparent light transmissive lens 402 (FIG. 24) comprising a diffuser cover or diffuser can cover the LED emitter boards. The lens can be rounded, semicircular and/or positioned radially outwardly of the LED emitters. The elongated longitudinal lower ends 404 of the lens can comprise feet and can fit in and be supported by channels of the heat sink. End caps 406 (FIG. 25) can be positioned about the ends of the lens and end cap PCB connectors. FIG. 26 is a perspective view of the three sided delta or triangular non-curvilinear LED luminary with the end cap and showing portions of the lens removed to illustrate the emitters on the emitter board and the AC and DC power traces connected to the surface mount connectors. As shown in FIG. 26, the end caps can have arcuate curved concave brackets 408 comprising bracket segments which can extend longitudinally inwardly and can provide clamps positioned about portions of the periphery of the end caps to securely engage, grasp, snap fit, clamp and hold the top ends of the emitter boards.

Figure 27:
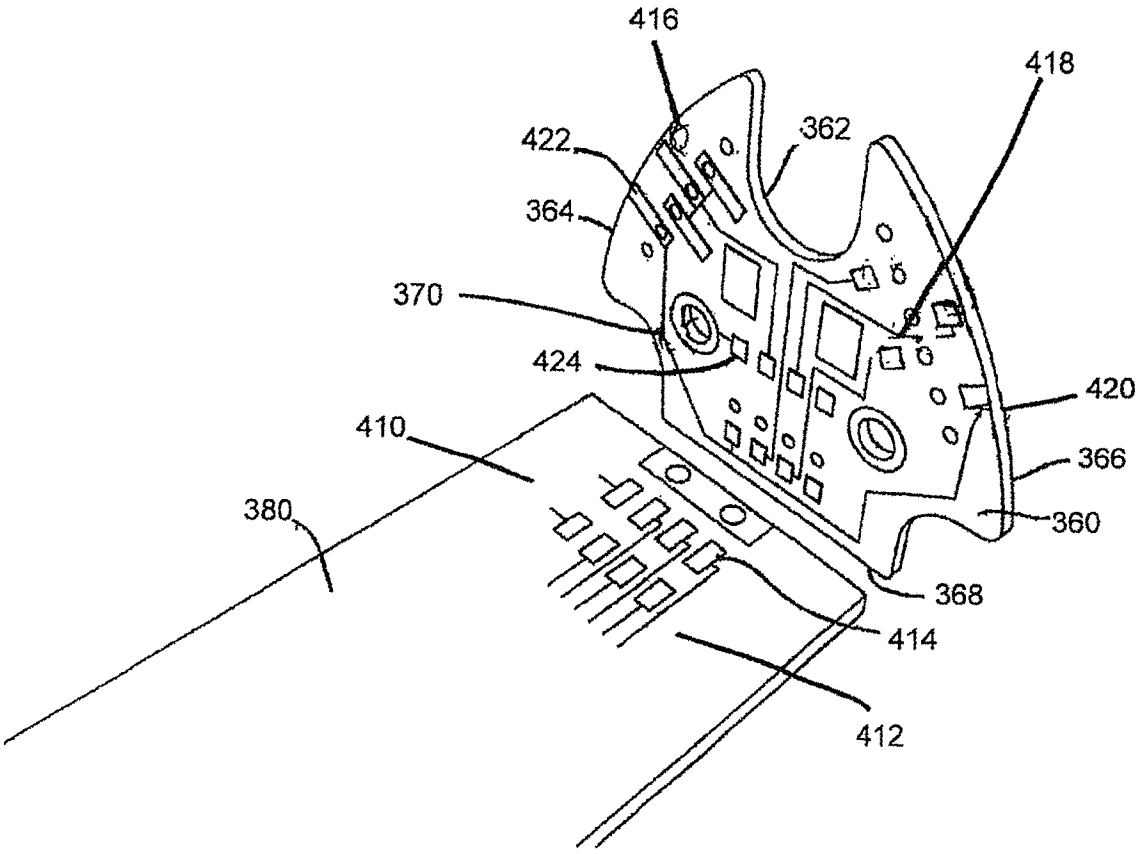
FIG. 27 is a perspective view of an end cap connector board or connector end board and driver board for a two sided delta non-curvilinear LED luminary in accordance with principles of the present invention.
Figure 28:
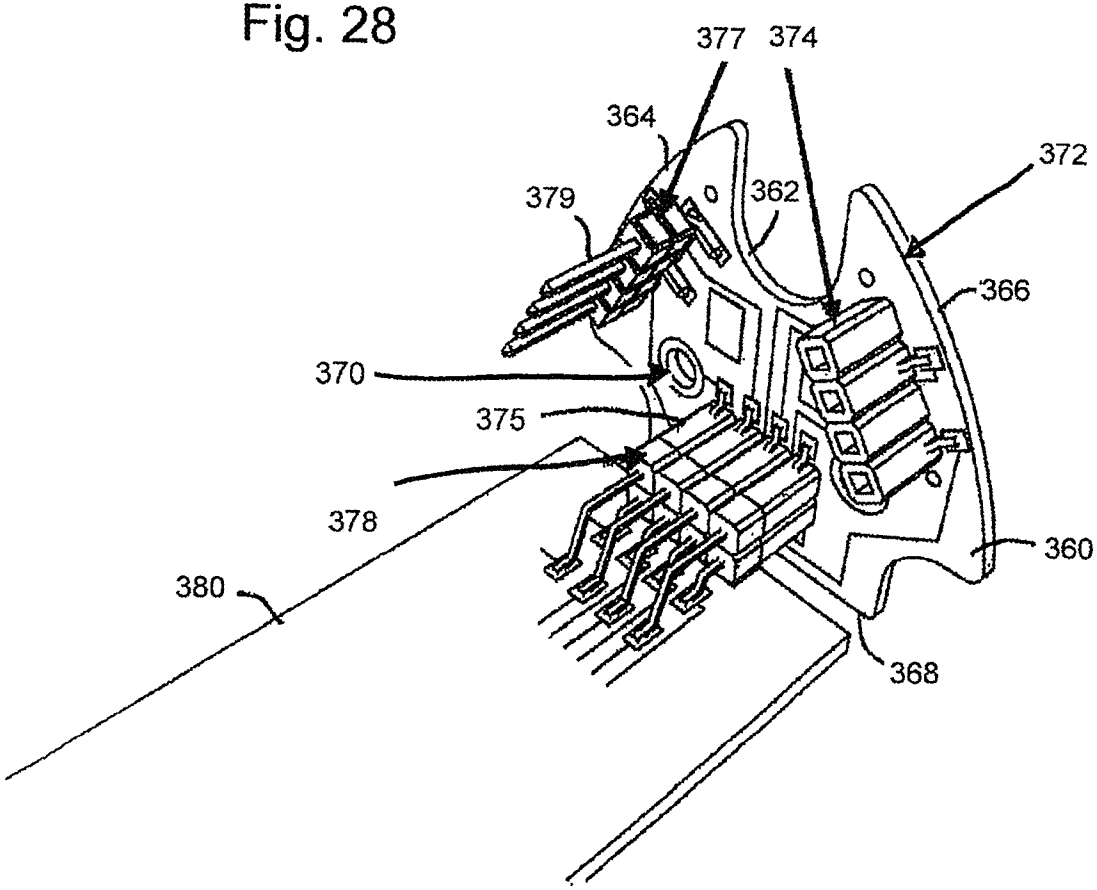
FIG. 28 is a perspective view of emitter board connectors connected to the end cap connector board and illustrating driver connectors connected to the driver board and the end cap connector board of FIG. 27.

AC traces 410 (FIG. 27) and DC traces 412 can be connected to driver circuitry 414 on the driver board 380. Driver connectors 378 (FIG. 28) can be connected to the driver circuitry as well as to the surface mount connectors 375, also referred to as emitter board connectors, of the end cap PCB connector (connector end board or end cap board) 372. In some arrangements, the end cap connector board can have male connectors 377 with longitudinally inwardly extending connector pins 379 to matingly engage and plug into female connectors on the emitter boards and/or drive board and the end cap connector board can have female connectors 374 to receive and plug into the longitudinally outwardly connector pins of matingly engageable (mating) male connectors on the emitter board and/or driver board. In the illustrated embodiment, there are a four pin connectors at end of each emitter board and driver board, although for some longer light bars, it may be desirable to use six pin connectors.

Figure 30:
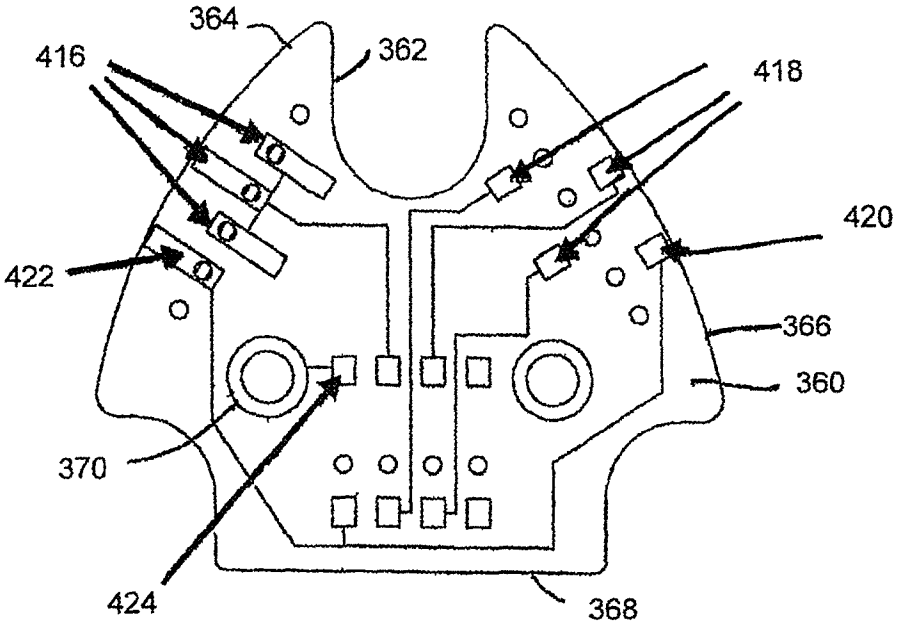
FIG. 30 is a front view of the end cap connector board of FIG. 27.

The end cap PCB connector can have DC power terminals 416 (FIG. 30) to conduct direct current (DC) to three LED strings as well as DC return terminals 418 to receive DC from the LEDs. An AC neutral trace 420 can extend from the opposite side. The end cap PCB connector can also have an AC neutral terminal 422 and an AC hot terminal 424.

Figure 29:
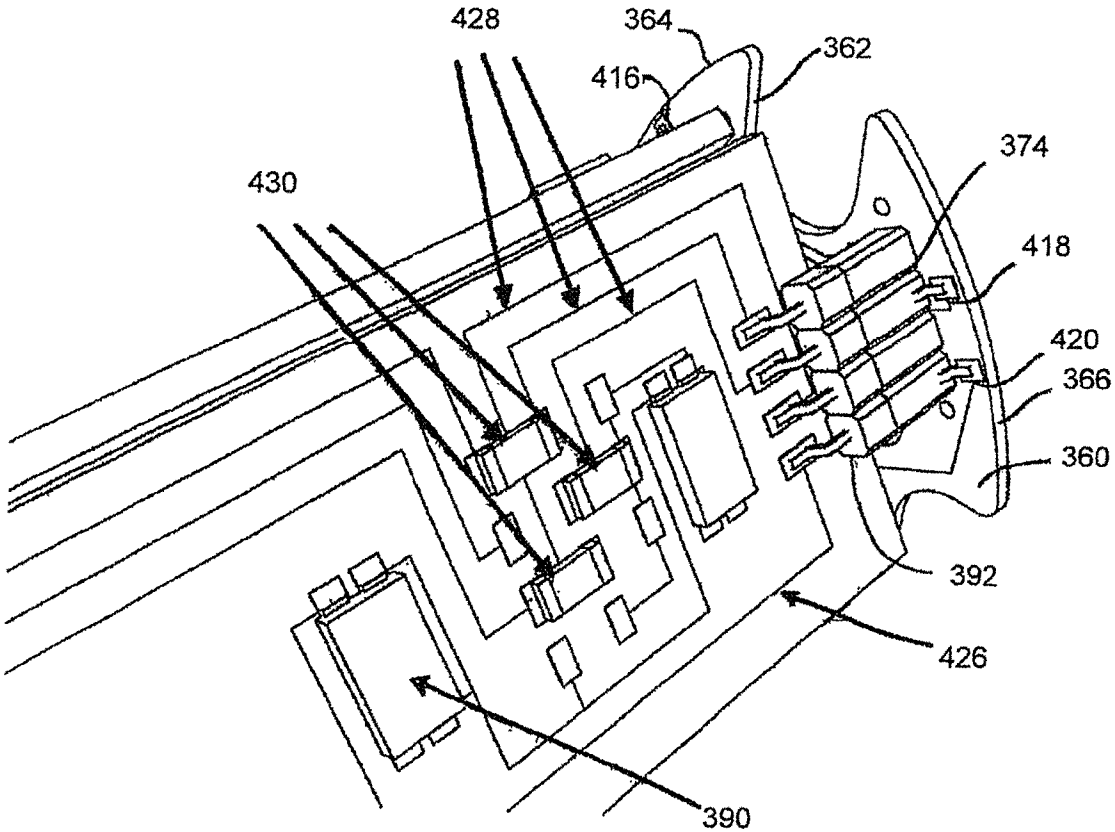
FIG. 29 is a perspective view of LED emitters mounted on an emitter board about a heat sink tube and against the end cap connector board of FIG. 28 and illustrating traces and jumpers.

FIG. 29 is a perspective view of LED emitters mounted on a modular LED emitter board about a heat sink tube (tubular heat sink) and against the end cap connector. The emitter can have an extra trace 426 connected to the emitter board connectors to carry either AC or DC from the opposite side or end of the emitter board. The emitter board can also have regulated DC return traces 428 connected to the emitter board connectors and to series-parallel jumpers 430. The drawings show how the driver is connected to the connector end board in a delta two-sided configuration with both male and female connectors. In some arrangements, (modules), only one end cap board is needed and the emitter boards are designed within a built in electric loop which sends electrical signals through both emitter boards in a W configuration.

The end cap board can have power pins directly soldered without wires. The driver board can be directly socketed and positioned inside the tube (tubular array). Each of the emitter boards can be directly socketed without wires. Extra traces are utilized when necessary to eliminate the need for a main power wire running thought the tube (heat sink).

Figure 31:
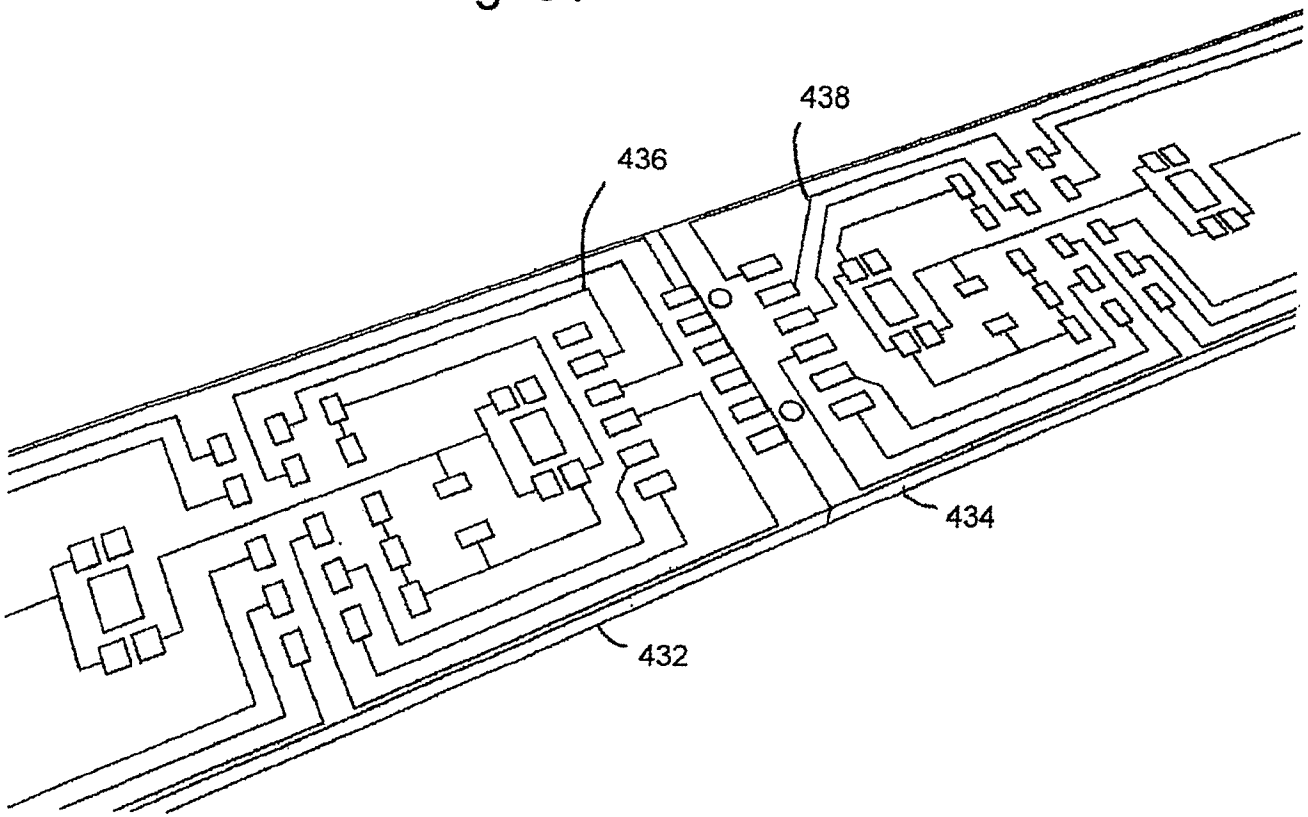
FIG. 31 is a perspective view of emitter boards which are connected longitudinally end to end for use in the non-curvilinear LED luminaries in accordance with principles of the present invention.
Figure 32:
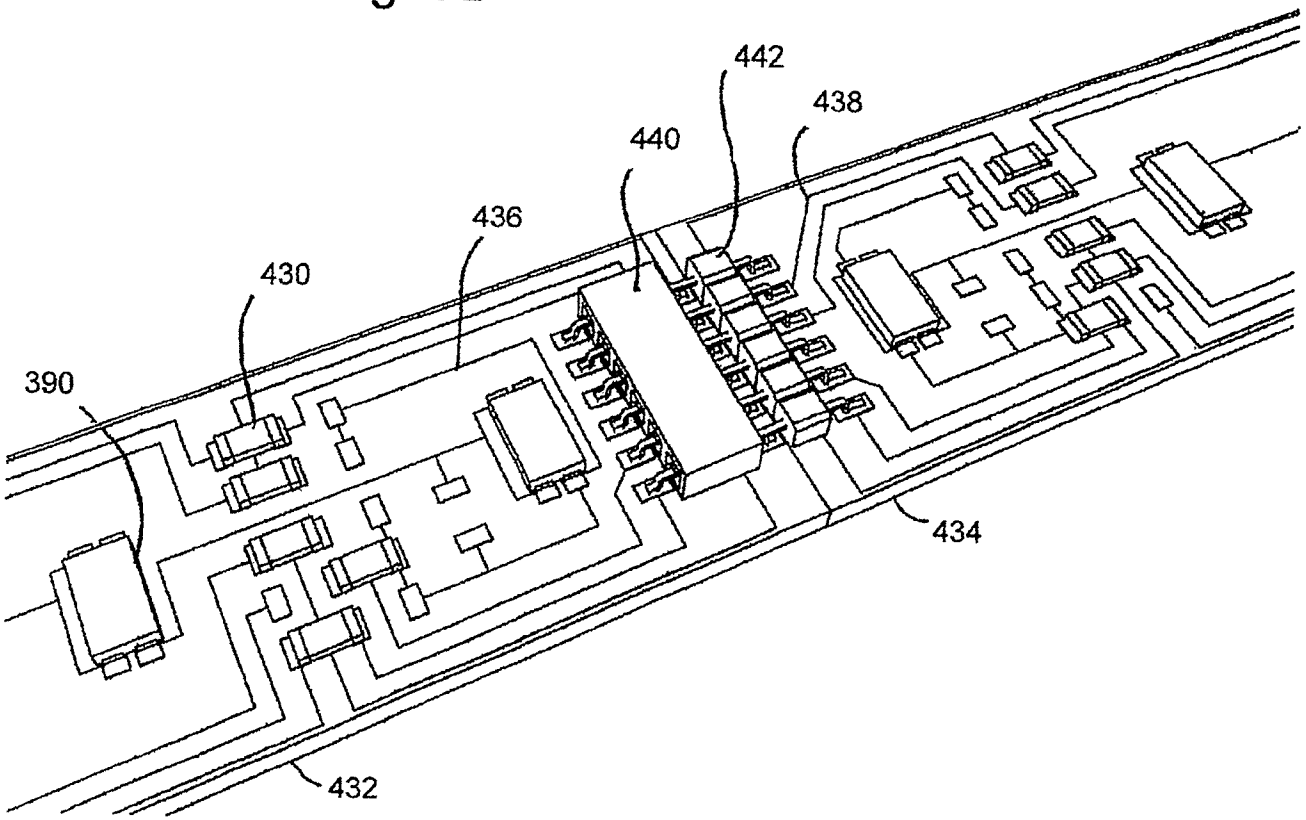
FIG. 32 is a perspective view of LED emitters mounted on the emitter boards of FIG. 31 and illustrating the emitter board connectors.

FIG. 31 is a perspective view of modular emitter boards 432 and 434 which are connected longitudinally end to end, such as described in FIGS. 17 and 18. The emitter boards can have printed emitter board circuitry 436 and sub-circuitry 438. FIG. 32 is a perspective view of LED emitters 390 and series-parallel jumpers 430 mounted on the emitter boards and illustrating emitter board connectors 440 and 442 comprising emitter PCB panel terminal connectors which can connect the ends of the emitter boards.

Figure 33:
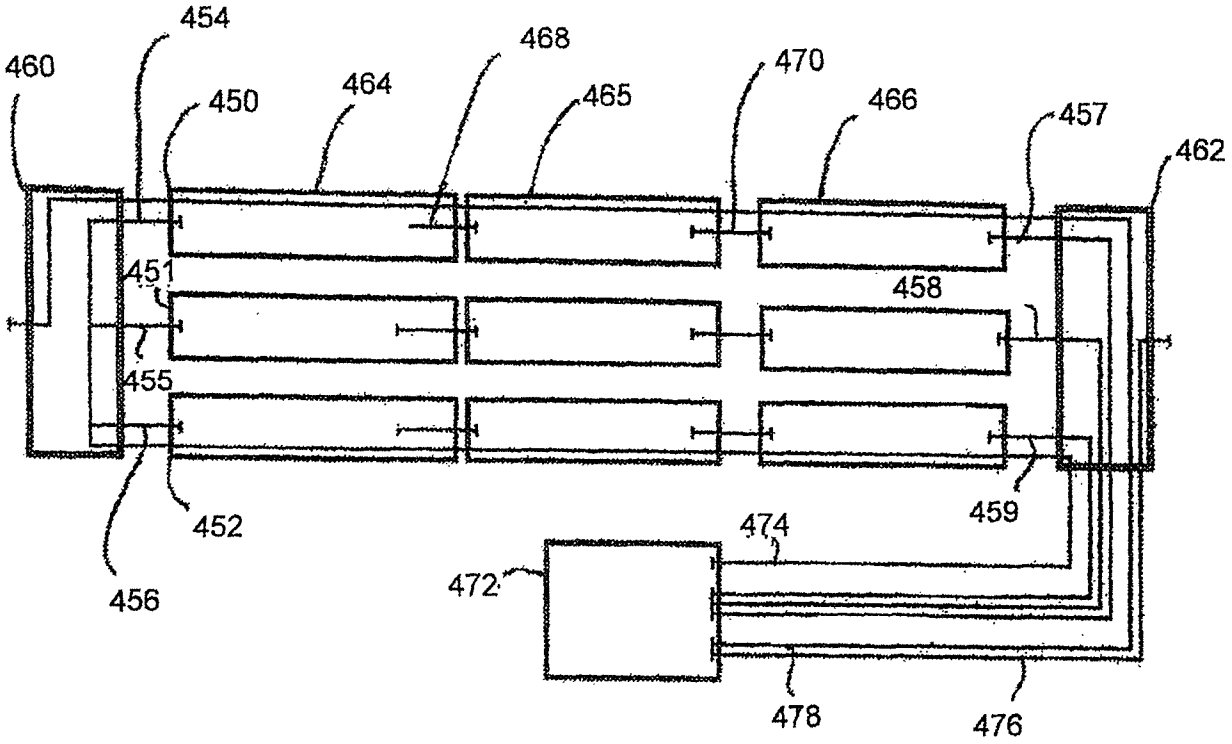
FIG. 33 is a schematic delta LED wiring diagram for the three sided delta noncurvilinear LED luminary in accordance with principles of the present invention.

FIG. 33 is a schematic delta LED wiring diagram for a LED illuminating assembly comprising a three sided LED lighting bar (LED light bar) providing the three sided delta or triangular shaped non-curvilinear LED luminary. The luminary can have three sides comprising rows 450-452 of modular LED emitter boards. Each row can be connected by emitter end traces 454-459 in parallel to end cap PCB connectors (connector end boards or end cap boards) 460 and 462. Each row of LED emitter boards can comprise three aligned modular LED emitter boards 464-466 which can be connected in series to each other by emitter serial traces 468 and 470. The emitter end traces can comprise independent DC regulated return lines (traces) 457-459 which can be connected in parallel to a driver board 472. A common DC outlet line (trace) 474 can be connected to the driver board in parallel with the independent DC regulated return lines. The common DC out line can be connected and extend through the end cap PCB connector 462 through the LED emitter boards of bottom row 452 to end cap PCB connector 460 and in parallel to emitter end traces 454-456. AC line (trace) 476 can extend from the driver board to the end cap 462 and outwardly, such as but not limited to another electrical component or an AC power source. An extra AC line (trace) 478 can extend from the driver board through the end cap PCB connector 462 and top row 450 of LED emitter boards to the end cap PCB connector 460 to eliminate the need of a wire to carry AC. The wiring diagram can include parallel paths on every emitter board allowing many variations of parallel-series electrical connections, such as by using jumpers on the emitter boards.

The wiring diagram of FIG. 33 illustrates the elimination of all wires. While the drawing shows what appears to be a jumper cable between the driver and end-cap, there is only a connector, because they are directly connected. More specifically, alternating current (AC) comes in on the two end-caps; the 'hot' on one side and 'neutral' on the other side. One side of the AC is fed along one string of emitter boards to the main end cap (shown on the right of FIG. 33), where it meets up with the other half of the AC and is fed to the driver board. The driver board converts the AC to direct current (DC) and sends DC current on one trace to the secondary end-cap through an extra trace on one row of emitter boards, where it is combined to apply the same high voltage DC to each string of emitters. On the low side of each string of emitters, there is an independent trace returning to the driver which has an independent current-controlling driver that controls the current separately to each string of emitters with high precision. The wiring diagram is simplified, because in reality there are multiple traces through each emitter board, so that any board can be assigned to any sub-driver.

The wiring diagram shows an example with three strings of three emitter boards: driver portion "a" running the top three emitter boards, driver portion "b" the middle three emitter boards and driver portion "c" the bottom three emitter boards, however for ultimate in redundancy, they can actually be wired such that the driver is responsible for three boards and will not light up emitter boards next to each other.

Example. In this case, the emitter board: driver combination:

AAA
BBB
CCC if sub-driver A, B or C fails, or any emitter in the string, one third of the light goes away on that whole side. However, the real wiring would look like this:

ABC
CAB
BCA

Now if or when one driver sub circuit fails, two-thirds of the light remains and the dead spot revolves around the lamp so there is only a dim spot and not a black out.

Parallel traces can be used in the preferred arrangement. The boards can be made with the traces pre-fabricated. Parallel traces are utilized when needed to get the power to the emitters in an electrically efficient way. The advantage of using parallel traces means is the emitters are all driven at exactly the same current and power level. That is not the case in most conventional designs. A further advantage of the arrangement of parallel-series wiring is that we can run our lighting at higher voltage and lower current so that it is more efficient regardless of which driver is used. This is an important aspect of this arrangement. Furthermore, a multiple channel driver that has multiple channels can be used. In one particular model, six boards were wired three different ways.

Figure 34:
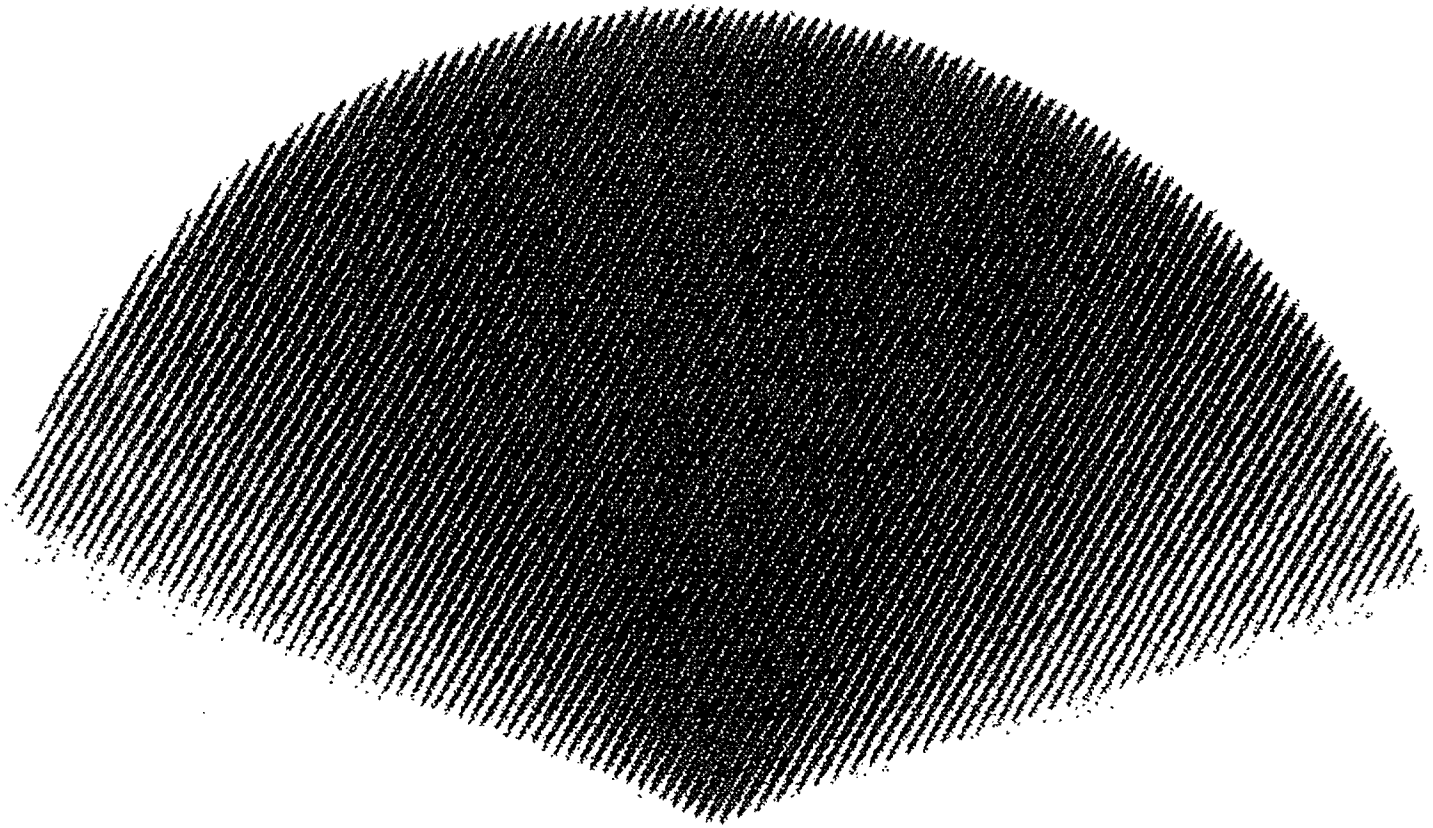
FIG. 34 is a light distribution pattern emitted from a straight row of emitters and is sometime referred to as the "baseline" or "light angle before.

Light distribution patterns are shown in FIGS. 34-43. FIG. 34 is a light distribution pattern emitted from a straight row of emitters and is sometime referred to as the "baseline" or light angle before". The full angle is about 150 degrees of usable light but the fall-off is down to 20% of peak brightness on the outer edges of that cone of light. The Y2 brightness angle (angle outside of which is less than Y2 the peak on axis intensity) is about 120 degree in a very good emitter (60 degrees off-axis in a 360 degree cone). When using rows of emitters in columns with the rows representing the PCB and the columns representing the light bar, the light distribution is uneven as the columns are spread out, since due to practicality, the spacing on the rows will be closer than on the column.

Figure 35:
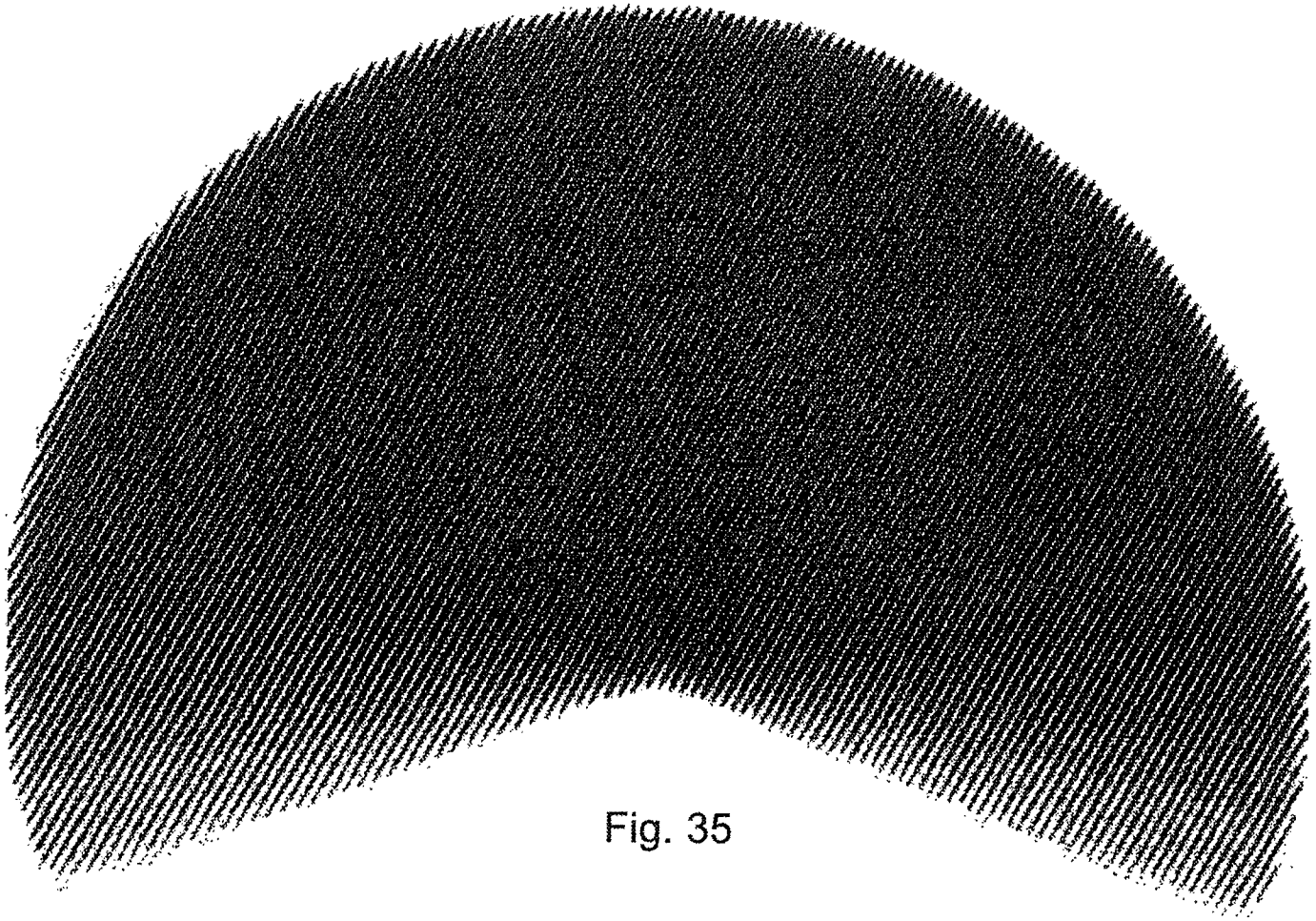
FIG. 35 is a light distribution pattern emitted from a two sided delta noncurvilinear LED luminary in accordance with principles of the present invention and is sometimes referred to as the "light angle after"

FIG. 35 is a light distribution pattern emitted from a two sided delta non-curvilinear LED luminary and is sometime referred to as the "light angle after". Clearly visible is the fact that the center brightness is far wider and the beam width is greatly improved. The full angle is about 230 degree which is up from 150 degrees of usable light. The Y2 brightness angle is bumped up from about 120 degrees which up to over 180 degrees, something impossible to achieve with a conventional single row of emitters.

Figure 36:
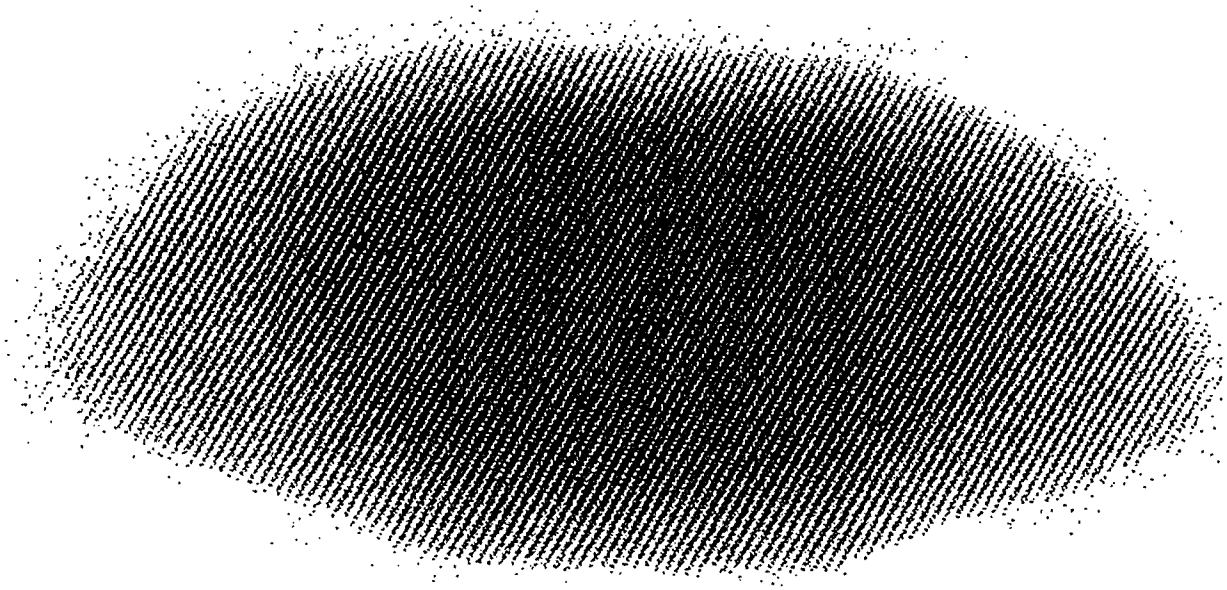
FIG. 36 is a light distribution pattern emitted from a conventional prior art flat plane of forward facing emitters with the four light bars spaced six inches apart in one or four rows and is sometime referred to as the "light array before"

FIG. 36 is a light distribution pattern emitted from a conventional prior art flat plane of forward facing emitters with four light bars spaced six inches apart in one or four rows and is sometime referred to as the "light array before". FIG. 36 is a light distribution pattern emitted from a conventional prior art flat plane of forward facing emitters with the four light bars spaced six inches apart in one or four rows and is sometime referred to as the "light array before". Rows of forward-facing only emitters make almost a circular pattern of light with dramatic fall off outside of that 'hot spot' area. A better solution can be attained by putting multiple copies of the rows on each column, angled away from each other in an angle optimized per use. Such as with the light bounced back off a reflector or directly to the subject being lit. Here is an example of a cross-section of the light using two rows of emitters angled away from each other at an angle optimized to combine the two into one smooth continuous beam as if it were one row of wider-angle emitters.

Figure 37:
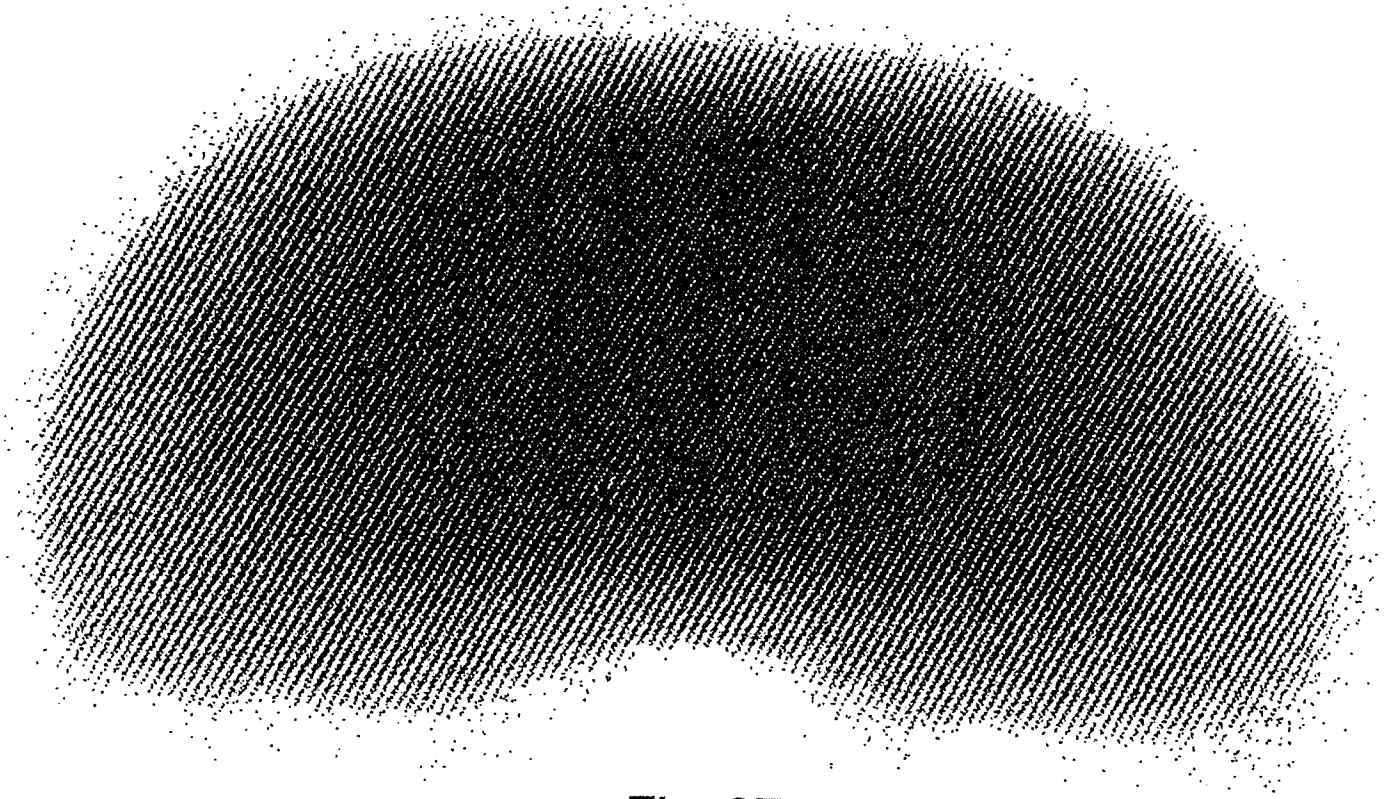
FIG. 37 is a light distribution pattern emitted from four light bars of two sided delta non-curvilinear LED luminaries in accordance with principles of the present invention and is sometime referred to as the "light array before"

FIG. 37 is a light distribution pattern emitted from four light bars of two sided delta non-curvilinear LED luminaries and is sometime referred to as the "light array before". An array of delta LED light bars will have a light distribution similar to FIG. 37. This is a far wider light distribution indicating that the light pattern will be smoother with less dark and bright zones. This same concept applies when going around the tube. The perfect light pattern can be achieved with a five sided hexagonal or a heptagonal extrusion but shown here are the difference of using a two sided and three sided LED light bar.

Figure 38:
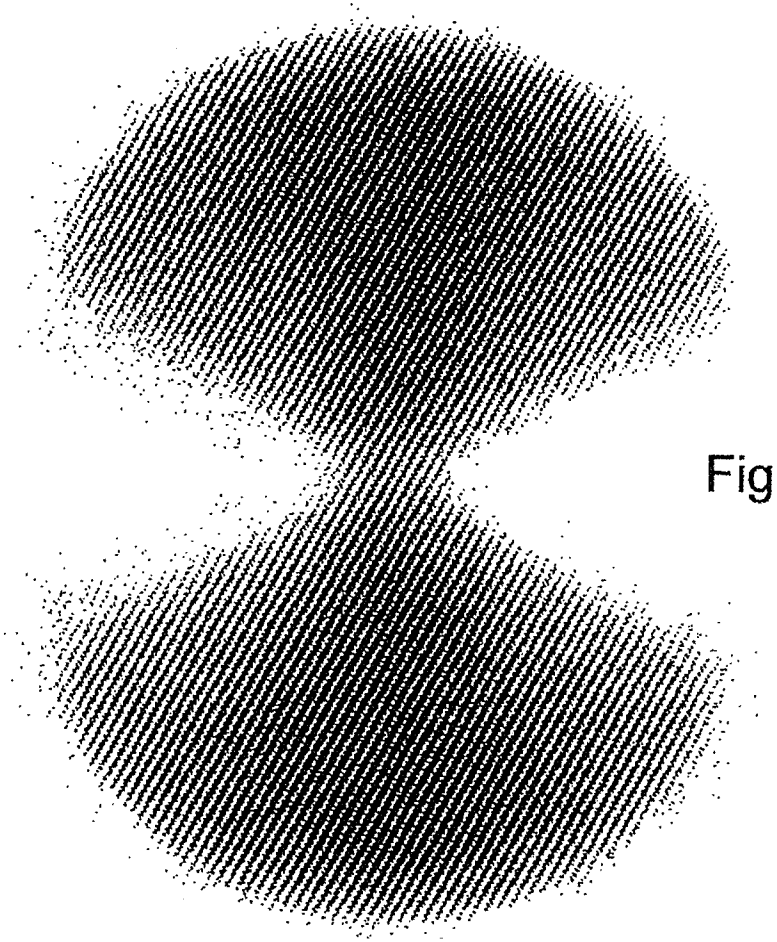
FIG. 38 is a light distribution pattern emitted from a conventional prior art setup using two planar row of emitters back-to-back at 180 degrees such as for illuminating a two sided outdoor sign.
Figure 39:
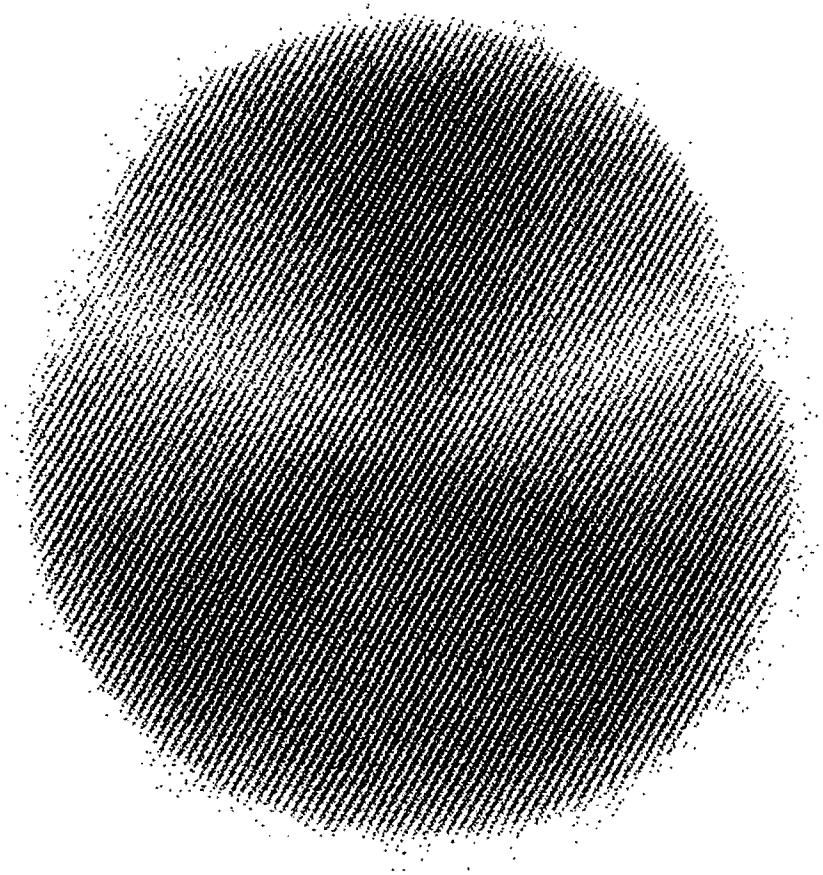
FIG. 39 is a light distribution pattern emitted from three sided delta noncurvilinear LED luminaries in accordance with principles of the present invention and is optimized to reduce the dim zone on the forward facing sided as well as create a balance between two dark zone that are mostly going into a reflector and the one zone that is used for direct illumination.

FIG. 38 is a light distribution pattern emitted from a conventional prior art setup using two planar row of emitters back-to-back at 180 degrees such as for illuminating a two sided outdoor sign. FIG. 39 is a light distribution pattern emitted from three sided delta or triangular non-curvilinear LED luminaries and is optimized to reduce the dim zone on the forward facing sided as well as create a balance between two dark zones that are mostly going into a reflector and the one zone that is used for direct illumination. With only three rows, a perfectly even light distribution is not physically possible, but by adjusting the angles, we can improve the forward-facing light. Though there is a slight dimming zone directly up from the center, the light distribution pattern is improved over the two dim zones that are 'south east' and 'south west' from the center. The improved LED light bar can be installed in such a way to eliminate any artifacts from those dim zones. When using a four sided tube LED light bar, the light pattern becomes nearly uniform. When using a five sided tube LED light bar, the light pattern essentially attains a 360 degree uniform light distribution.

Figure 40:
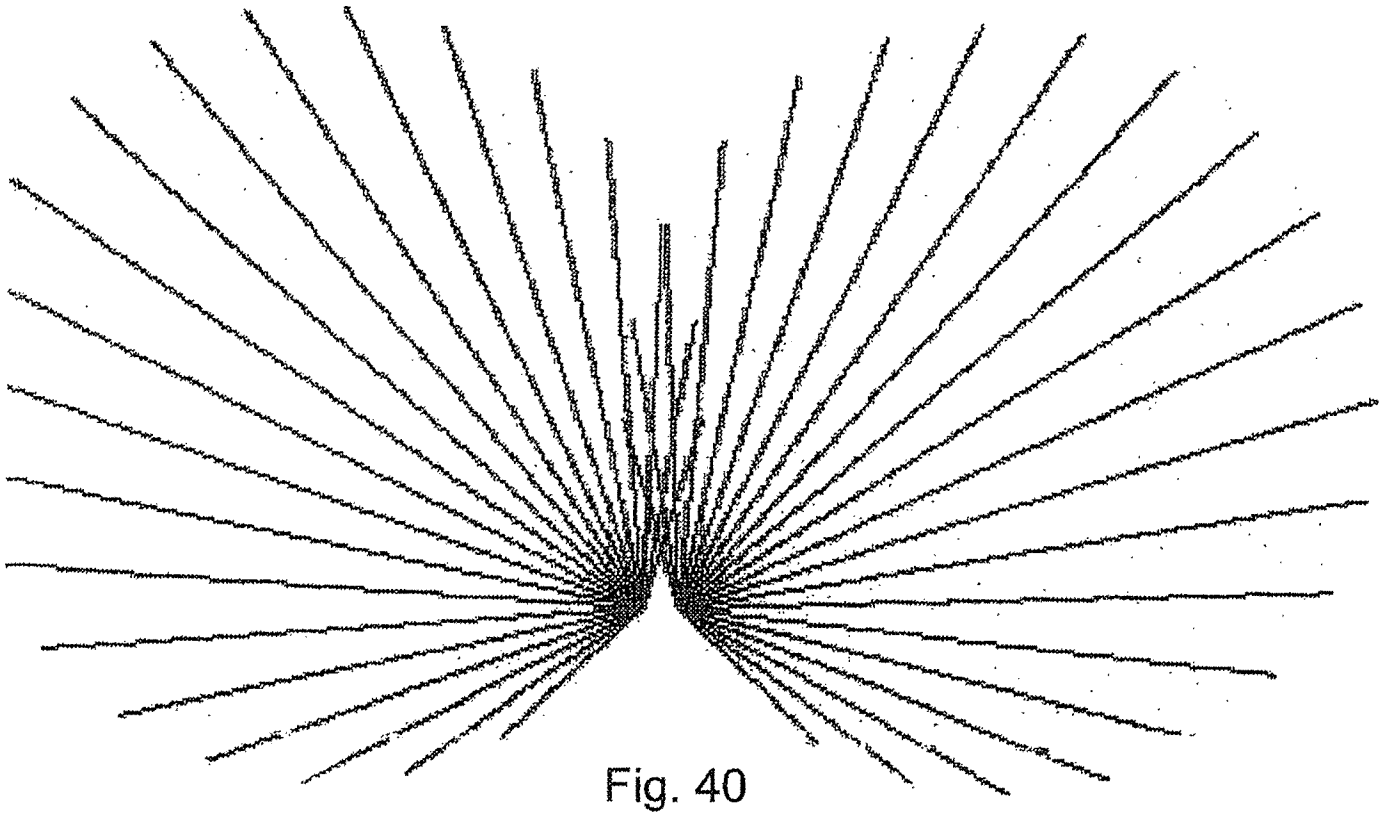
FIG. 40 is a light distribution pattern emitted from a single emitter.
Figure 41:
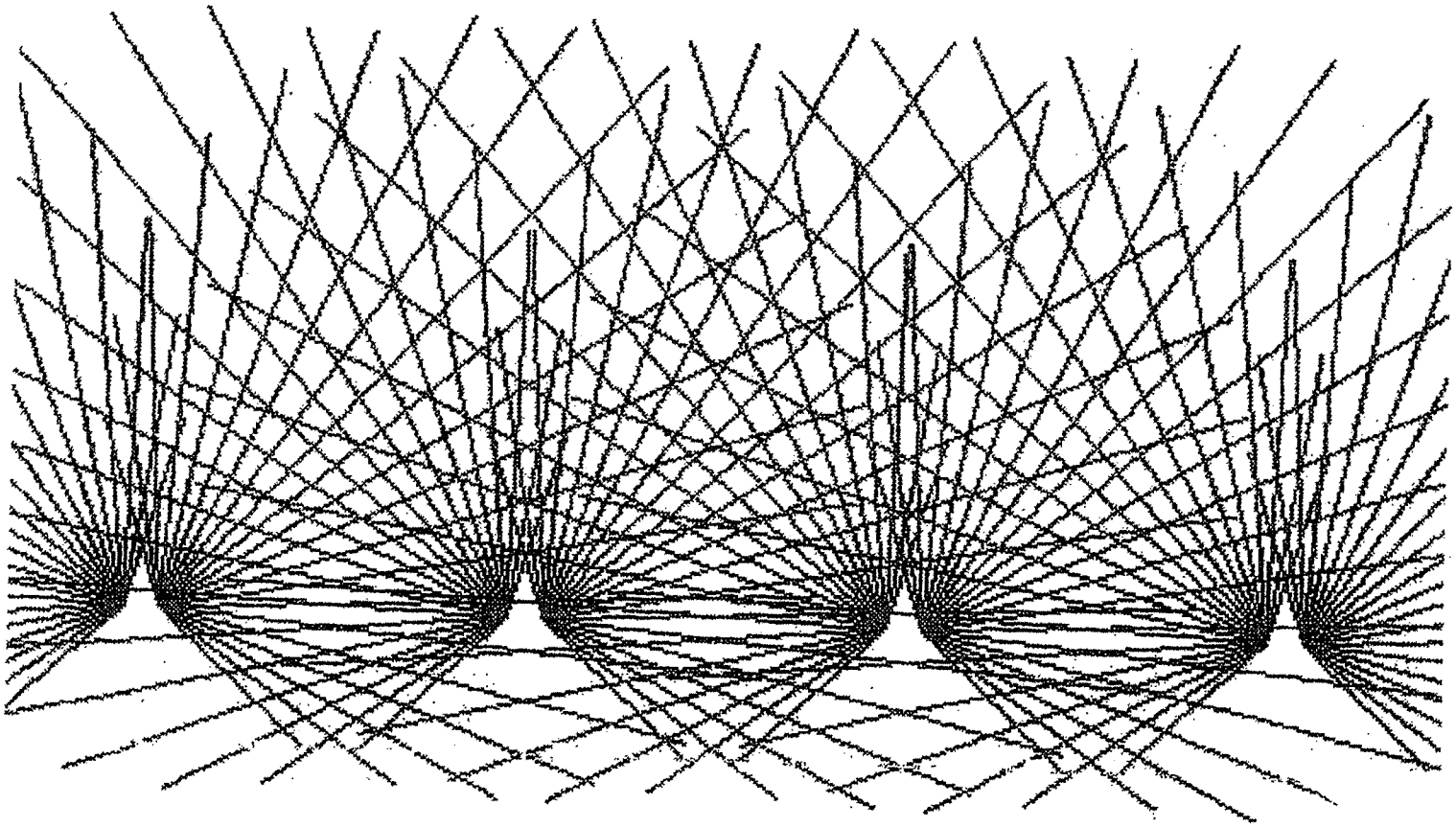
FIG. 41 is a light distribution pattern emitted from a set or row of emitter of FIG. 40.
Figure 42:
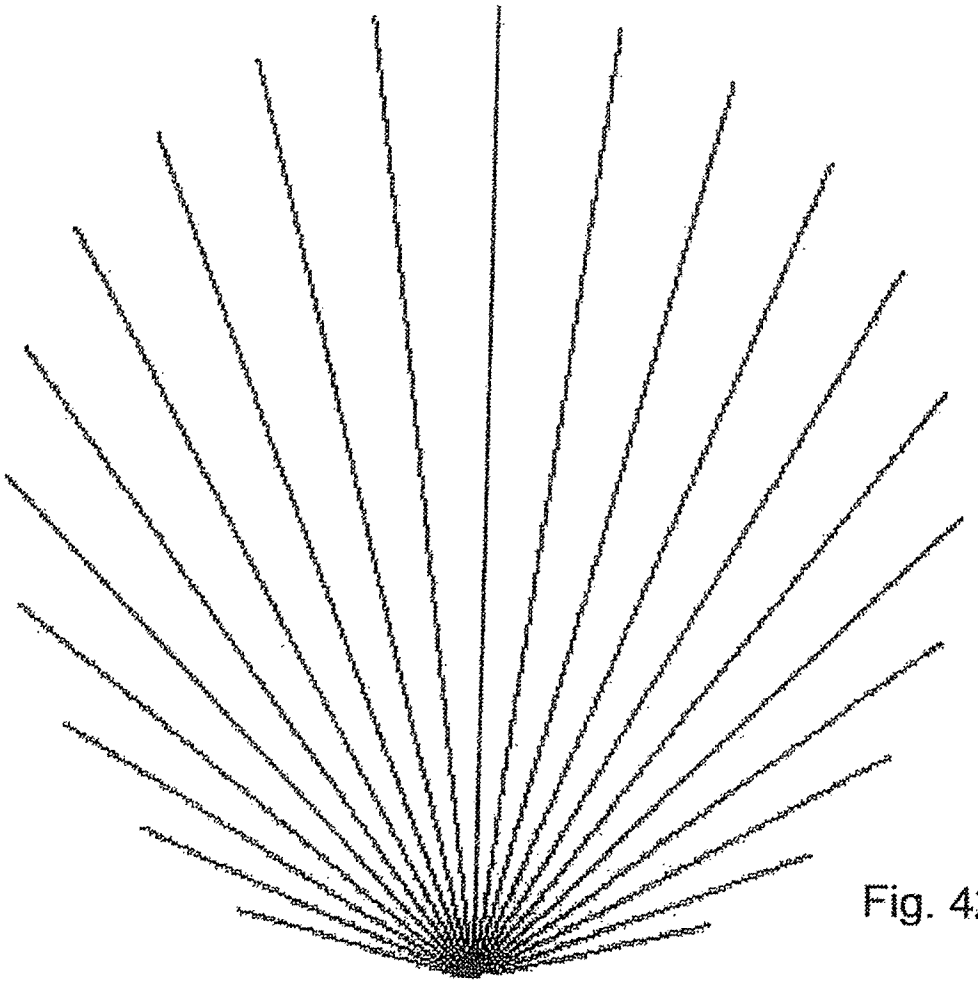
FIG. 42 is a light distribution pattern emitted from a single forward facing emitter.
Figure 43:
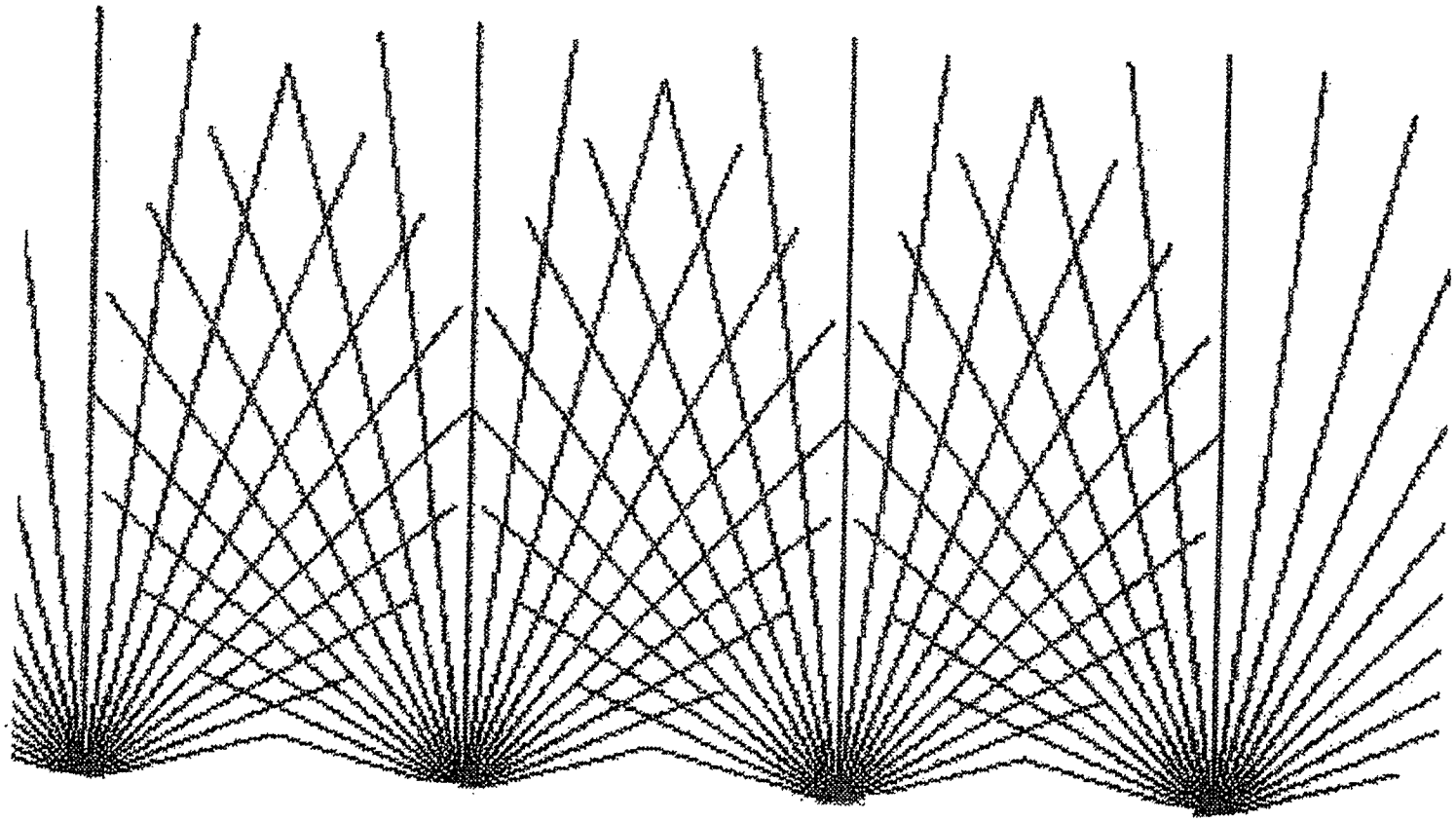
FIG. 43 is a light distribution pattern emitted from a set or row of forward facing emitters of FIG. 4.

FIG. 40 is a light distribution pattern emitted from a single emitter. FIG. 41 is a light distribution pattern emitted from a set or row of emitter of FIG. 40. FIG. 42 is a light distribution pattern emitted from a single forward facing emitter. FIG. 43 is a light distribution pattern emitted from a set or row of forward facing emitters of FIG. 4.

Figure 44:
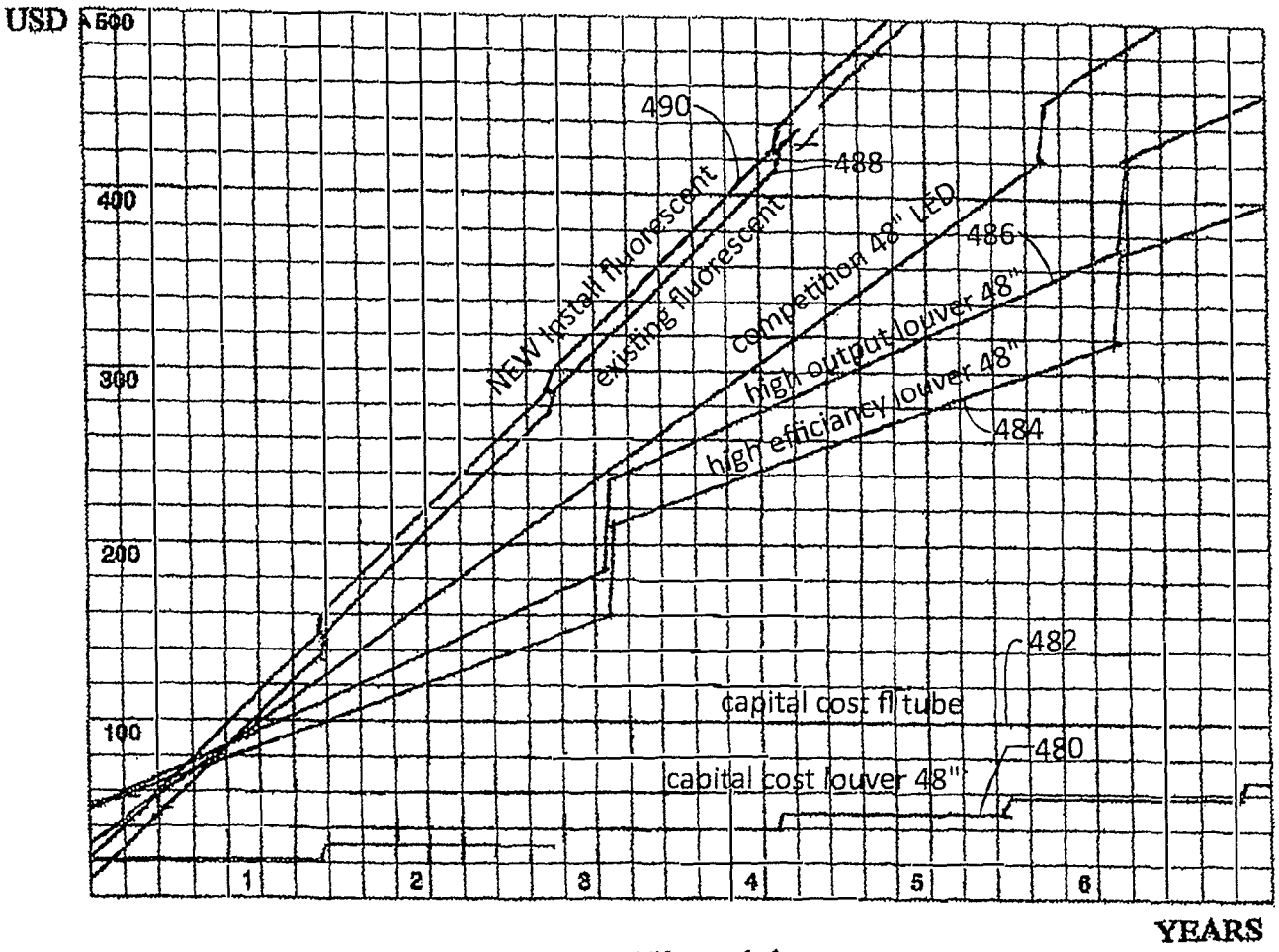
FIG. 44 is a graph of operational costs of non-curvilinear LED luminaries in accordance with principles of the present invention in comparison with conventional LED and fluorescent luminaries where the X axis is time in years and the Y axis is U.S. dollars (USD).

FIG. 44 is a graph of operational and capital costs of non-curvilinear LED luminaries in comparison with conventional LED and fluorescent luminaries where the X axis is timed expressed in years and the Y axis is U.S. dollars (USD). The capital cost to replace a lighting bar (LED light bar) comprising a delta or triangular shaped LED luminary 480 which extends 48 inches is illustrated in the graph and has the lowest cost. The capital cost to replace a 48 inch fluorescent bulb 482 operating at 65 watts has a higher cost. The operational cost of a high efficiency delta or triangular shaped LED luminary 484 which is 48 inches long and emits and emits 3000 lumens (L) is shown in the graph and has the lowest operational cost. The operational cost of a high output delta or triangular shaped LED luminary 486 which is 48 inches long and emits a brighter light with an illumination of 3600 L, but with the more power and the same number of emitters as LED luminary 484, is slightly more than the high efficiency LED luminary. A typical prior art LED luminary 486 is shown in the graph and has higher operational costs than the delta triangular shaped LED luminaries 484 and 486. The operational costs of an existing 48 inch 65 watt (W) fluorescent tube 488 than including ballast is much more expensive than the delta triangular shaped LED luminaries 484 and 486. The operational costs of electricity to operate a newly installed fluorescent tube 490 are the most expensive cost on the graph.

When referring to relative brightness to power, the correct term is efficacy or illuminating efficacy and it can be expressed in lumen per watt. Electrical efficiency when referring to the light bar or its components can be expressed in watts of power going into the system versus how many are delivered to the emitters themselves. Lifespan can be expressed in thousands of hours. Typically, a fluorescent tube will last 8 to 10,000 hours. A conventional LED can last about the same when driven hard as they are when used as fluorescent replacements. A high-quality SMD high-power LED will last about 50,000 hours when driven to spec and over 70,000 hours when under-driven. The models of lighting described by this patent application can be optimized to be nearly 100% efficient from the light bars themselves, that is to say, 100% of the watts going to the light-bar are delivered to the emitters. This is because the wiring goes directly to the emitters and there is not a lot of power loss on the traces. There is a tremendous gain in overall system efficiency when the emitter count is optimized to the input voltage so an extremely high-efficiency electrical driver can be utilized. Four to five time improvements in conventional efficiency can be achieved with the inventive LED light bars.

Figure 45:
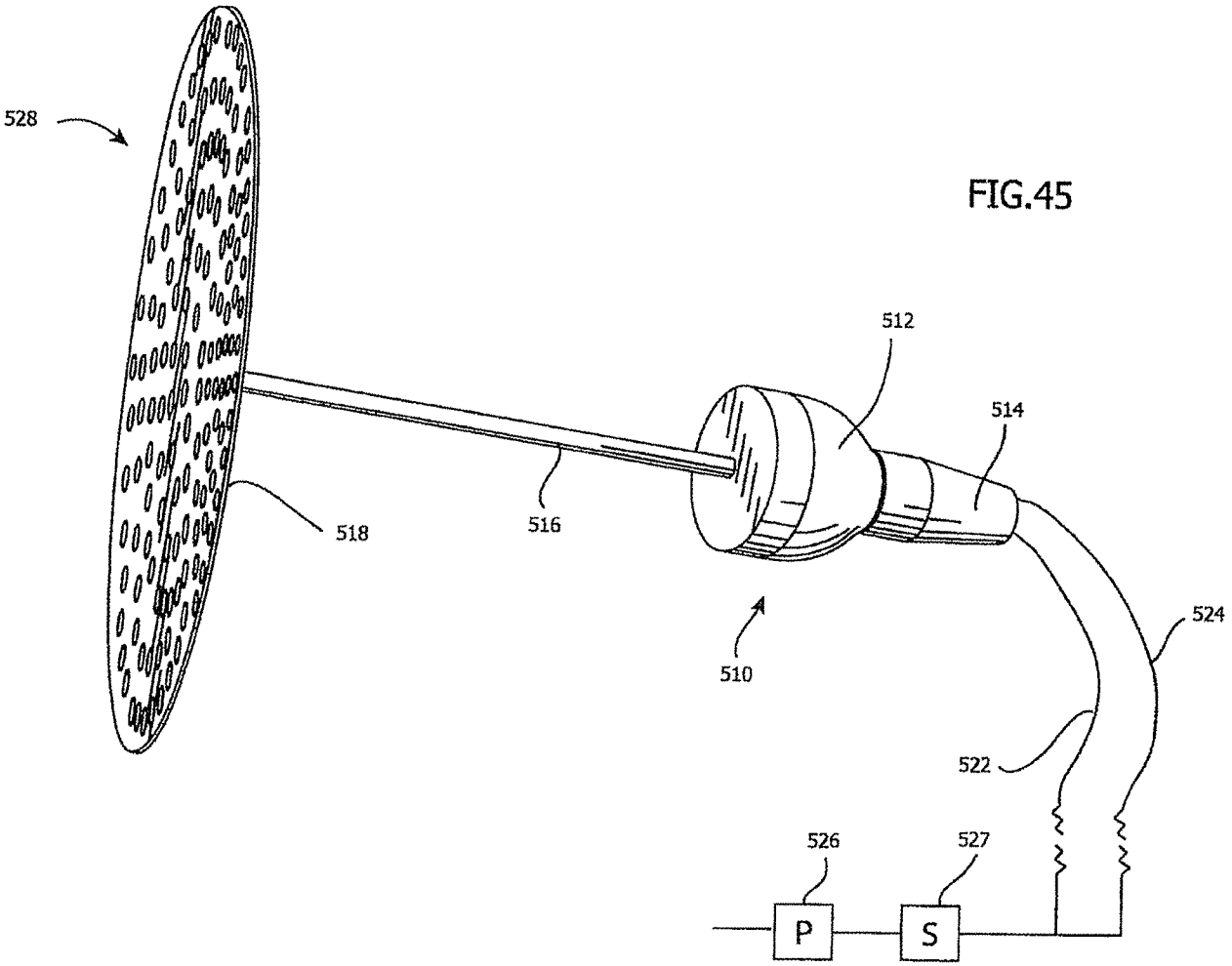
FIG. 45 is a schematic diagram of a prototype non-curvilinear LED luminary in accordance with principles of the present invention.
Figure 46:
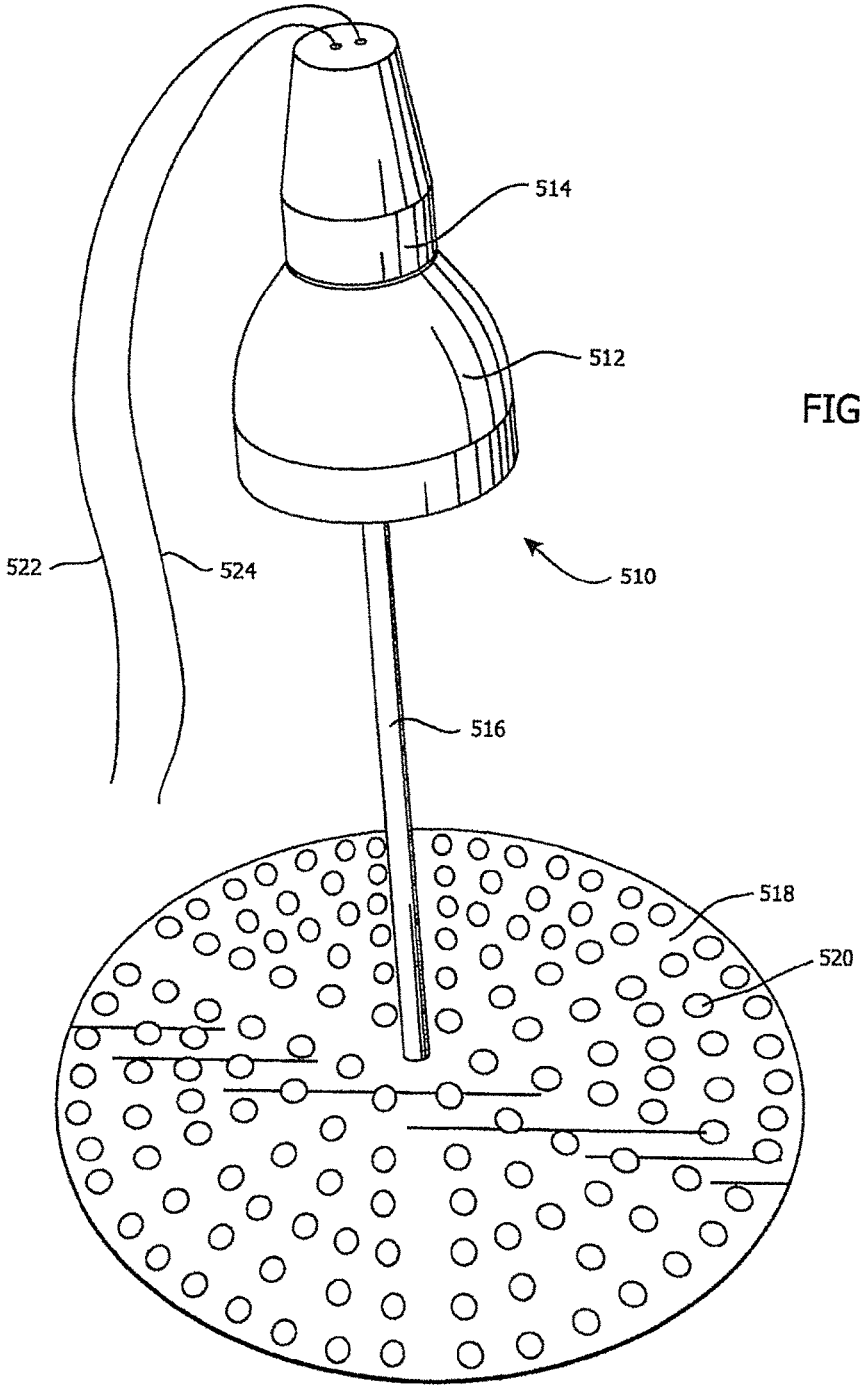
FIG. 46 is a top view of the prototype non-curvilinear LED luminary of FIG. 45.

FIG. 45 is a schematic diagram of a prototype non-curvilinear LED luminary. FIG. 46 is a top view of the prototype non-curvilinear LED luminary.

FIG. 47 is a schematic diagram of another prototype non-curvilinear LED luminary. FIG. 48 is an enlarged cross-sectional view of a prototype delta three sided non-curvilinear LED luminary taken along line A-A of FIG. 47. FIG. 49 is a bottom view of the non-curvilinear LED taken along line B of FIG. 48.

Figure 50:
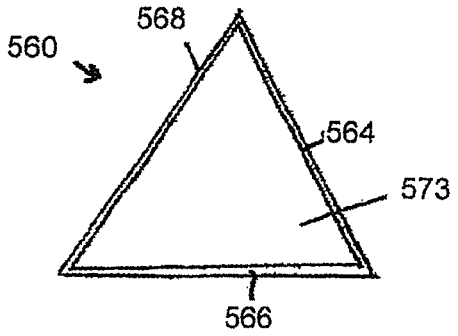
FIG. 50 is an enlarged cross-sectional view of a further prototype delta three sided non-curvilinear LED luminary in accordance with principles of the present invention.
Figure 51:
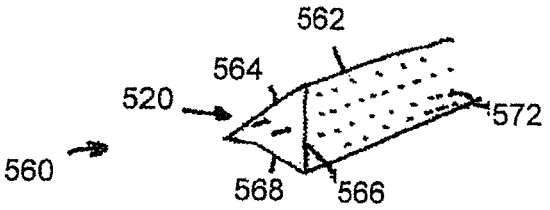
FIG. 51 is a perspective view of part of the prototype delta three sided noncurvilinear LED luminary of FIG. 50.

FIG. 50 is an enlarged cross-sectional view of a further prototype delta three sided non-curvilinear LED luminary. FIG. 51 is a perspective view of part of the prototype delta three sided non-curvilinear LED luminary of FIG. 50.

Figure 52:
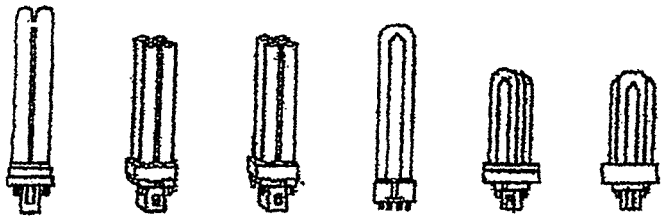
FIG. 52 is a perspective view of pin arrangements in lamp bases for compact lamp shapes.
Figure 53:
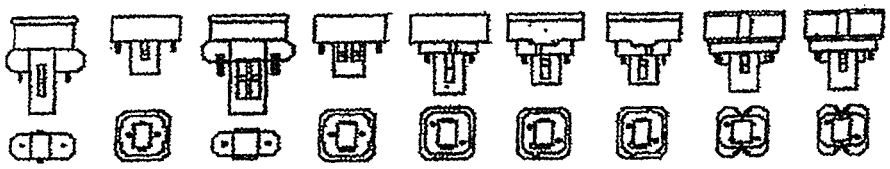
FIG. 53 illustrates the front and bottom views of pin arrangements in compact lamp bases for two pin lamps.
Figure 54:
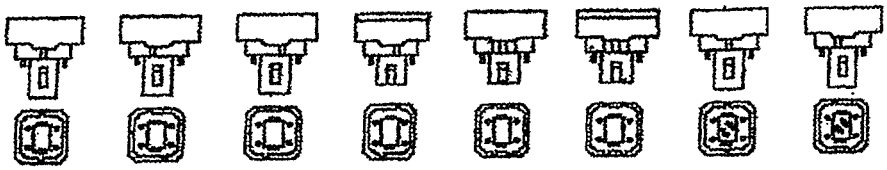
FIG. 54 illustrates the front and bottom views of pin arrangements in compact lamp bases for four pin lamps.
Figure 54:
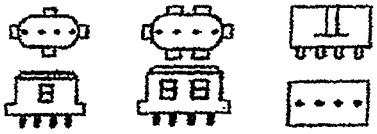
Figure 55:
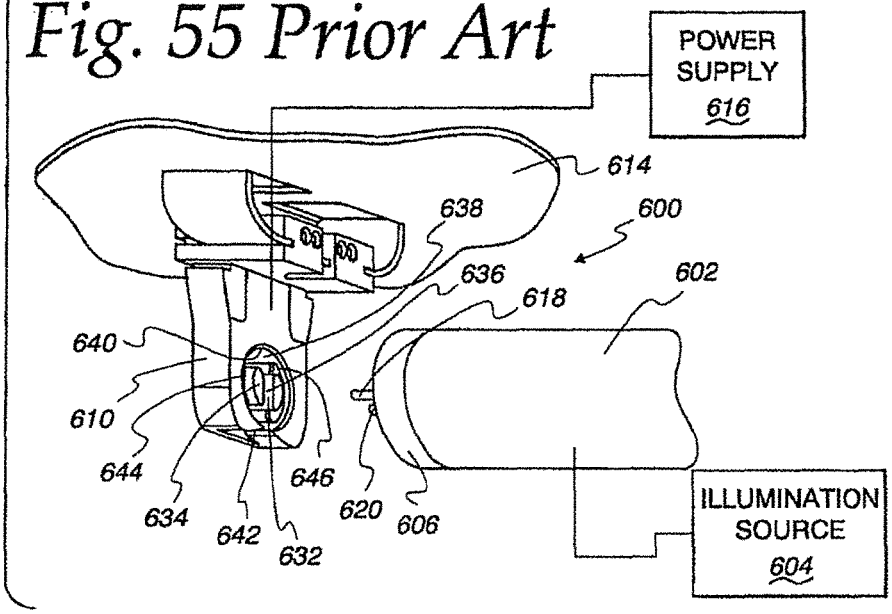
Fig. 55 Prior Art
FIG. 55 is a fragmentary, exploded, perspective view of one end of a conventional tubular lighting assembly with a connector on a body having an illumination source and a cooperating connector on a support.

FIG. 52 is a perspective view of pin arrangements in lamp bases for compact lamp shapes. FIG. 53 illustrates the front and bottom views of pin arrangements in compact lamp bases for two pin lamps. FIG. 54 illustrates the front and bottom views of pin arrangements in compact lamp bases for four pin lamps.

In describing the preferred embodiments of the invention, which are illustrated in the drawings, specific terminology has been resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

The present invention and the various features and advantageous details thereof are explained more fully with reference to the non-limiting embodiments described in the detailed description of the invention. The present invention can relate to aspects of providing electrical housings, device frame work, and a lightweight luminary body for a luminary whose illumination is provided by light emitting diodes (LEDs). The present invention can also addresses issues related to thermal management, heat sink, and power source integration. The more compact LED orientation can be achievable with improved management of the thermal operating loads.

FIG. 47 illustrates an existing lighting fixture 510 that is retrofitted for light emitting diode (LED) lamination. Driver 502 is provided for LED electric power. A shaft 503 is connected to a LED power strip 504. A LED bulb 505 is connected to the LED power strip, electric power lines 506 are connected to and power the LED power strip.

FIGS. 45-51 show a light emitting diode (LED) luminary 510 according to one embodiment of the present invention. Luminary 510 includes a socket 512 that is preferably constructed to removably cooperate with a base 514. Regardless of the specific construction of the base 514, the base is commonly understood as that portion of a fixture that receives a luminary and provides the electrical connection between the luminary and the fixture. In one embodiment, the socket and base are constructed to cooperate in a threading manner common to many different types of luminaries. Alternatively, the socket and base can be constructed in any number of corresponding mating configurations. A number of such mating configurations are shown in FIGS. 52-54. It is appreciated that such interactions may be provided in a number of configurations that may or may not have a threading and/or a twisting interaction between the socket and base.

Referring back to FIGS. 45 and 46, an optional post 516 extends between the socket and a base or support 518. The support includes one, and preferably a number of individual light emitting diodes (LEDs) 520 that can be supported in an offset orientation from the socket. Preferably, the support can be configured to isolate the LEDs from the atmosphere. It is also appreciated that the support can form a lens or the outermost translucent structure of the luminary and/or be positioned very near thereto for those instances that include a supplemental lens near support 518.

A number of conductors or electrical connectors 522 and 524 can communicate electrical power, which are indicated by exemplary power supply 526 and/or switch 527 to the socket. The conductors 522 and 524 can extend through the optional post 516 to the support. The support 518 can be provided with a number of wire traces that are distributed about the support and electrically connect to each LED to the power source 526. As explained further below, it is appreciated that one or more power modifying devices such as converters or drivers may be disposed between LEDs and power source. The LEDs 520 can be oriented on each of the opposite sides 528 and 530 of the generally planar shape of support 518 of the luminary.

As shown in FIG. 47, a shroud or reflector 530 can be oriented about the luminary 510 and configured to redirect light emitted from LEDs oriented on the upward directed side 530 of the support in a generally downward direction, indicated by arrow 534 (FIG. 48), to improve the illumination performance of luminary. The LEDs are preferably uniformly distributed about the support.

Referring to FIGS. 47-49, an alternate configuration of the luminary includes a generally planar multi-sided hollow support post 544 that extends in a longitudinal direction between the socket 512 and support 518. As shown in FIG. 48, in one embodiment of the present invention, the support post includes three walls 546, 548, and 550 that form a generally equilateral triangle. Although shown as having a triangular shape, it is appreciated that the support post can be provided in other generally rectilinear or substantially non-curvilinear cross-sectional shapes. As described further below, such a configuration increases the area available for LED support and provides a beneficial configuration for the integration of power, heat dissipating, and operational control devices such as device drivers within the footprint of the luminary rather than requiring extraneous structures for housing such components. As shown in FIG. 48, a cavity 552 enclosed by the post 544 may be sized to accommodate electrical components, such as a driver, a heat sink, a circuit board, electrical and/or thermal components 556, associated with the powered operation of the LEDs.

FIGS. 50 and 51 show a luminary 560 according to another embodiment of the invention. The luminary can include an elongated body 562 that can comprise a number of sides 564, 566 and 568 that can also be oriented in a rectilinear or non-curvilinear orientation. Unlike luminary 510, luminary 560 includes a socket 570 that is generally oriented at one end of luminary. A number of individual LEDs 572 can be distributed about at least one, and preferably more than one or each of sides 564, 566 and 568 of the luminary. A space 573 bounded by sides 564, 566 and 568 and socket 570 can accommodate the electronic and/or thermal equipment such as a power supply and/or electronic drivers, heat sinks and/or other thermal control structures, and/or controllers associated with the operation of LEDs. As shown in FIG. 51, in another embodiment, a number of LEDs 572 is supported by each side 564, 566 and 568 of the luminary 560. Such an orientation can increases the range of lumen output associated with luminary 560 as compared to conventional prior art luminaries having similar spatial requirements. Although the LEDs 572 are shown as being supported on a lens forming structure of luminary 560, it is appreciated that the LEDs could be supported on an internal power strip or circuit board having a generally similar shape as the luminary and can be oriented in close proximity to the interior surface of sides 564, 566 and 568. Such an LED support can be longitudinally translatable relative to the exterior surface of the luminary during the assembly thereof. The LEDs can be integrated into each of sides 564, 566 and 568 such that each of the respective sides of the luminary forms the lens and isolates the LEDs from the atmosphere.

The shape of the frame work, housing configuration, and considerations of thermal management can allow the placement of LEDs on a broader surface area than known conventional luminaries. This dispersed placement of the LEDs can allow greater degree of light dissipation and greater lumen output. In one preferred embodiments, the non-circular or rectilinear orientation of the LEDs can allow up to three surface points for placement of the individual light sources. The preferred embodiment can includes a frame work housing and thermal management channel that also allows for selective internal or external placement of a power source that powers the light source. Regardless of the proximate orientation of the power source, the luminary can allow greater thermal management for heat dissipation. In a preferred embodiment, the luminary has a three-sided, triangular or delta cross-sectional shape. It is appreciated that the lumen can have any number of generally non-curvilinear shapes including a square or virtually any number of planar side members. When provided in a delta or triangular shape, it is appreciated that the lumen can be provided in virtually any shape including equilateral and/or isosceles triangular shapes. The multiple planar surface structures allows for greater variation in the lumen orientation and position and a broader lumen mounting area to provide greater light.

It is envisioned that the socket of the lumen (luminary) can be configured to cooperate with virtually any base receptacle including, but not limited to, those shown in FIGS. 52-54. Such bases can also include other bases. It is envisioned that the luminary of the present invention can be provided in a shape applicable to any base configuration. The luminary can be configured to operate in the range of about 1 watt to about 1000 watts or more power usage. The luminary can provide a full spectrum of kelvin colors and can be configured for operation at all voltages including the most common voltages of 12 volts (v), 24 v, 110 v, 120 v, 208 v, 277 v, and 480 v. It is further appreciated that the luminary can be provided in virtually any length including lengths ranging from about 2 inches to about 96 inches or more and lengths common to the lighting industry.

The disclosed luminary can provide for greater surface area for LED light source than any known conventional luminary having a comparable footprint. The luminary construction can also allow for internal or external placement of a power supply source while allowing thermal management and greater lumen output and greater degree of light spread. The luminary can be configured to be a suitable plug and play configuration to provide enhanced LED lighting that suitable for operation with conventional fluorescent type lighting.

This invention can allow more surface area for placement of LEDs for the purpose of increased lumen output and greater degree of light dispersion. This can allow provisions for an internal or an external power supply, source, controllers, connections, and/or thermal control devices. The triangular shape can allow up to three points for light surface and thermal management to provide a luminary with a greater operating range and improved power management.

The improved light emitting diode (LED) illuminating assembly can comprise a multiple sided modular LED lighting bar, which is also referred to as a multi-sided LED light bar, comprising a non-curvilinear (LED) luminary with a multi-sided elongated tubular array having multiple, several, numerous or many sides comprising modular boards which can define panels with longitudinally opposite ends. The tubular array preferably can have a non-curvilinear cross-sectional configuration (cross-section) without and in the absence of a circular cross-sectional configuration, oval cross-sectional configuration, elliptical cross-sectional configuration and a substantially or rounded curved cross-sectional configuration. Each of the sides of the multi-sided tubular array can have a generally planar flat surface as viewed from the ends of the array, and adjacent sides which intersect each other and converge at an angle of inclination. Operatively positioned and connected to the multi-sided array can be an internal non-switching printed circuit board (PCB) driver comprising a driver board. The driver can be an interior or inner driver board positioned within an interior of the tubular array or can be an exterior or outer driver board which comprises and provides one of the sides of the tubular array. Desirably, two or some of the sides comprise modular LED emitter boards which can provide elongated LED PCB panels. The internal driver comprising the driver board can drive the LED emitter boards and can comprise one or more modular driver boards that are connected in series and/or parallel with each other.

The improved LED illuminating assembly comprising a multi-sided light bar providing a non-curvilinear (LED) luminary can have an optimal count of LED emitters comprising a group, set, matrix, series, multitude, plurality or array of light emitting diodes (LEDs) securely positioned, mounted and arranged on each of the emitter boards for emitting and distributing light outwardly from the emitter boards in a light distribution pattern for enhanced LED illumination and operational efficiency.

End cap PCB connectors providing connector end boards which are also referred to as end cap boards can be positioned at the ends of the tubular array and connected to the internal driver board and the emitter boards. The connector end boards can have power connector pins which can extend longitudinally outwardly for engaging and providing an electrical power connection with at least one light socket. End caps can be positioned about the end cap PCB connectors. The end caps can have bracket segments which can provide clamps that can extend longitudinally inwardly for abuttingly engaging, grasping and clamping the emitter boards.

The boards comprising the emitter boards and driver board can be generally rectangular and modular. Each of the sides of the multi-sided array comprising emitter boards can comprise a single emitter board or a set, series, plurality, multitude or multiple elongated emitter boards longitudinally connected end to end. The sides comprising the emitter boards can include all of the sides of the tubular array or all but one of the sides of the tubular array with the one other side comprising the driver board. The driver board can comprise a single driver board or multiple driver boards that are longitudinally connected end to end. The boards can have matingly engageable male and female connectors such that the connectors on the connector end boards matingly engage, connect and plug into matingly engageable female and male connectors on the driver board and/or on the emitter boards.

A multiple sided tubular heat sink comprising multiple metal sides can be positioned radially inwardly of the multi-sided tubular array for supporting and dissipating heat generated from the emitter boards and driver board(s). The heat sink can have a tubular cross-section which can be generally complementary or similar to the cross-sectional configuration of the multi-sided tubular array. The cross-section of the heat sink preferably has a non-curvilinear cross-section without and in the absence of a circular cross-section, oval cross-section, elliptical cross-section and a substantially curved or rounded cross-section.

The improved LED illuminating assembly comprising a multi-sided light bar providing a non-curvilinear (LED) luminary can have emitter traces for connecting the LED emitters in parallel and in series and can have alternating current (AC) and/or direct current (DC) lines. The emitters can comprise at least one row of substantially aligned aliquot uniformly spaced LED emitters. Desirably, the multi-sided light bar provides a no wire design in the absence of electrical wires.

The improved LED illuminating assembly comprising a multi-sided light bar providing a non-curvilinear (LED) luminary can also have a diffuser comprising an elongated light diffuser cover which can provide a light transmissive lens that can be positioned about and cover the LED emitters for reflecting, diffusing and/or focusing light emitted from the LED emitters.

In one embodiment, the lighting bar comprises: a two sided modular LED lighting bar; the array comprises a two sided array; the heat sink comprises a heat sink with at least two sides; and the emitter boards are arranged in a generally V-shaped configuration at an angle of inclination ranging from less than 180 degrees to an angle more than zero degrees; and the driver is positioned in proximity to an open end of the V-shaped configuration.

In another embodiment, the lighting bar comprises: a three sided modular LED lighting bar; the array comprises a three sided delta or triangular array; the heat sink comprises a tubular three sided heat sink with a delta or triangular cross-section; and the angle of inclination can range from less than 180 degrees to an angle more than zero degrees, and is preferably 120 degrees. The driver can be positioned within the interior of the delta or triangular cross-section of the three sided heat sink.

In a further embodiment, the lighting bar comprises: a four sided modular LED lighting bar; the array comprises a square or rectangular array; the heat sink comprises a tubular four sided heat sink with a square or rectangular cross-section; and the angle of inclination can be a right angle of about 90 degrees.

In still another embodiment, the lighting bar comprises: a five sided modular LED lighting bar; the array comprises a pentagon array; the heat sink comprises a tubular five sided heat sink with a pentagon cross-section; and the angle of inclination of the intersecting sides of the pentagon can comprise an acute angle such as at about 72 degrees.

Multi-sided LED light bars, arrays and heat sinks with more than five sides can also be used.

The improved LED illuminating assembly can comprise an illuminated LED sign, such as an outdoor sign or an indoor sig. The outdoor sign can comprise an outdoor menu board, such as for use in a drive through restaurant. The indoor sign can comprise an indoor menu board such as for use in an indoor restaurant. LED signs can also be provided for displays and other uses. The illuminated LED sign can comprise: a housing with light sockets; at least one light transmissive panel providing an illuminated window connected to the housing; multiple sided modular LED lighting bars, which are also referred to as multi-sided light bars, of the type previously described, can be connected to the light sockets for emitting light through the illuminated window; and the illuminated window can be moved from a closed position to an open position for access to the LED lighting bars. The lighting bars can extend vertically, horizontally, longitudinally, transversely or laterally along portions of the housing. The illuminated window can be covered by a diffuser.

The improved LED illuminating assembly can also comprise: an overhead LED lighting assembly providing overhead ceiling light with: translucent ceiling panels comprising light transmissive ceiling tiles; at least one drop ceiling light fixture comprising light sockets; and at least one multiple sided modular LED lighting bar (multi-sided light bar) of the type previously described, connected to the light sockets and positioned above the ceiling panels for emitting light through the translucent ceiling panels in a general downwardly direction and diverging toward a floor or room. One or more concave light reflector can be positioned above the LED lighting bar to reflect light downwardly through the translucent ceiling panel into the room.

Among the many advantages of the light emitting diode (LED) illuminating assemblies provided with a multi-sided LED light bar comprising a non-curvilinear LED luminary are:

1. Superior product.
2. Outstanding performance.
3. Superb illumination.
4. Improved LED lighting.
5. Excellent resistance to breakage and impact.
6. Long useful life span.
7. User friendly.
8. Reliable.
9. Readily transportable.
10. Lightweight.
11. Portable.
12. Convenient.
13. Easy to use and install.
14. Less time needed to replace the light bar.
15. Durable
16. Economical.
17. Attractive.
18. Safe.
19. Efficient.
20. Effective.

There are many other advantages of the inventive LED illuminating assembly with a novel multi-sided LED lighting bar comprising a non-curvilinear LED luminary versus conventional LED lighting.

1. The use of multi-sided light bar allows for a much wider distribution of light. A standard solution has about 100-110 degree light beam to half brightness. The inventive LED illuminating assembly with the novel multi-sided LED lighting bar, however, can reach a full 360 degrees with little or no loss of brightness. Furthermore, the illustrated two-sided design can reach over 180 degrees to half-brightness. Another advantage is near-field use; lighting something just a few inches from the light source.

2. The internal driver of the improved LED illuminating assembly with the multi-sided lighting bar is less expensive, uses less labor, is simpler and has lower chance of failure over conventional lighting.

3. The non-switching driver of the improved LED illuminating assembly with the multi-sided lighting bar provides a boost of efficiency on the scale of 47 magnitude. A typical switching driver which is used on conventional LED lighting bars has a typical efficiency of 80-85% or 15-20% loss. In contrast, the improved LED illuminating assembly with the multi-sided lighting bar can have an efficiency of 95-97% (3-5% loss), and is four to seven time more efficient than conventional lighting and this improved results in about 20% overall efficiency gain. Desirably, the improved LED illuminating assembly with the multi-sided lighting bar can achieve greater than 90% efficiency, which is practically impossible with conventional switching drivers.

The improved LED illuminating assembly with the multi-sided lighting bar desirably can optimize the emitter count to the voltage source and can advantageously utilize wiring of the emitters in the appropriate numbers in a parallel-series arrangement.

In the improved LED illuminating assembly with the novel multi-sided lighting bar, the diffuser comprising the lens can be modified to change the output of the beam. By use of this arrangement, dark spots can be eliminated so that a much higher illuminating output can be attained. The improved LED illuminating assembly with the multi-sided lighting bar example can emit a 360 degree beam without visible hot or cold spots. The improved LED illuminating assembly with the multi-sided lighting bar can also have scalable length since there is no theoretical limit to the length of the novel arrangement and design. The actual length may be limited, however, by customer needs, costs, available space, and production capabilities.

The improved LED illuminating assembly with the multi-sided lighting bar further can have driver redundancy using parallel and multiple driver sub-circuits for even better reliability. This can achieve two other important goals:

1. The improved LED illuminating assembly with the multi-sided lighting bar can attain even, uniform accurate power levels to all emitters. In contrast, conventional LED designs do not control the current to all the emitters evenly, but apply a metered amount of current to all parallel circuits, typically as many as three to eight of them, and the current can vary on each parallel circuit because there is no control per sub-circuit. The improved LED illuminating assembly with the multi-sided lighting bar can control each sub-circuit independently so that every emitter in the entire light assembly gets exactly the same current.

2. The improved LED illuminating assembly with the multi-sided lighting bar achieves reliability of output during normal operating conditions and in the event of sub-circuit failure.

In a conventional LED design with output 300 mA to three branches or sub-circuits, when one branch fails, then two sub-circuits will share that same 300 mA so they will go from 100 mA to 150 mA, which is a huge change in current that is not desirable and is likely to cause a cascading failure. In the improved LED illuminating assembly with the multi-sided lighting bar, if one sub-circuit fails, the remaining circuits operate exactly as they were before the failure.

Furthermore, in the improved LED illuminating assembly with the multi-sided lighting bar, the sub-circuits can be spread out so that no one portion of the light assembly goes completely dark, but will just dim. This can be very important when lighting up a sign so that although it may be a little darker in one spot, the sign will still illuminate brightly and be readable.

In conventional LED illumination, all the emitters are typically in series with each other so in the event of a single LED failure that entire row blinks out and that entire portion of the light assembly will go dark. In the improved LED illuminating assembly with the multi-sided lighting bar, the strings or set of emitters are aligned and connected in parallel with the other emitter so that in the event of failure of one sub-circuit, the LED lamp of the LED illuminating assembly goes to 50% brightness but is evenly lit from edge to edge.

The improved LED illuminating assembly with the multi-sided lighting bar also achieves efficiency over initial capital costs. Conventional LED designs attempt to maximize lumens per emitter and are designed according to the specification ("spec") of the emitter. Emitters operating 'at spec' tend to net about 80 Lumen/watt total.

The improved LED illuminating assembly with the multi-sided lighting bar can be specifically under-driven to achieve some very valuable goals:

1. Longer life span. For example, an emitter run at 70% of rated capacity will last 70-80,000 hours when specified at 50,000 hours. That's a difference of 8.6 to 5.7 years when operating at 24 hours per day at seven days a week.

2. Higher efficacy. The improved LED illuminating assembly with the multi-sided lighting bar can achieve over 100 L/W system total by de-tuning the current drive of the emitter. The improved LED illuminating assembly with the multi-sided lighting bar can achieve the same total output by adding more emitters. The initial cost maybe higher but the operational cost will be much lower. This is shown in the illustrated operational costs chart which compares the high output 3600 L LED light bar to the high efficiency 3000 L LED light bar with the exact same design but at different drive operating levels because the LEDs are more efficient and last longer when driven below spec.

3. Higher reliability. Within their expected lifespan, LED emitters will maintain lumen longer and maintain color temperature longer when they are cooler, if the temperature is directly proportional to LED drive current. An over-driven LED will lose color temperature accuracy quicker than one driven at spec. An under driven LED can maintain lumen and color temperature longer than even one driven to 'spec'.

The improved LED illuminating assembly can have a no-wire design such that the novel light bar of the improved LED luminary assembly has no electrical wires. This arrangement can decrease assembly time and problems and lower failure rate associated with complexity in a manual labor portion of the assembly. A conventional LED light bar can have 12 or more hand-made solder joints. The new inventive light bar design can include only two hand-made solder joints as well as eliminating 100% of the electrical wiring. Elimination of standard electrical wires can increase both initial and long term reliability and expenses.

The embodiments described above use a driver board including circuitry which converts AC to DC for driving the LEDs that use a DC supply of the correct electrical polarity. The driver board adds to the overall component cost, assembly cost and design cost of tubular LED lighting assemblies and requires additional space in the assembly. Power loss in the range of 15% or higher typically result from the conversion from AC to DC. The driver components, such as rectifiers to convert AC into pulsed DC and filters to smooth the signal to a constant DC voltage, have high failure rates compared to other longer lasting components of tubular LED lighting assemblies. The use of highly reliable components is important, but can add substantial cost and may entail complex designs.

LED-based solid state lighting provides the opportunity for significant reduction in the carbon footprint of the electrical power grid due to the dramatic reduction in real power consumption. However, if power factor is not managed, the grid will still need to be able to provide a much higher power level than is actually needed at the load, eliminating a significant portion of the benefits of moving to solid state lighting. Power factor is a unit-less ratio of real power to apparent power. Real power is the power used at the load measured in kilowatts (kW). Apparent power is a measurement of power in volt-amps (VA) that the grid supplies to a system load. In a highly reactive system, the current and voltage, both angular quantities, can be highly out of phase with each other. This results in the power grid needing to supply a much larger reactive power to be able to supply the actual real power at any given time. Incandescent bulbs have historically had a very high power factor. LEDs have a non-linear impedance as do their drivers, causing the power factor to be inherently low. In order to combat this, the drivers typically include power factor correction circuitry to increase that ratio to as close to 1 as possible. However, as mentioned above, significant power is still typically lost in converting AC to DC current, resulting in less than ideal power factor ratios.

The LEDs, being diodes, conduct current in only a single direction. However, AC driven LEDs are also available as an alternative to DC solutions. AC LEDs do not require an AC to DC driver circuit. With AC LED technology an LED is directly connected to AC power, or through a limiting resistor circuit. A rectifier diode may be used to prevent reverse bias. With AC as a driving source, the LED will only illuminate about fifty percent of the time. However, the noticeable effect of this can be minimized through circuitry design. For general illumination, AC LED technology can sometimes allow simpler form factors to enhance manufacturing or aesthetics and have the benefit of eliminating the converter and driver components. AC LEDs also allow the lamp to dim and to shift the spectrum of the lamp as it dims to mimic an incandescent light or other colors. Lighting using AC LEDs can also achieve a higher power factor because the power loss associated with DC LED driver circuits is avoided.

AC LED technology has been deployed in some lighting applications, such as street lighting and conventional screw in type bulbs. Despite the potential advantages of AC LED technology, tubular LED lighting assemblies have traditionally deployed only DC LEDs, and the applicant is not aware of any such tubular LED lighting assemblies using AC LEDs. One challenge associated with tubular lighting applications is that the intensity and consistency of the light distribution pattern is particularly important. Conventional LED tubular lamps, utilizing one or more LED emitter panels oriented in the same plane within a cylindrical tubular diffuser lens, are typically operated at a high percentage of the LED power rating and rely on the resulting intensity and overspill of light towards the sides to improve the light distribution pattern. AC LEDs operate at a lower efficiency when driven at higher power levels, and this presents an obstacle to a high-efficiency tubular lamp of optimal light intensity and distribution performance.

The present invention, however, can readily be adapted to provide tubular lighting forms utilizing AC powered LEDs as an illumination source, thus permitting the elimination of the driver circuit and providing other advantages associated with AC LED technology. In particular, embodiments employing a multi-sided luminary formed of multiple LED emitter boards oriented in intersecting planes provide for a greater number of LEDs and direct the emitted light over a wider angle. AC LEDs can thus be deployed in these embodiments and operated at lower, more efficient power levels while still achieving substantial light intensity and consistent light distribution patterns over a wide area. As explained in more detail below, elimination of the driver circuit also enables other forms such as embodiments which utilize a single AC LED emitter panel that is positioned on a lower profile heat sink and spaced further from a curved diffuser cover to capture a wider angle of light emanating from the LEDs and disburse the light evenly and consistently.

Embodiments of the invention employing AC LED technology eliminate power loss associated with the conversion of AC to DC voltage and can achieve a higher power factor compared to DC LED designs. These embodiments of the invention can be provided as a less complex design in simpler form factors to enhance manufacturing and/or aesthetics, and are potentially more reliable and longer lasting due to a reduction in the number of components that can fail. This is significant advantage to customers who require longer life bulbs to offset the greater up front cost of solid state LED lighting compared to conventional tube lighting. These embodiments further provide for dimming control and the ability to shift the spectrum of the lamp as it dims to mimic an incandescent or other colors.

Referring to FIGS. 55-61, one conventional form of elongate tubular lighting assembly is shown at 600. The lighting assembly 600 consists of an elongate body 602 on, or within, which an illumination source 604 is provided. The illumination source 604 is shown in schematic form to generically represent all existing illumination sources, including those utilizing LEDs, a gas-discharge lamp that uses fluorescence to produce visible light, etc.

The body 602 has first and second end connectors 606, 608, respectively at first and second lengthwise ends of the body 602. The end connectors 606, 608 respectively mechanically and electrically interconnect with connectors 610, 612 mounted on a support 614, that may define a reflector for controllably dispersing light generated by the illumination source 604 and directed thereat. The interaction of the connectors 606, 610 and 608, 612 is substantially the same and thus description herein will be limited to the interaction of the exemplary connectors 606, 610 through which one tube end is mechanically supported and the illumination source 604 is electrically connected to a power supply 616.

The connector 606 has a bi-pin/2-pin arrangement with separate power lead pins 618, 620, which have substantially the same construction and project in cantilever fashion from diametrically opposite locations relative to the body axis 622.

The connector 610 is what is conventionally referred to in the industry as a "tombstone" connector, since it generally resembles a tombstone in terms of its shape. The connector 610 has a mounting portion 624 from which a "tombstone"-shaped portion 626 depends. The mounting portion 624 is designed to slide into its operative position along rails defined by a pair of tabs 628, 630 struck from the support 614. The connectors 610 may be permanently or releasably fixed with respect to the support 614.

The depending connector portion 626 has a pair of non-conductive tabs 632, 634, that project in generally parallel, spaced relationship to define a slot 636 therebetween. The tubular lighting assembly 600 will be described herein as being in an orientation wherein the axis 622 of the body 602 is substantially horizontal. With this arrangement, the slot 636 extends in a substantially vertical line. The tabs 632, 634 project from the base of a cup-shaped receptacle 638 so that there is an annular pathway 640 surrounding the tabs 632, 634 within the receptacle 638. A bottom opening 642 is defined for introducing the pins 618, 620.

To operatively position the connector 606, the body 602 is angularly oriented so that the axes of the power leads/pins 618, 620 reside in the same vertical plane. With the body 602 in this orientation, the pins 618 can be directed, one after the other, through the opening 642, with the leading pin 618 advanced to and through the slot 636 so that the pins 618, 620 reside in diametrically opposite regions of the annular pathway 640. By then turning the body 602 around its axis through 90°, the pin 618 becomes wedged between the tab 634 and a first conductive component 644 within the receptacle 638. The pin 620 wedges in the same manner between the tab 632 and a second conductive component 646 that is generally diametrically opposite to the first conductive component 644 within the receptacle 638. Through the conductive components 644, 646, the pins 618, 620 establish electrical connection between the illumination source 604 and the power supply 616. An electrical circuit is completed by power leads/pins 618', 620' on the connector 608 that have the same bi-pin arrangement and cooperate with the connector 612 in the same manner that the pins 618, 620 cooperate with the connector 610.

Installation of the body 602 requires controlled movement between the connectors 606, 608 at the ends and the cooperating connectors 610, 612. If the pins 618, 620, 618', 620' are not all consistently aligned and appropriately moved, electrical connection of the illumination source 604 may not be established. Improper alignment and movement of the pins 618, 620, 618', 620' during the assembly process may also result in one or more of the pins 618, 620, 618', 620' not appropriately seating. Since the integrity of the mechanical connection of the body 602 relies on stable securing of the pins 618, 620, 618', 620', improper pin seating may allow the body 602 to be inadvertently released, which may cause it to be damaged or destroyed.

Figure 58:
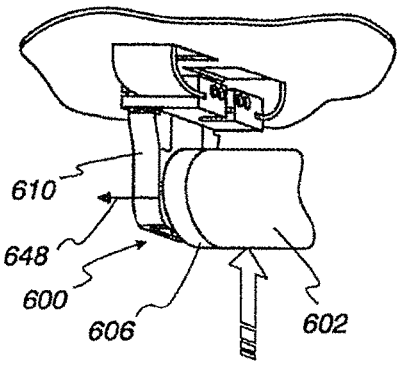
Fig. 58 Prior Art
FIGS. 58 and 59 correspond respectively to FIGS. 56 and 57 and show the body pushed upwardly to engage the cooperating connectors.
Figure 59:
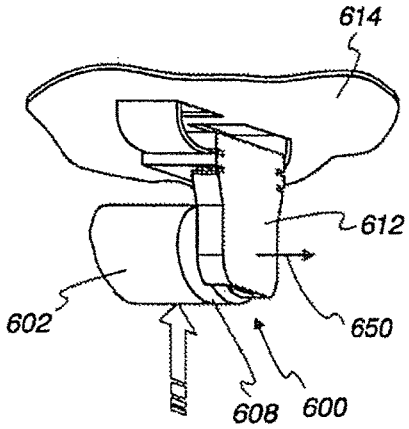
Fig. 59 Prior Art
Figure 60:
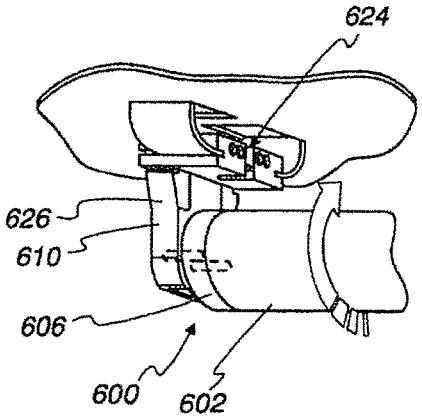
Fig. 60 Prior Art
FIGS. 60 and 61 correspond respectively to FIGS. 58 and 59 and show the tube turned to lock the tube in place through the cooperating connectors.
Figure 61:
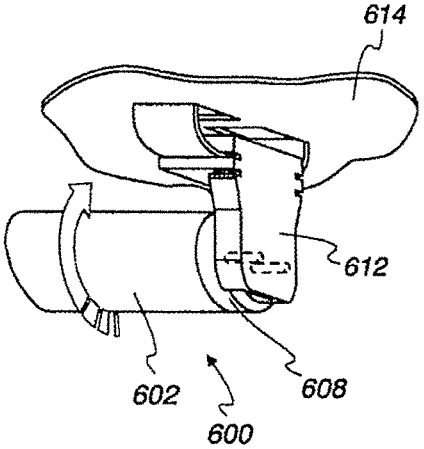
Fig. 61 Prior Art
Figure 62:
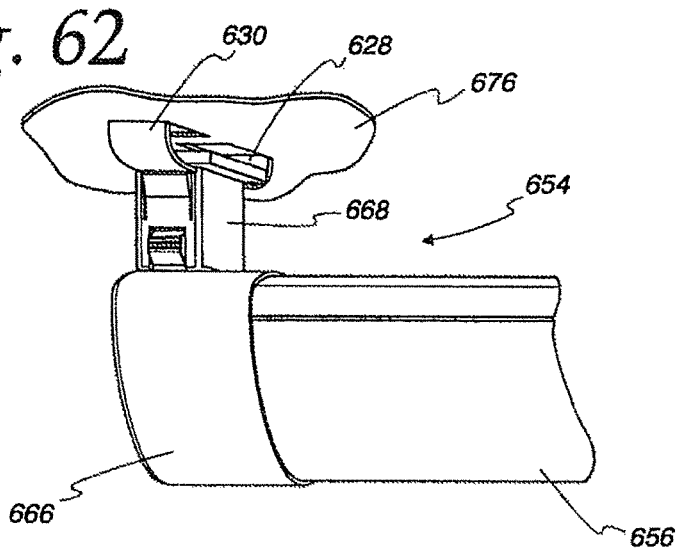
FIG. 62 is a fragmentary, perspective view of an elongate tubular lighting assembly, according to the invention, and showing cooperating connector parts at one end of a body on or within which there is a source of illumination.
Figure 63:
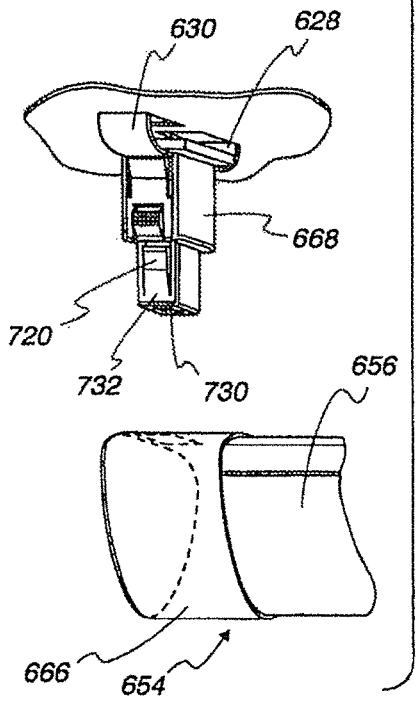
FIG. 63 is a view as in FIG. 62 with the connector parts fully separated from each other.
Figure 64:
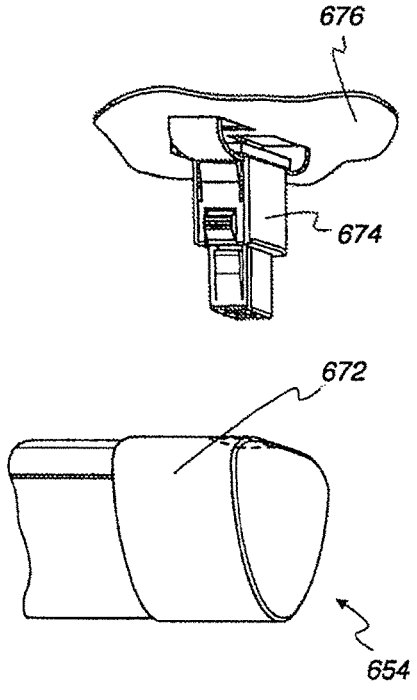
FIG. 64 is a view as in FIG. 63 showing cooperating connector parts at the opposite end of the body.
Figure 65:
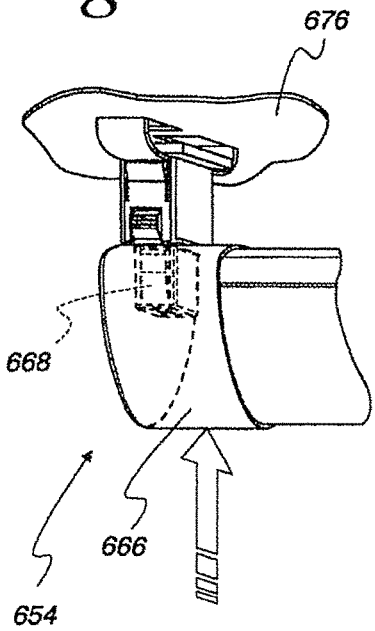
FIGS. 65 and 66 correspond respectively to FIGS. 63 and 64 and show the connector parts snap-fit together.
Figure 66:
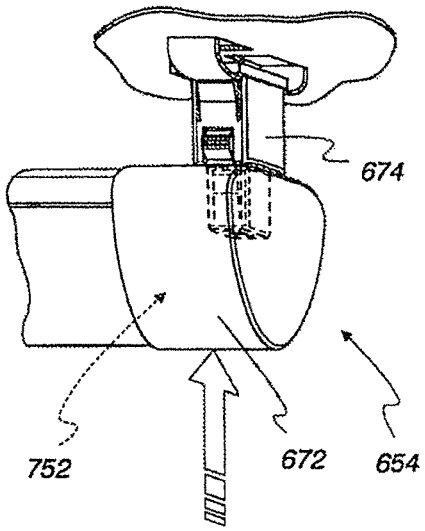

Aside from the inconvenience of installing the body 602, the body 602 may still be prone to releasing, even after proper installation. As seen in FIGS. 58 and 59, the connectors 610, 612, by reason of their overall depending construction, are prone to being deflected oppositely away from each other, as indicated by the arrows 648, 650. A slight deflection at the bottom region of the connectors 610, 612 may be adequate to release the power leads/pins 618, 620, 618', 620' from one or both of the connectors 610, 612. Such deflection might be caused by nothing more than the weight of the body 602.

Further, after repetitive force application to the connectors 610, 612, as during installation and removal of the body 602, the support 614, which is typically light gauge sheet metal, may progressively deform at the locations where the connectors 610, 612 are joined thereto.

Still further, the connectors 610, 612 may slide away from each other under typical forces applied during installation and replacement of the body 602. Those designs, which require a sliding movement of the connectors 610, 612 during assembly, are particularly prone to this problem. That is, one or both of the connectors 610, 612 might move oppositely to its installation direction adequately that the free ends of the pins 618, 620, 618', 620' are not firmly and positively supported. Significantly, there may be no positive blocking of a slight movement of the connectors 610, 612, or a deflection thereof adequate to inadvertently release the body 602 either during, or after, installation.

Figure 78:
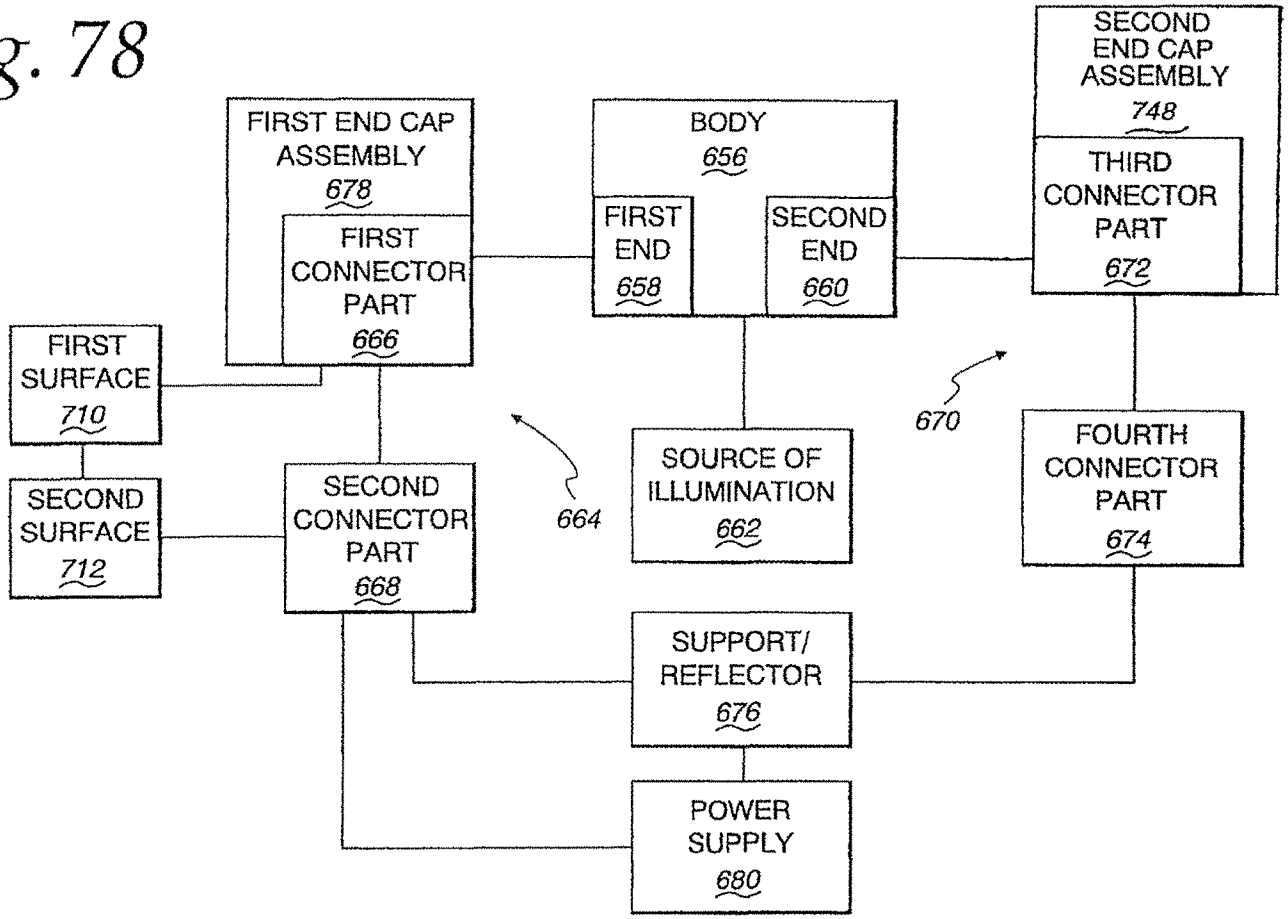
FIG. 78 is a schematic representation of a tubular lighting assembly, according to the invention.

One preferred form of elongate tubular lighting assembly, according to the present invention, is shown at 654 in FIGS. 62-78. FIG. 78 shows the basic components of the tubular lighting assembly 654 in schematic form, to encompass the specific design as shown in FIGS. 62-77, and any of potentially limitless variations thereof which would be apparent to one skilled in the art based upon the disclosure herein.

As seen in FIG. 78, the tubular lighting assembly 654 has a body 656 with a length between first and second ends 658, 660. A source of illumination 662 is provided on or within the body 656.

The source of illumination 662 could be any structure that is provided in a generally tubular form and is capable of generating visible light. While the particular embodiment described in FIGS. 62-77 utilizes LEDs, the invention contemplates using the same principles to construct any type of lighting assembly having a generally elongate tubular body shape between spaced ends at which the body is supported in an operative state. As but one example, the source of illumination may be a gas-discharge lamp that uses fluorescence to produce visible light and conventional bi-pin/2-pin leads at its ends. Other designs are contemplated, either alone or in combination.

A first connector 664 at the first end 658 of the body 656 is made up of a first connector part 666 and a second connector part 668. A second connector 670 is provided at the second end 660 of the body 656 and is made up of a third connector part 672 and a fourth connector part 674. The first and second connectors 664, 670 are configured to maintain the body 656 in an operative state on a support 676 that may be in the form of a reflector, or otherwise configured. The first connector part 664 is part of a first end cap assembly 678 that is provided at the first body end 658. The second connector part 668 is provided on the support/reflector 676. The third connector part 672 is provided at the second end 660 of the body 656, with the fourth connector part 674 provided on the support/reflector 676. The source of illumination 662 is electrically connected to a power supply 680 through the first connector 664.

Referring now to FIGS. 62-77, details of one exemplary form of the generically depicted elongate tubular lighting assembly 654 of FIG. 78 will be described. The body 656 has the basic components of the illuminating assembly/luminary shown in FIGS. 15 and 16, and described hereinabove. Generally, this construction consists of the three-sided delta, or triangularly-shaped, metal heat sink 297 with two LED emitter panels 293 positioned in a generally "V"-shape on the heat sink 297. Each of the LED emitter boards/panels 293 has a plurality of LED emitters 298 spaced at generally uniform intervals along the length thereof between the ends 658, 660 of the body 656. The LED emitter panels 293 provide the source of light of the illumination source 662 depicted in FIG. 78. Each of the LED emitter panels 293 has terminals 302 in the form of conductive components 682 projecting in a lengthwise direction from the opposite ends of the emitter panels 293.

As described above, the first connector 664 is provided at the first end 658 of the body 656, with the second connector 670 provided at the second end 660 of the body 656. The first connector 664 consists of the first connector part 666, that is part of the first end cap assembly 678, and the second connector part 668. The first end cap assembly 678 consists of a first, cup-shaped component 684 defining a first receptacle 686 opening towards the body 656 and into which the first end 658 of the body extends.

The receptacle 686 receives an end connector board 688 which overlies a separate board 690 having L-shaped electrical connector components 692 thereon that cooperate with connector components 694, 696 within wires that extend into the second connector part 668 to establish electrical connection between the boards 688, 690 and the power supply 680.

In this embodiment, the first connector part 666 has three like mounting posts 698 projecting from within the receptacle 686. The posts 698 have stepped diameters to produce shoulders 700 to bear simultaneously against one side 702 of the board 690. The opposite side 704 thereof facially engages a surface 706 on the connector board 688 to positively support the same.

The conductive components 682 on the emitter panel terminals 302 are designed to electrically connect to conductive components 708 on the terminals 324 through a press fit operation. More specifically, the source of illumination 662 and connector boards 688, 690 are configured to be electrically connected as an incident of the first end 658 of the body 656 and first end cap assembly 678 being moved towards each other in a direction substantially parallel to the length of the body 656. As this occurs, the first end 658 of the body 656 extends into the receptacle 686 to thereby place the first end 658 of the body 656 and first end cap assembly 678 in mechanically and electrically connected relationship.

Figure 70:
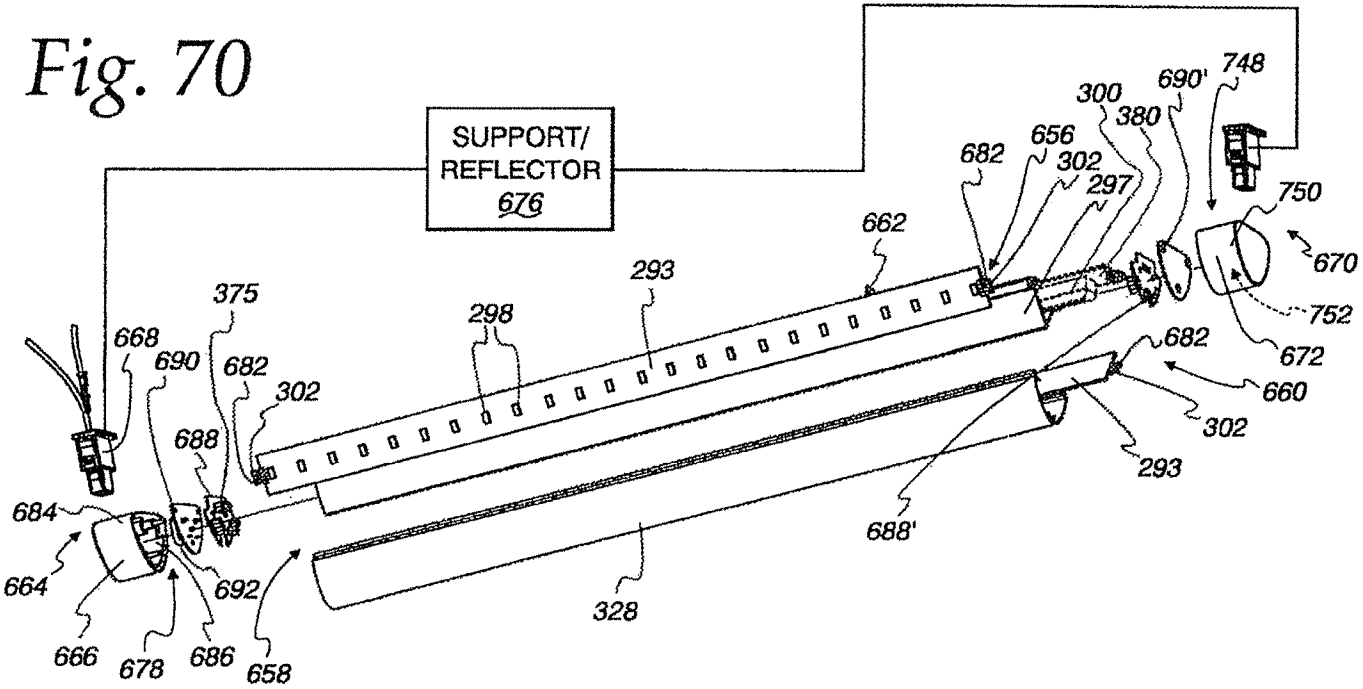
FIG. 70 is an exploded, perspective view of the tubular lighting assembly in FIG. 69.
Figure 70A:
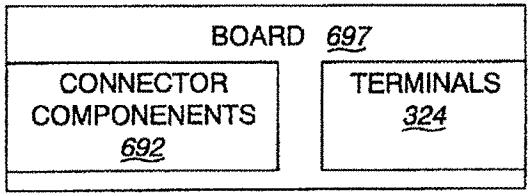
FIG. 70*a* is a schematic representation of a connector board at one end of the body that is an alternative to the two boards used at the same end of the body in FIG. 70.
Figures 71, 72:
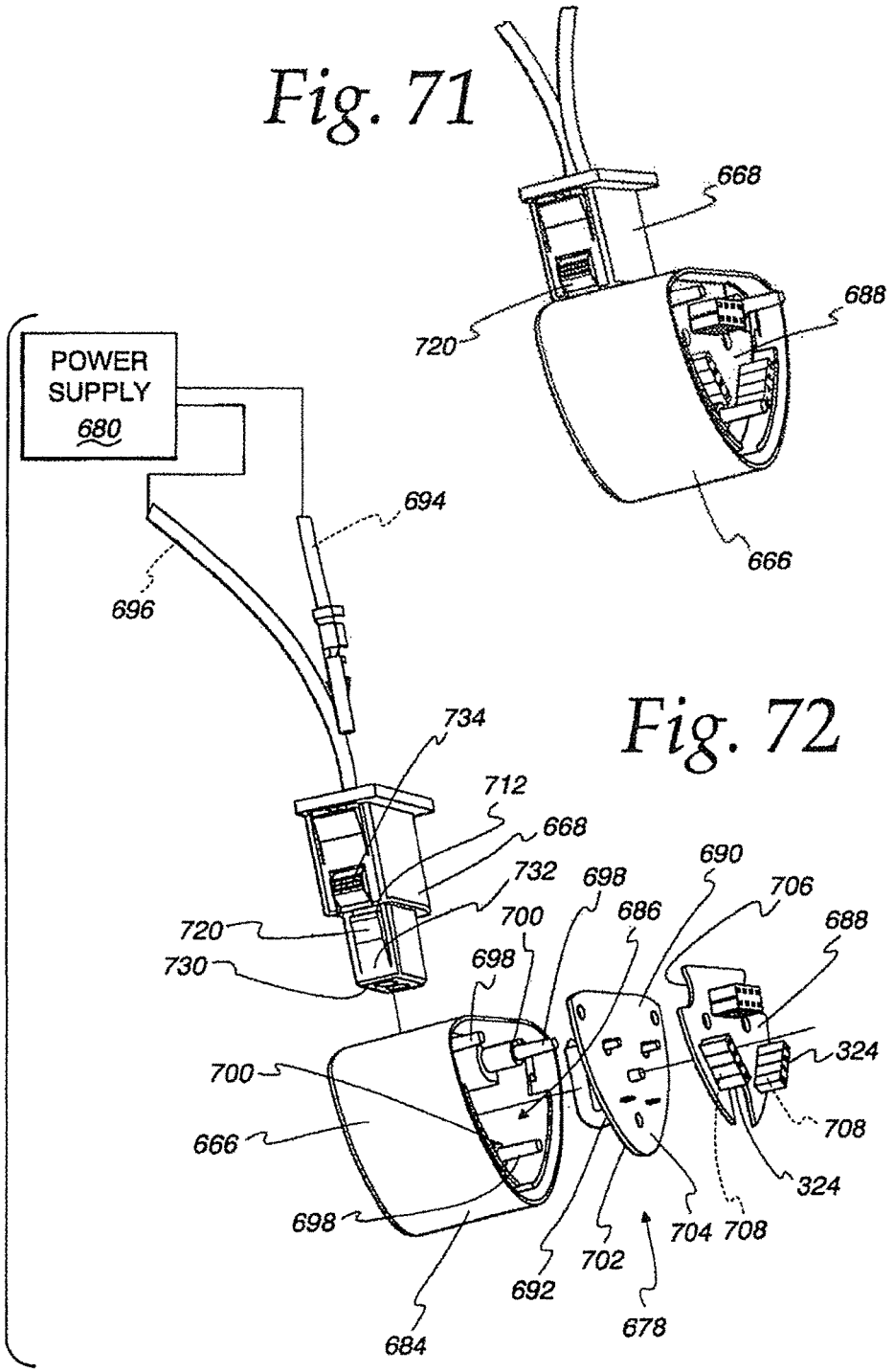
FIG. 71 is an enlarged, perspective view of an end cap assembly consisting of the connector parts in FIG. 65 and connector boards for the source of illumination.
FIG. 72 is an exploded, perspective view of the components in FIG. 71.
Figure 72A:
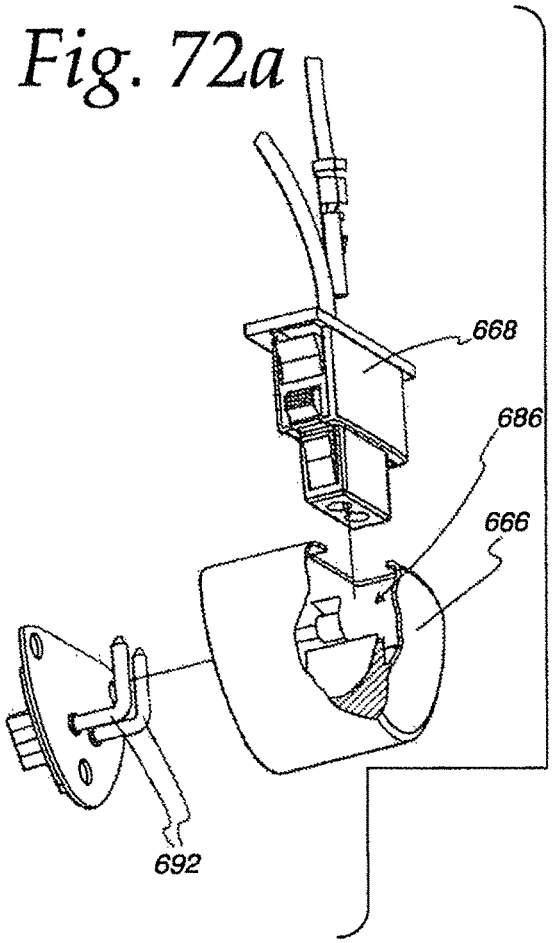
FIG. 72*a* is a view as in FIG. 72 but from a different perspective and with a part of one of the connector parts broken away.
Figure 72B:
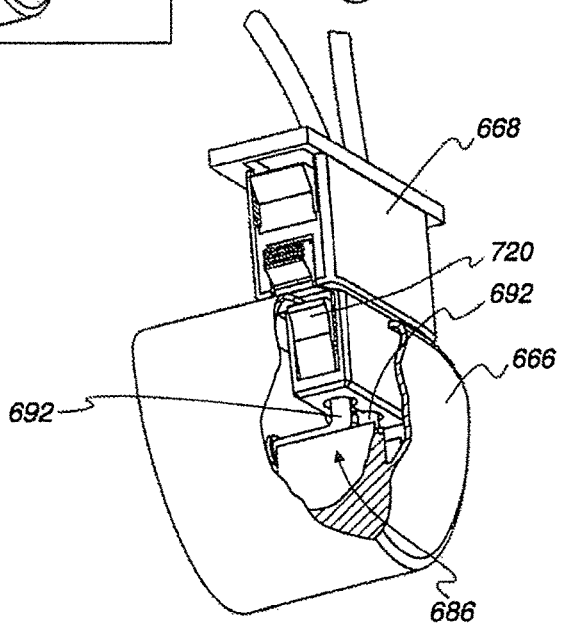
FIG. 72*b* is a view as in FIG. 72*a* with the parts assembled.
Figure 73:
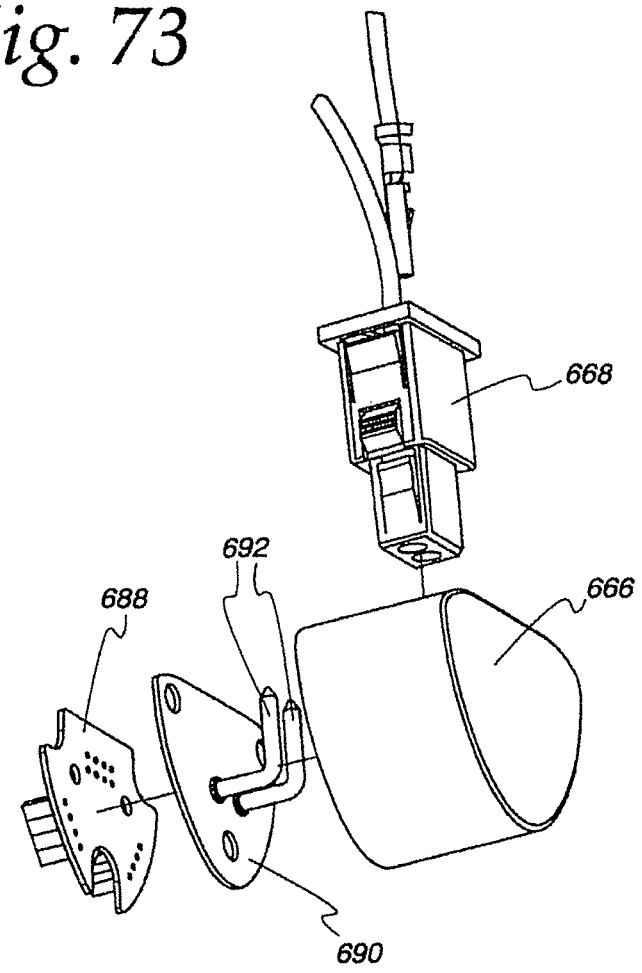
FIG. 73 is an exploded view of the components in FIG. 72 from a different perspective.

A single board 697, as shown schematically in FIG. 70*a*, may be used in place of, and to perform the combined functions of, the separate boards 688, 690. Identical, or like, connector components 692, as seen in FIG. 72, may be mechanically and electrically connected to the board 697 to provide an electrical path from the connector components 694, 696 to the board 697 on which the cap board terminals 324, or like terminals, are provided. The cap board terminals 324 cooperate with the emitter board terminals 302, as described above.

As seen in FIG. 78, the first connector part 666 has a first surface 710 with the second connector part 668 having a cooperating second surface 712. The first and second connector parts 666, 668 are configured so that the first and second surfaces 710, 712 are placed in confronting relationship to prevent separation of the first and second connector parts 666,668 with the body 656 in its operative state. This relationship is affected as an incident of the first connector part 666 moving relative to the second connector part 668, initially from a position fully separated from the second connector part 668, in a path that is transverse to the length of the body 656, into an engaged position. The generic showing of the structure in FIG. 78 is intended to encompass a wide range of different structures that can achieve the same structural objective in joining the connector parts 666, 668. It is contemplated by the generic showing that the first and second connector parts 666, 668 are configured so that the first connector part 666 moves against the second connector part 668 as the first connector part moves towards the engaged position, thereby causing a part of at least one of the first and second connector parts 666, 668 to reconfigure to allow the first and second surfaces 710, 712 to be placed in confronting relationship.

The detailed description hereinbelow will be focused on the exemplary embodiment shown in FIGS. 62-77. As noted, this embodiment is only one exemplary form of the many different forms contemplated for the various components shown schematically in FIG. 78, including the configuration of the first and second connector parts 666, 668.

Figure 74:
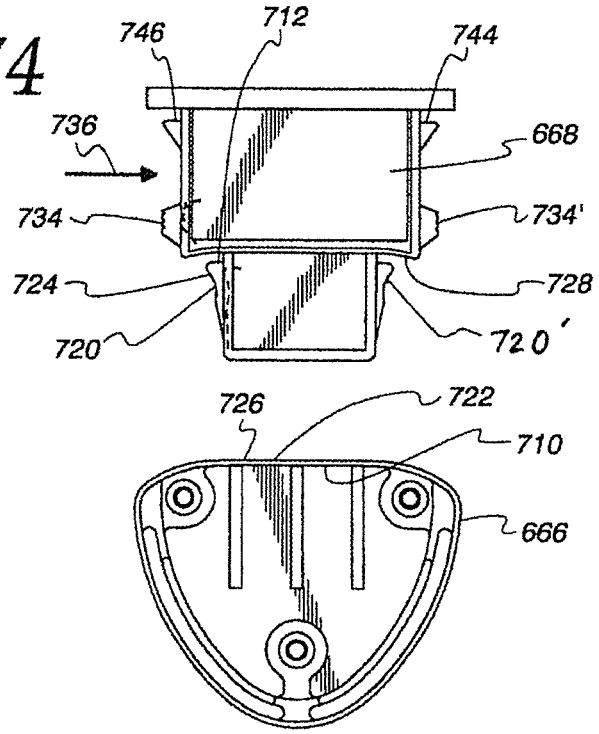
FIG. 74 is an enlarged, end view of the connector parts shown in the relationship of FIG. 63.
Figure 75:
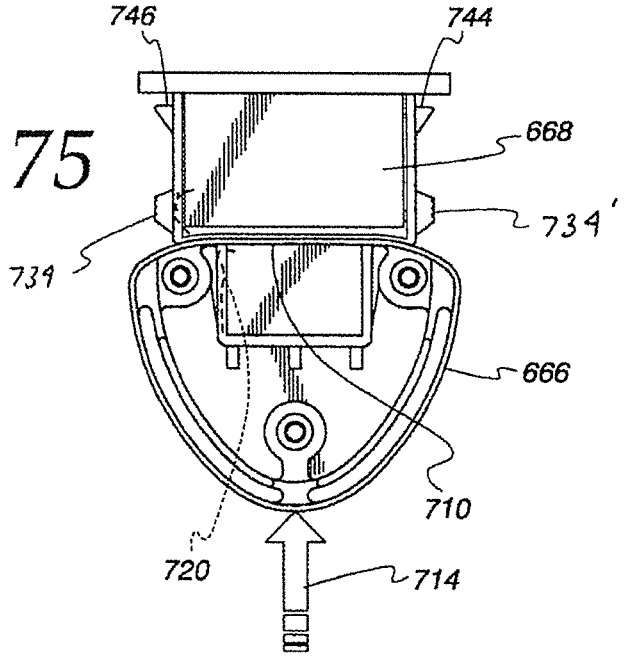
FIG. 75 is a view as in FIG. 74 with the connector parts in the relationship of FIG. 65.

In FIG. 74, the first connector part 666 is shown in a position fully separated from the second connector part 668. In FIG. 75, the first connector part 666 is shown moved relative to the second connector part 668 from the fully separated position in a substantially straight path, as indicated by the arrow 714, transverse to the length of the body 656, into the engaged position.

To make this interaction possible, the first connector part 666 has an opening 716 bounded by an edge 718. The second connector part 668 has a first bendable part 720. The second connector part 668 is configured so that the first bendable part 720 is engaged by the edge 718 of the opening 716 and progressively cammed from a holding position, as shown in solid lines in FIGS. 74 and 75, towards an assembly position, as shown in dotted lines in each of FIG. 74 and FIG. 75, as the first connector part 666 is moved up to and into the engaged position. The first bendable part 720 moves from the assembly position back towards the holding position with the first part realizing the engaged position.

In this embodiment, the first connector part 666 has a wall 722 through which the opening 716 is formed. The first surface 710 is a portion of the inner surface of this wall 722. The second surface 712 is defined by a boss 724 on the bendable part 720.

The wall 722 has a third surface 726 on its opposite surface that faces towards a fourth surface 728 on the second connector part 668. The wall 722 resides captively between the second and fourth surfaces 712, 728 with the first connector part 666 in the engaged position to maintain this snap-fit connection.

In this embodiment, the first bendable part 720 is joined to another part 730 of the first connector part 666 through a live hinge 732. The second connector part 668 has an actuator 734, in this embodiment on the first bendable part 720 remote from the hinge 732, that is engageable and can be pressed in the direction of the arrow 736 in FIG. 74 with the first connector part 666 in the engaged position, thereby to move the first bendable part 720 towards its assembly position, as shown in dotted lines in FIGS. 74 and 75, to allow the surface 712 to pass through the opening 716 so that first connector part 666 can be separated from the second connector part 668.

In the depicted embodiment, the second connector part 668 has a second bendable part 720' that is configured the same as the first bendable part 720 and cooperates with the edge 718 in the same way that the first bendable part 720 cooperates with the edge 718 in moving between corresponding holding and assembly positions. An actuator 734' is situated so that the installer can grip and squeeze the actuators 734, 734', as between two fingers, towards each other, thereby changing both bendable parts 720, 720' from their holding positions into their assembly positions.

Figure 76:
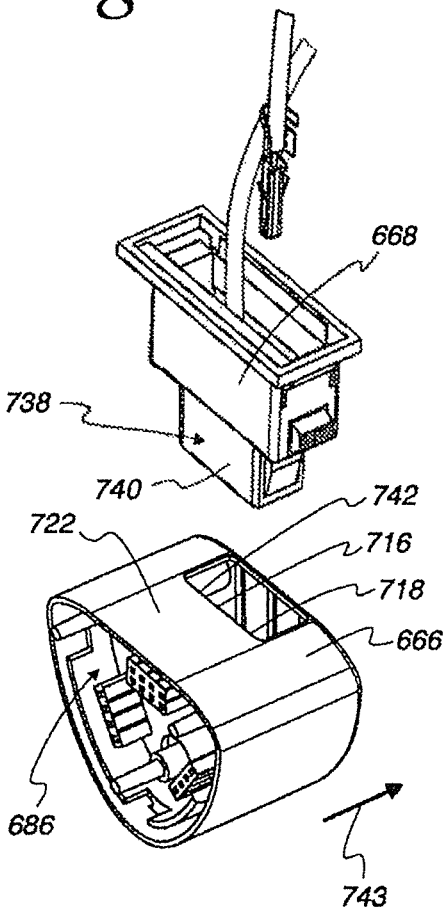
FIG. 76 is a view as in FIG. 73 from a different perspective.
Figure 77:
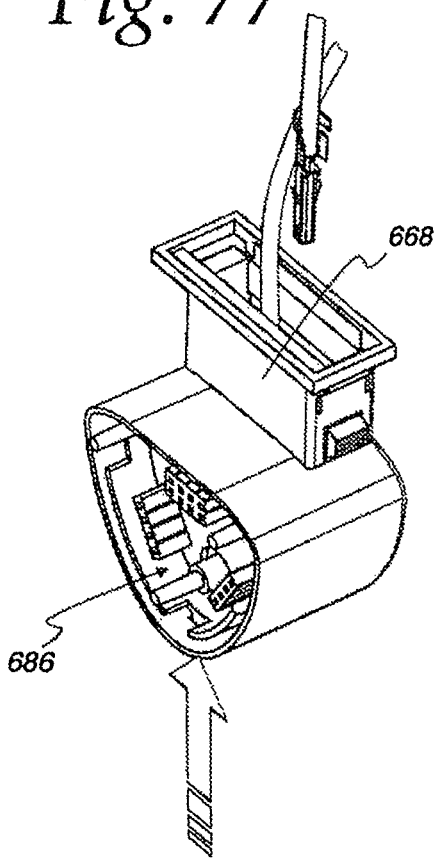
FIG. 77 is a view as in FIG. 76 with the connector parts joined as in FIG. 69.

As seen in FIG. 76, the edge 718 extends fully around the opening 716. Preferably the opening 716 and second connector part 668 are configured so that the edge 718 and a peripheral surface 738 on the second connector part, that is advanced therethrough, cooperate to consistently align the second connector part 668 with the opening 716 as the second connector part 668 is directed into the opening 718 as the first connector part 666 is changed between the fully separated position and the engaged position. Matching, non-round shapes achieve this objective.

Also, this arrangement keys the connector parts 666, 668 together as a unit so that they do not move any substantial distance along the length of the body 656. As seen in FIG. 76, a portion 740 of the peripheral surface 738 bears on a portion 742 of the edge 718 to prevent lengthwise movement of the connector part 666 in the direction of the arrow 743, as might permit separation of the first connector part 666 from the first end 658 of the body 656.

The third and fourth connector parts 672, 674, that make up the second connector 670, may be respectively structurally the same or similar as the first and second connector parts 666, 668 and interact with each other at the second end 660 of the body 656 in the same way that the first and second connector parts 666, 668 interact with each other at the first end 658 of the body 656. Accordingly, the first and third connector parts 666, 672 are held positively captively against their respective body ends 658, 660 by the second and fourth connector parts 672, 674, thereby avoiding inadvertent separation of the connector parts 666, 672 from the body ends 658, 660, respectively.

The second connector part 668 has oppositely opening slots 744, 746 that cooperate with the reflector tabs 628, 630 in the same manner that the connectors 626 (see FIG. 56) do. That is, the tabs 628, 630 are formed so that they can slide through the slots 744, 746 whereby the second connector part 668 and support/reflector 676 can be press connected starting with these parts fully separated from each other. A simple sliding movement lengthwise of the body 656 will fully seat the tabs 628, 630 that become frictionally held in the slots 744, 746. Of course other, and potentially permanent, connections are contemplated.

With the above described arrangement, the first and second connector parts 666, 668 can be mechanically snap-connected through a simple movement of the first connector part 666 from its fully separated position into its engaged position. The connector components 692, 694, 696 are also configured so that the connector components 694, 696 are press fit into electrical connection with the connector components 692 as an incident of the first connector part 666 moving from its fully separated position into its engaged position.

The third connector part 672 is part of a second end cap assembly 748 at the second end 660 of the body 656. The second end cap assembly 748 has a second cup-shaped component 750 defining a receptacle 752 that receives the second body end 660 in substantially the same manner as the first cup-shaped component 684 receives the first end 658 of the body 656. The oppositely opening cup-shaped components 684, 750 captively engage the body ends 658, 660 which reside in their respective receptacles 686, 752. The receptacles 686, 752 are deep enough that the body ends 658, 660 penetrate an adequate distance to be securely held within the receptacles 686, 752.

In this embodiment, the second end cap assembly 748 includes at least one, and in this case two, connector boards 688', 690', corresponding to the boards 688, 690, described above.

The source of illumination 662 and connector boards 688', 690' are configured to be electrically connected as an incident of the second end 660 of the body 656 and second end cap assembly 748 being moved towards each other in a direction substantially parallel to the length of the body 656 into connected relationship.

The light diffuser cover 328, previously described, is optionally used to deflect, diffuse, and/or focus light from the source of illumination 662.

With the above-described construction, the first and second connector parts 666, 668 are configured to be structurally held together, independently of the conductive connector components 692 and 694, 696 that electrically connect between the source of illumination 662 and power supply 680, to thereby maintain the body 656 in its operative state. This avoids stressing of conductive components that effect electrical connection on the lighting assembly 654 and also permits rigid and maintainable mounting of the body 656 in its operative state. This ability becomes particularly significant with long body constructions, typically up to eight feet, with an LED source of illumination. These bodies may have a significantly heavier construction than their fluorescent bulb counterparts.

With the above-described construction, the first and second connector parts 666, 668 and third and fourth connector parts 672, 674 can be simply aligned and snap-connected to each other to thereby be held together as an incident of relatively moving the connector parts towards and against each other. Supplemental fasteners (not shown) could be used for further securing these connections, but ideally no supplemental fasteners are required.

The above-described construction lends itself to pre-assembling the first and third connector parts 666, 672 to their respective body end 658, 660 by a simple press fit step. The resulting unit U (FIG. 67) can then be situated to align the first and third connector parts 666, 672 with the second and fourth connector parts 668, 674, whereupon a translational movement of the unit snap-connects the first and second connector parts 666, 668 and third and fourth connector parts 672, 674. The snap connection of the connector parts 666, 668 and 672, 674 also effects electrical connection between conductive connector components associated therewith.

The use of the boards 688, 688', 690, 690' and press connection of the end cap assemblies 678, 748 potentially avoids certain, and in a preferred form all, wire connecting operations, that may be labor intensive, difficult to perform, and often lead to operational failures. That is, as seen at one exemplary body end 658, the electrical connection of the emitter boards 293 can be effected through cooperation between the terminals 302, 324 and connector board 688 up to the connector components 692 without the use of any wire that would have to be soldered or otherwise connected at its ends.

Further, the body ends 658, 660 can project adequately into their respective receptacles 686, 752 that there is little risk of separation of the body 656 from its operative state.

Figure 56:
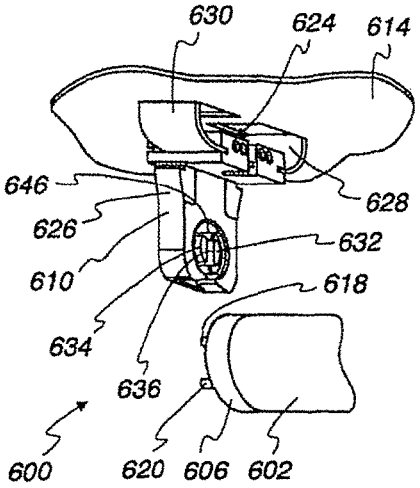
Fig. 56 Prior Art
FIG. 56 is a view as in FIG. 55 with the body aligned for installation.
Figure 57:
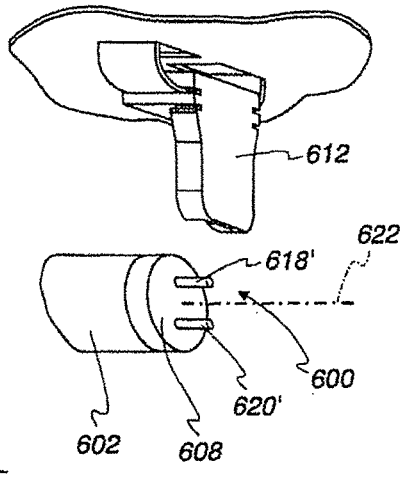
Fig. 57 Prior Art
FIG. 57 is a view as in FIG. 56 and showing cooperating connectors at the opposite end of the body and on the support.

The second and fourth connector parts 668, 674 can be configured to replace conventional fluorescent bi-pin bulb connectors, as shown at 610 and 612 in FIGS. 56 and 57. The conventional connectors 610, 612 lend themselves to being readily removed and replaced by the connector parts 668, 674 potentially without any, or any significant, modification to the support 614. Thus, retrofitting of LED-based technology is facilitated.

Figure 67:
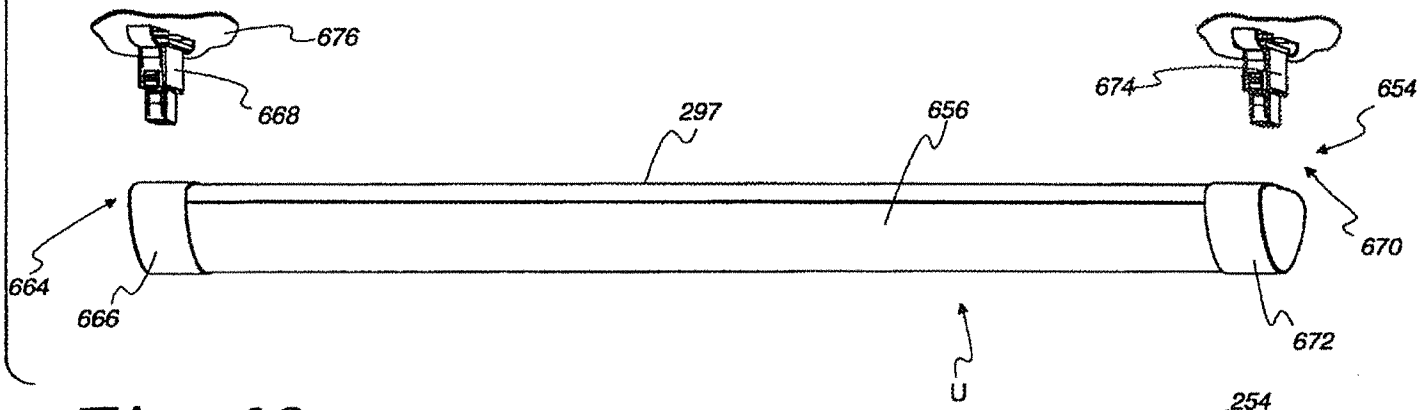
FIG. 67 corresponds to FIGS. 63 and 64, reduced in size, and taken together to show the entire body.
Figure 68:
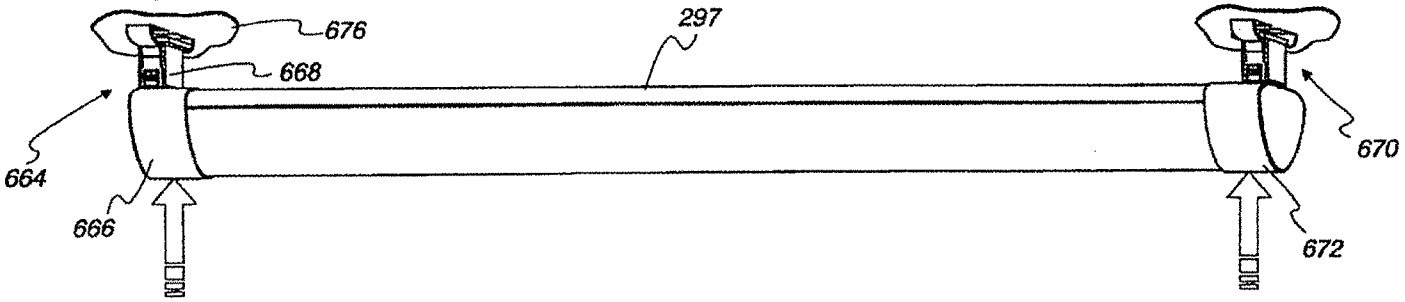
FIG. 68 is a view as in FIG. 67 and corresponds to FIGS. 65 and 66, taken together, to show the entire body.
Figure 69:
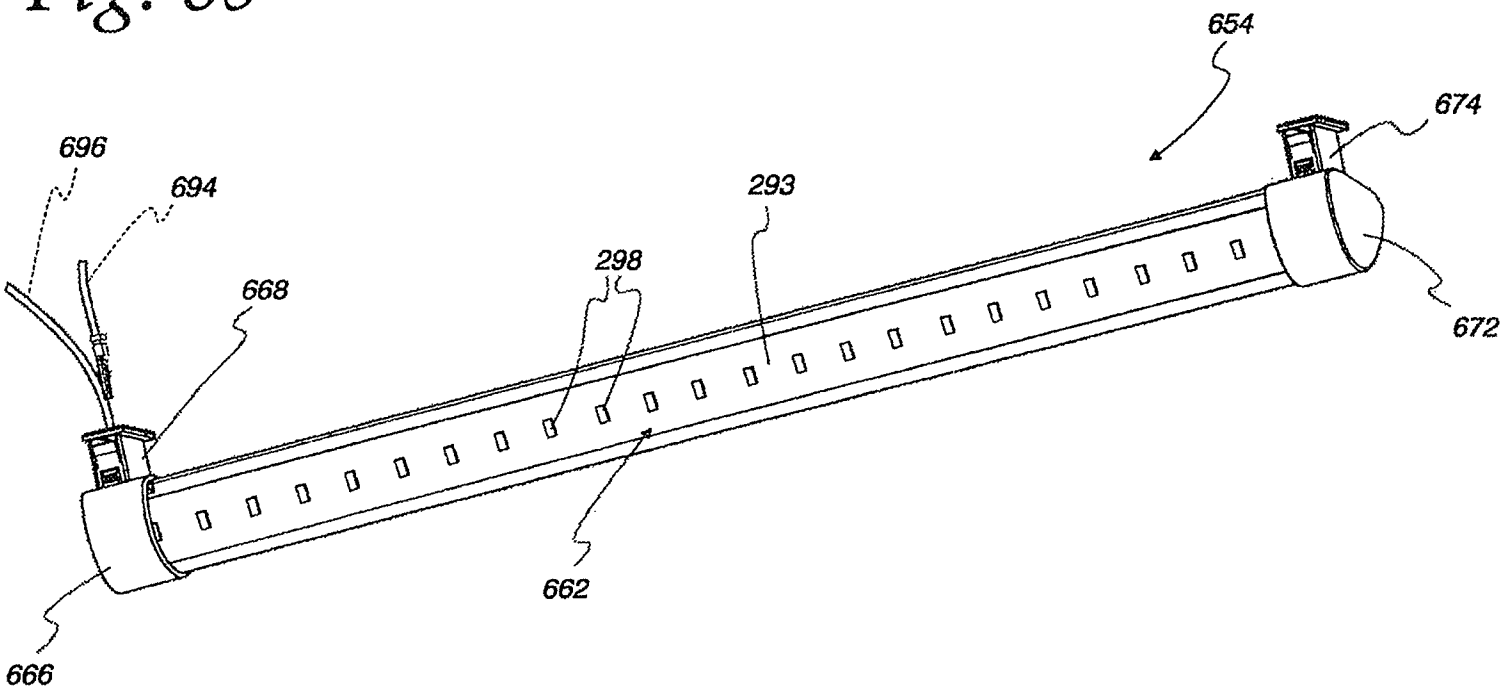
FIG. 69 is a view as in FIG. 68 with a diffusion cover removed to expose the source of illumination.

Once the connector parts 668. 674 are in place, either through initial assembly or as replacements for the connectors 610, 612, the body 656 and pre-joined connector parts 666, 672, that cooperatively define the unit U in FIG. 67, can be readily assembled through a press fit operation. The interacting portions of the connector parts 666, 668; 672, 674 are robust and are guided into connected relationship without requiring the precise preparatory alignment and subsequent movement of conventional bi-pin structures. In the event the body 656 and/or one of the connector parts 666, 672 needs to be repaired or replaced, the connector part 666 can be released by squeezing the actuators 734, 734' together, whereupon the connector part 666 can be drawn away from the connector part 668 at one end of the body 656. The connector parts 672, 674 are released in like fashion at the opposite end of the body 656 to allow isolation of the unit U. Once that occurs, the unit U can be replaced in its entirety with a similar unit (not shown). Alternatively, one or both of the connector parts 666, 672 can be pulled lengthwise of the body 656 to effect separation to allow replacement, or access for repair, to any of the unit components 656, 666, 672. The absence of solder or other wire connections in preferred embodiments facilitates fast and simple disassembly and reassembly of the unit for this purpose. Thus, assembly of the unit U to the support 614, and separation of the unit U from the support 614 can be efficiently carried out. Through the assembly process, the body 656 becomes firmly mounted with the parts preferably configured so that there is an audible and/or tactile indication that the parts are fully engaged, which condition is not reliably determinable with the conventional bi-pin connection.

The above design, while described with a body 656 having a generally delta- or triangularly-shaped cross section, taken transversely to the length of the body 656, can be adapted to any body shape by conforming the end cap receptacle to be complementary to the peripheral body shape. For example, embodiments described above have different cross-sectional shapes with different numbers of sides (see, for example, the four-sided luminary in FIG. 5 and the five-sided luminary in FIG. 6). The connecting structure described in FIGS. 62-77 is adaptable to each of the earlier embodiments, and other shapes, by changing all of the connector parts to adapt to the different cross-sectional shapes for the corresponding bodies.

Figure 79:
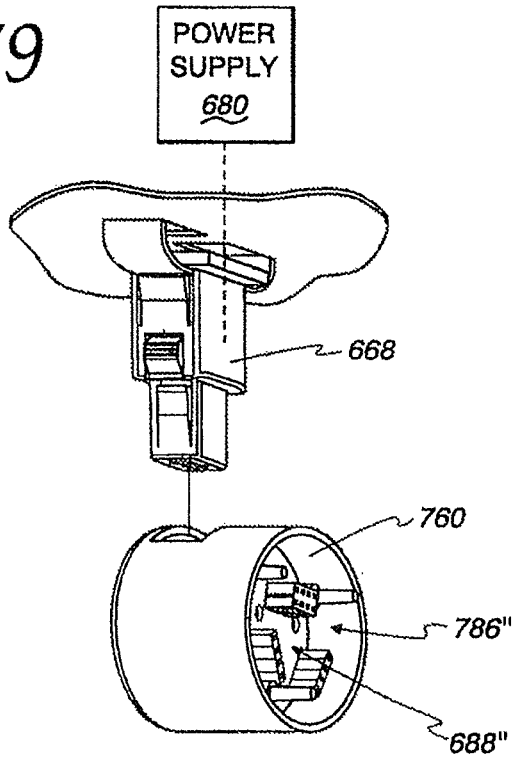
FIG. 79 is a view as in FIG. 72 and showing a modified form of one of the connector parts to cooperate with a cylindrical body.
Figure 80:
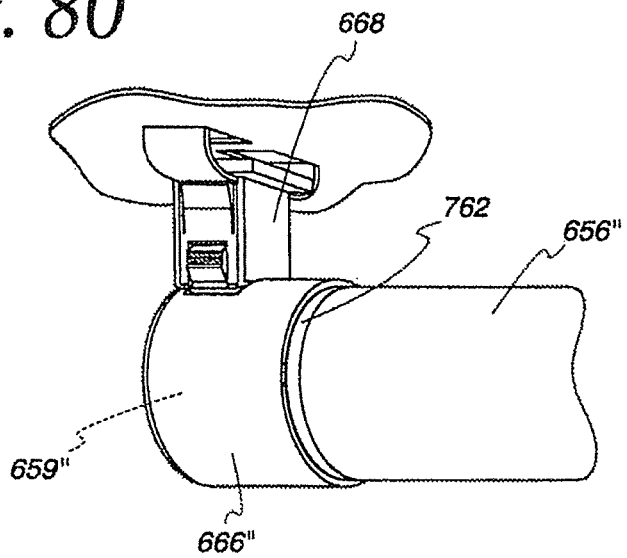
FIG. 80 is a view as in FIG. 79 with the connector parts snap-fit together.

Still further, the connecting structures can be adapted to connector parts that are used on conventional round/cylindrical luminary shapes, typical of conventional fluorescent bulbs and many LED tubular bulbs. As seen in FIGS. 79 and 80, a connector part 666", corresponding to the connector part 666, can be made with a receptacle 686", corresponding to the receptacle 686, that is bounded by a cylindrical surface 760 that is complementary in shape and diameter to an outer surface 762 of a cylindrical luminary body 656". The body 656" can be translated parallel to its length to seat the body end 659" in the receptacle 686" and establish an electrical connection, through an end connector board 688", which in turn may be electrically connected through the connector part 668 to the power supply 680. The end connector board 688" may be substantially the same as the end connector board 688, differing only in shape to nest conformingly in the receptacle 686". Indicia, and/or keying structure may be provided on the connector part 666" and body 656" to allow an assembler to properly angularly align these parts for connection.

Figure 81:
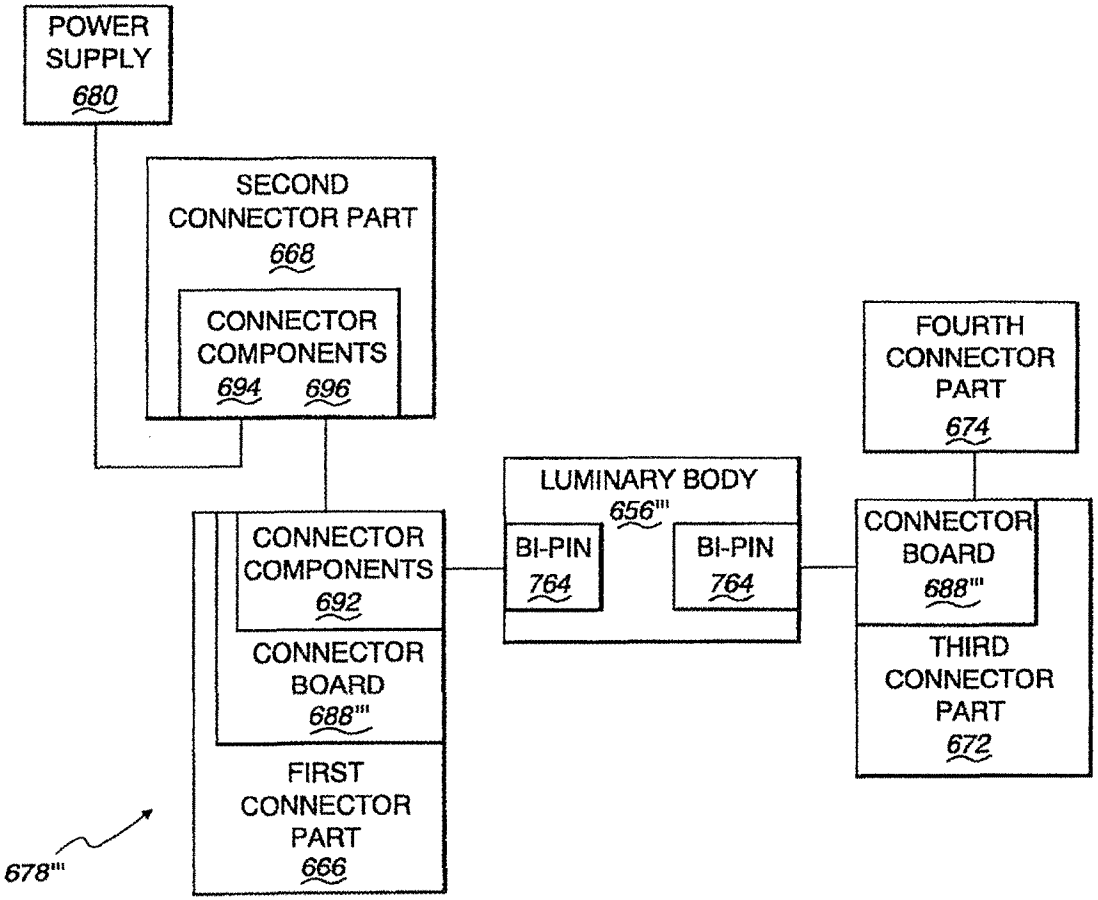
FIG. 81 is a schematic representation of a modified form of tubular lighting assembly, according to the invention.

As depicted generally in FIG. 81, the first and third connector parts 666,672 can be alternatively configured to cooperate with a conventional bi-pin arrangement 764 at the ends of a conventional fluorescent-type luminary, a luminary utilizing LEDs, or another design, with the body for such a generic luminary identified at 656'". The bi-pins 764 cooperate with connector boards 688'", corresponding to the connector boards 688, but modified to electrically connect to the bi-pins 764, preferably through a press fit step. The connector board 688'" and first connector part 666 make up an end cap assembly 678'" that cooperates with the second connector part 668 to: a) electrically connect to the power supply 680 through the connector components 692; 694, 696, respectively on the first and second connector parts 666, 668; and b) mechanically connect, as described above for these same connector parts 666, 668. The connector board 688" at the opposite body end connects to the bi-pin 764 in similar fashion, with the third and fourth connector parts 672, 674 mechanically connected as described above for these connector parts 672, 674. The details of the circuitry on the connector boards 688'" to accommodate the bi-pin design would be readily devised by one skilled in the art in view of the disclosure herein.

In this manner, the disadvantages described above associated with conventional bi-pin bulbs and connectors may be overcome by retrofitting such bulbs with end connectors of the type disclosed in accordance with the invention, thereby permitting such bulbs to be installed on and mechanically and electrically connected to connectors of the type described as the second and fourth connector parts herein.

As explained above, the driver 300, including the driver board 380, may be eliminated. To depict this form of the invention, the driver 300 is shown in dotted lines in FIG. 70. Without the driver 300, the need for the terminal/surface mount driver connector 375 on the connector board 688 in FIG. 70 is obviated, as is the corresponding driver connector (not shown in FIG. 70) at the opposite end of the body 656 on the connector board 688'. Although shown for illustrative purposes in FIG. 70 near the second end 660 of body 656, the driver 300 may be mounted at any location along the length of the heat sink 297. When a single driver is utilized, it is preferably mounted near the first end 658 for connection to the surface mount connectors 375 of the end cap PCB connector 688.

Another variation from the embodiments described above relates to how the LED panels/emitter boards 293 are designed to be electrically connected to the power supply 680. Referring again to FIG. 70, which is representative of embodiments hereinabove described, the circuit for each of the emitter panels 293 is defined through the connector board 688', thereby necessitating electrical connection of each emitter panel 293, that is carried out as the third connector 672 with the associated board 688' is press fit at the second end 660 of the body 656.

Figure 82:
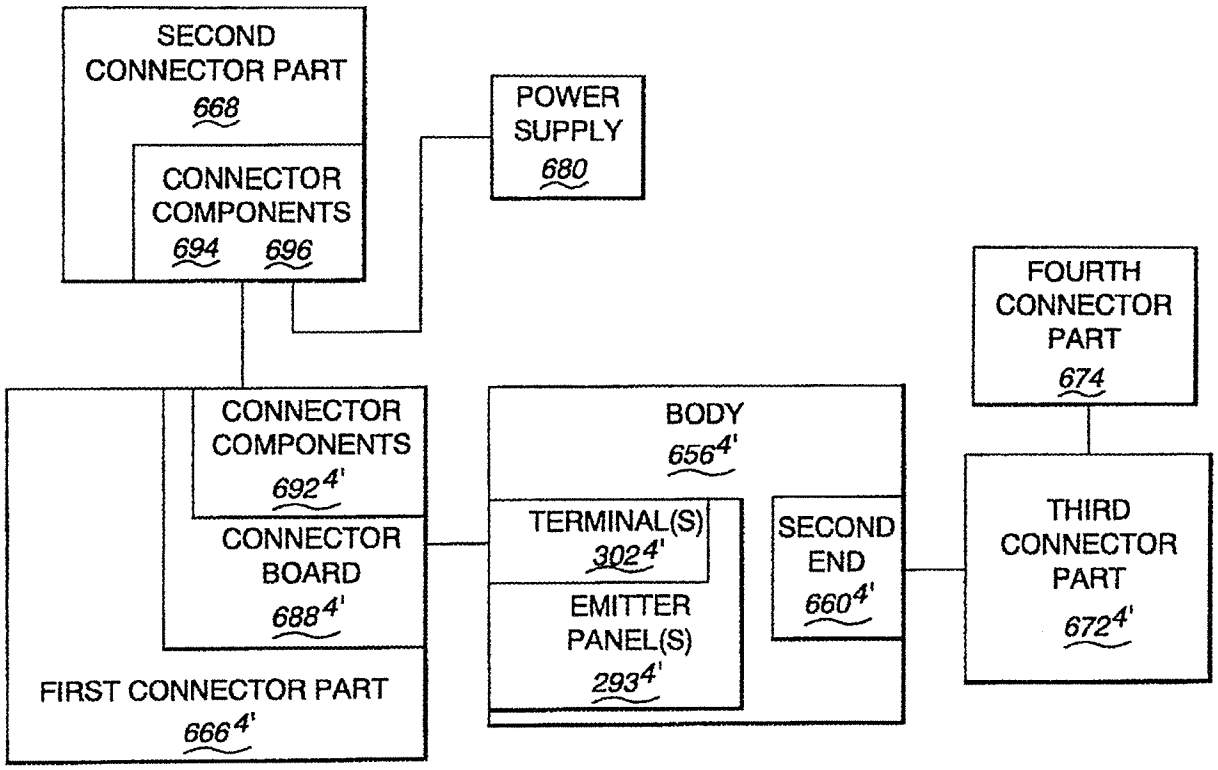
FIG. 82 is a schematic representation of a further modified form of tubular lighting assembly, according to the invention.

In an alternative design, as shown schematically in FIG. 82, wherein modified parts corresponding to those described above are identified with the same number and a "4'" designation, the emitter panels 293$^{4'}$ are configured so that no electrical components are required within, or on, the third connector part 672$^{4'}$ to power the emitter panels 293$^{4'}$ from the supply 680. Instead, the electrical path between the connector components 694, 696, on the second connector part 668 connecting to the power supply 680, is completed adjacent to the second body end 660$^{4'}$ within the lengthwise extent of each of the body 656$^{4'}$ and the emitter panels 293$^{4'}$. This eliminates the need for the terminals 302 on the emitter panels 293$^{4'}$ at the second body end 660$^{4'}$ and the need for any electrical connecting components on either the third connector part 672$^{4'}$ or fourth connector part 674 to be electrically joined as the third connector part 672$^{4'}$ is press fit to the second body end 660$^{4'}$ and the fourth connector part 674. This modification potentially simplifies individual part design, reduces associated cost, and reduces the likelihood of an electrical failure caused during manufacture or assembly, or that might occur during use.

The body 656$^{4'}$ is otherwise mechanically connected to the first connector part 666$^{4'}$, and electrically connected through the first connector part 666$^{4'}$ to the second connector part 668, as with the earlier-described embodiments. For example, the electrical connection of the emitter panels 293$^{4'}$ may be effected through a connector board 688$^{4'}$ having associated connector components 692$^{4'}$. Terminals 302$^{4'}$ on the emitter panels 293$^{4'}$ are used to effect this connection.

Figure 82A:
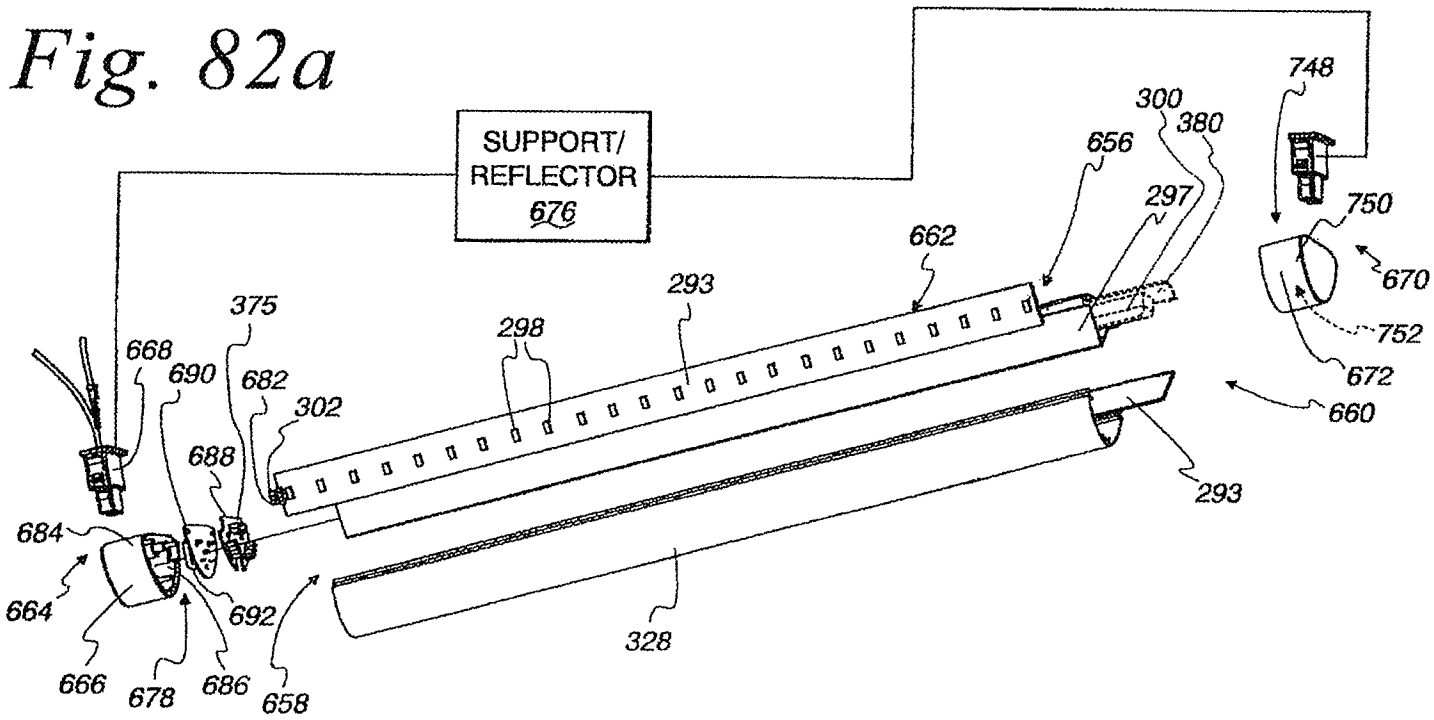
FIG. 82*a* is an exploded, perspective view corresponding generally to the tubular lighting assembly of FIGS. 69 and 70, but with the connector components and connector board eliminated at one end, as shown in the schematic representation of FIG. 82, according to the invention.

An example of such an embodiment corresponding to the embodiment of FIG. 70 but with the emitter panel terminals and electrical components at the second body end 660 eliminated, is illustrated in FIG. 82*a*. In such an embodiment, the optional internal driver, if included, would typically be mounted near the first end 658 for connection to the surface mount connectors 375 of the end cap PCB connector 688.

Figure 83:
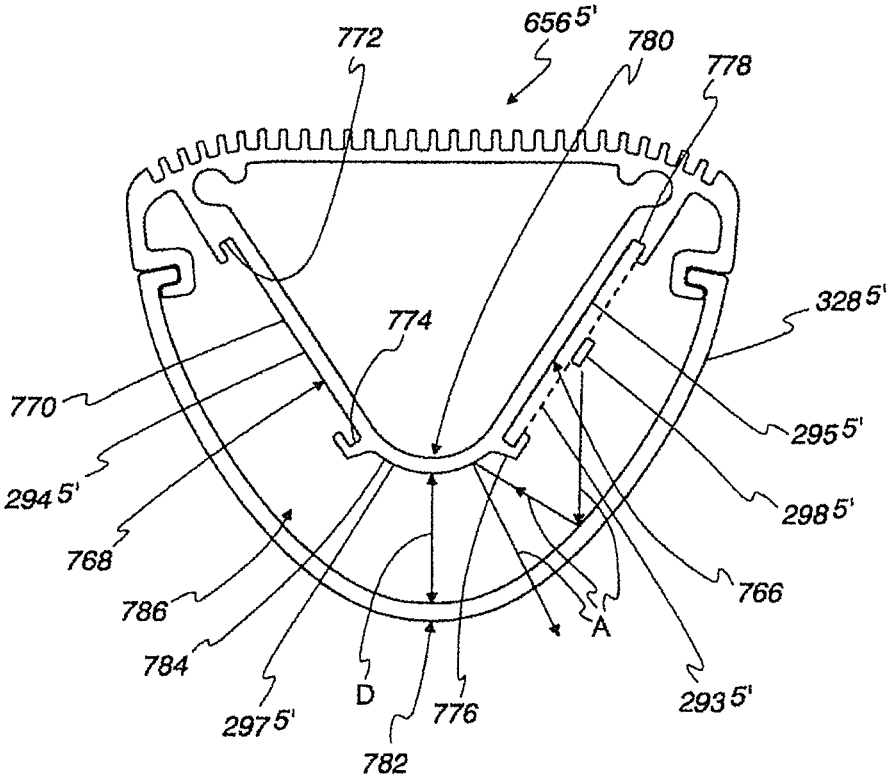
FIG. 83 is an end view of part of another modified form of body in a tubular lighting assembly, according to the invention.

Additional potential modifications are shown in FIG. 83, in which modified parts corresponding to those earlier described are identified with the same numbers together with a "5'" designation.

In FIG. 83 a luminary body 656$^{5'}$ is depicted having a heat sink 297$^{5'}$ with a delta- or triangularly-shaped cross-section. The heat sink 297$^{5'}$ has two sides 294$^{5'}$, 295$^{5'}$ at which emitter panels 293$^{5'}$ (one shown) are placed, each with LED emitters 298$^{5'}$ at intervals along the length of the heat sink 297$^{5'}$.

The heat sink 297$^{5'}$ may be extrusion-formed to define elongate receptacles 766, 768 of like construction. Exemplary receptacle 768 is defined by a flat surface 770 with widthwise ends that blend into spaced, "U" shapes that define slots 772, 774 that open towards each other. The emitter panels 293$^{5'}$ are configured to slide lengthwise, one each, into the receptacles 766, 768. The emitter panels 293$^{5'}$ (one shown in the receptacle 766) are dimensioned so that the opposite emitter panel edges 776, 778, spaced widthwise of each other, seat simultaneously in the slots 772, 774. The relative dimensions of the emitter panels 293$^{5'}$ and receptacles 766, 768 are selected so that the emitter panels 293$^{5'}$ can be assembled to the heat sink without requiring imparting of potentially damaging forces thereto. At the same time, the fit is preferably sufficiently snug so that the emitter panels 293$^{5'}$ do not shift so easily that they are prone to becoming misaligned lengthwise of the heat sink 297$^{5'}$ as the body 656$^{5'}$ is normally handled, either during shipping or assembly.

This design may simplify the assembly of the components on the body 656$^{5'}$ by permitting the union of the heat sink 297$^{5'}$ and emitter panels 293$^{5'}$ without the need for any separate fasteners or adhesive or the use of ribs, tabs or other structures extending from the inner surface of the diffuser cover to prevent the emitter panels from separating from the heat sink.

The relationship of the assembled emitter panels 293$^{5'}$ to the heat sink 297$^{5'}$ and diffuser cover 328$^{5'}$, as depicted in FIG. 83, may also enhance light intensity and distribution compared to earlier-described embodiments. The diffuser cover 354 in the embodiment in FIG. 17 is configured so that the base of the "U" shape, as seen in cross section, is adjacent to, or at, where the emitter panels 336, 337, 338 on angled sides of the heat sink 334 meet. On the other hand, as seen in FIG. 83, the base region of the heat sink 297$^{5'}$ at 780 is spaced a substantial distance D from a corresponding base region at 782 for the diffuser cover 328$^{5'}$.

Regardless of the light transmissive properties of the material defining the diffuser cover 328$^{5'}$, a certain amount of light from the LED emitters 298$^{5'}$ reflects back towards the emitter panels and will impact the emitter panels and the bottom surface 784 of the heat sink 297$^{5'}$ to be re-directed thereby within the space 786 outwardly towards the diffuser cover 328$^{5'}$. This reflected light, following the exemplary path indicated by the arrows A. The additional spacing between the lower regions of the heat sink 297$^{5'}$ and diffuser cover 328$^{5'}$, and removing the apex of the otherwise triangular heat sink cross section, as depicted, facilitates a more even distribution of the light reflected by the diffuser cover 328$^{5'}$ and intensifies the overall light pattern and may also enhance the uniformity of the light distribution pattern. Also, the receptacles 768, 766 described above secure the emitter panels 293$^{5'}$ without the need for additional structure such as the elongated rib shown at the base region of the diffuser cover 354 of FIG. 17. As such a rib may interfere with light transmission through the diffuser cover, eliminating the rib from the diffuser cover may further aid in providing a more even light distribution pattern emanating from the lighting assembly.

Figure 84:
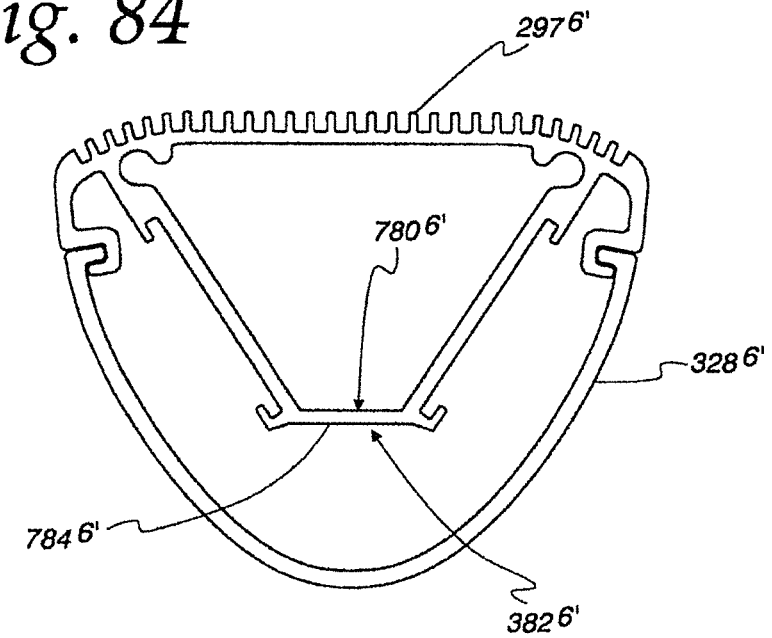
FIG. 84 is a view as in FIG. 83 of a further modified form of body, according to the invention.
Figure 85:
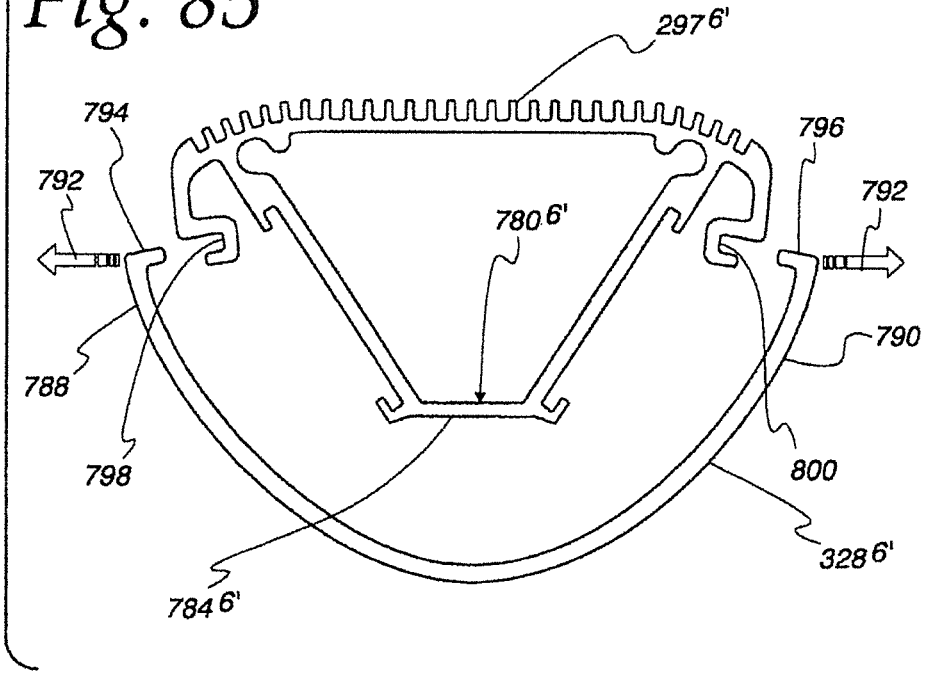
FIG. 85 is a view as in FIG. 84 with a diffuser cover situated in a pre-assembly position relative to a heat sink.

In FIGS. 84 and 85, a further modified form of heat sink 297$^{6'}$ is shown that is similar to the heat sink 297$^{5'}$ of FIG. 83, with the primary difference being that the base region 780$^{6'}$ is substantially flat, as is the surface 784$^{6'}$ at the bottom thereof. This design may also effectively increase light intensity and uniformity due to the re-direction of light that reflects from the diffuser cover 328$^{6'}$.

In both embodiments shown in FIGS. 83-85, the diffuser cover 328$^{5'}$, 328$^{6'}$ and heat sinks 297$^{5'}$, 297$^{6'}$ are configured to be connected in the same manner. As seen for exemplary diffuser cover 328$^{6'}$, the upper region of spaced legs 788, 790, that form part of a cross-sectional "U" shape for the diffuser cover 328$^{6'}$, can be flexed away from each other, as indicated by the arrows 792, thereby allowing rails 794, 796 to align vertically with complementary heat sink slots 798, 800, respectively. By then releasing the legs 788, 790, the residual forces, generated by the initial deformation, urge the legs 788, 790 towards their initial shape, whereupon the rails 794, 796 are urged into their respective slots 798, 800 to secure the diffuser cover 328$^{6'}$.

Alternatively, the undeformed diffuser cover 328$^{6'}$ can be aligned under the heat sink 297$^{6'}$ and pressed upwardly. As this occurs, the legs 788, 790, through a camming interaction between the rails 794, 796 and heat sink 297$^{6'}$, are urged away from each other. Once the rails 794, 796 vertically align with the slots 798, 800, the legs 788, 790 spring back towards, or into, their undeformed state, seating the rails 794, 796 in the slots 798, 800.

It may be desirable to maintain a certain level of the restoring forces in the legs 788, 790 once the diffuser cover 328$^{6'}$ is assembled so that the diffuser cover 328$^{6'}$ embraces the heat sink 297$^{6'}$ and thus maintains its assembled position.

Alternatively, each of the diffuser covers 328$^{5'}$, 328$^{6'}$ may be slid into its assembled state by aligning the ends of the rails 788, 790 and slots 798, 800, as seen in the embodiment in FIGS. 84 and 85, and thereafter effecting relative lengthwise translation of the diffuser cover 328$^{6'}$ until it is properly aligned.

Figure 86:
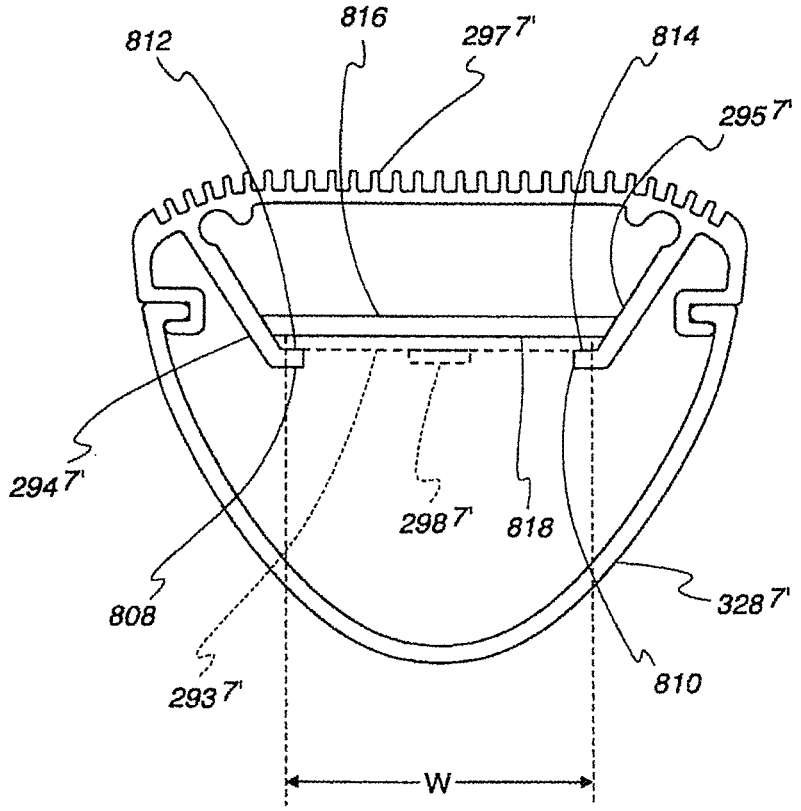
FIG. 86 is a view as in FIG. 84 of a still further modified form of body, according to the invention.

In FIG. 86, another modified form of heat sink is shown at 297$^{7'}$. The heat sink 297$^{7'}$ has a shorter vertical profile in relationship to the vertical extent of the depicted diffuser cover 328$^{7'}$, which may be the same as the diffuser cover 328$^{6'}$. This design is adapted to applications in which a single emitter panel 293$^{7'}$ (or series of emitter panels placed end to end) is used. The increased distance and centralized location of the LEDs relative to the diffuser cover effectively increases the area that light transmitted from the emitter board to the diffuser cover and distributed by the diffuser cover. This tends to promote a more even form of light emanating from the lighting assembly and allowing for a glow affect. Such a design is also ideal for areas that require Cove type lighting and other applications in which the LED emitters are required to be hidden from view.

The depending heat sink sides 294$^{7'}$, 295$^{7'}$ terminate at offset ends 808, 810, that project towards each other to define ledge portions 812, 814, respectively, that cooperatively support an emitter panel 293$^{7'}$ with LED emitters 298$^{7'}$. A horizontal wall 816 spans between the sides 294$^{7'}$, 295$^{7'}$ and bounds in conjunction with the offset ends 808, 810, a receptacle 818 into which the emitter panel 293$^{7'}$ can be directed. The emitter panel 293$^{7'}$ can be aligned at one end of the receptacle 818 and translated into a coextensive lengthwise relationship with the heat sink 297.

This design may accommodate emitter panels 293$^{7'}$ with a greater width W than is permitted within the same peripheral geometry of the embodiments depicted in FIGS. 83-85, without altering their operating characteristics or performance. Embodiments of this type are particularly well adapted for emitter panels of AC powered LEDs because the greater width is available for mounting additional electronic components, such as rectifiers and filters, associated with AC LEDs. Regardless of the type of emitter panel used, the placement of the emitter panel 293$^{7'}$ as shown in FIG. 86 makes possible a wide dispersion pattern emanating from a location a substantial distance above the bottom of the diffuser cover 328$^{7'}$. Alternatively, the vertical profile of the diffuser cover 328$^{7'}$ can be reduced from what is shown in FIG. 86. Of course this embodiment, as well as all of the embodiments herein, are not limited to use of either AC- or DC-powered emitter panels.

As mentioned above, modern building codes and ordinances require that each public facility have a stand-alone emergency battery backup lighting system. This is to ensure the safety of the occupant of any said space that may be impacted by catastrophic power failure. Most buildings run the emergency lighting (EM) circuit from a designated EM lighting and or power panel. The circuits that are utilized from that panel cannot be interrupted and or shared with common circuits and must run in a dedicated conduit system and routed to only the intended EM light for the space that it is supporting. This can involve significant cost to install dedicated battery backup lights, especially in a preexisting building. The EM circuit must be customized to each space to insure that EM lights are located by all exits and in rooms with no means of outside ambient light.

Figure 87:
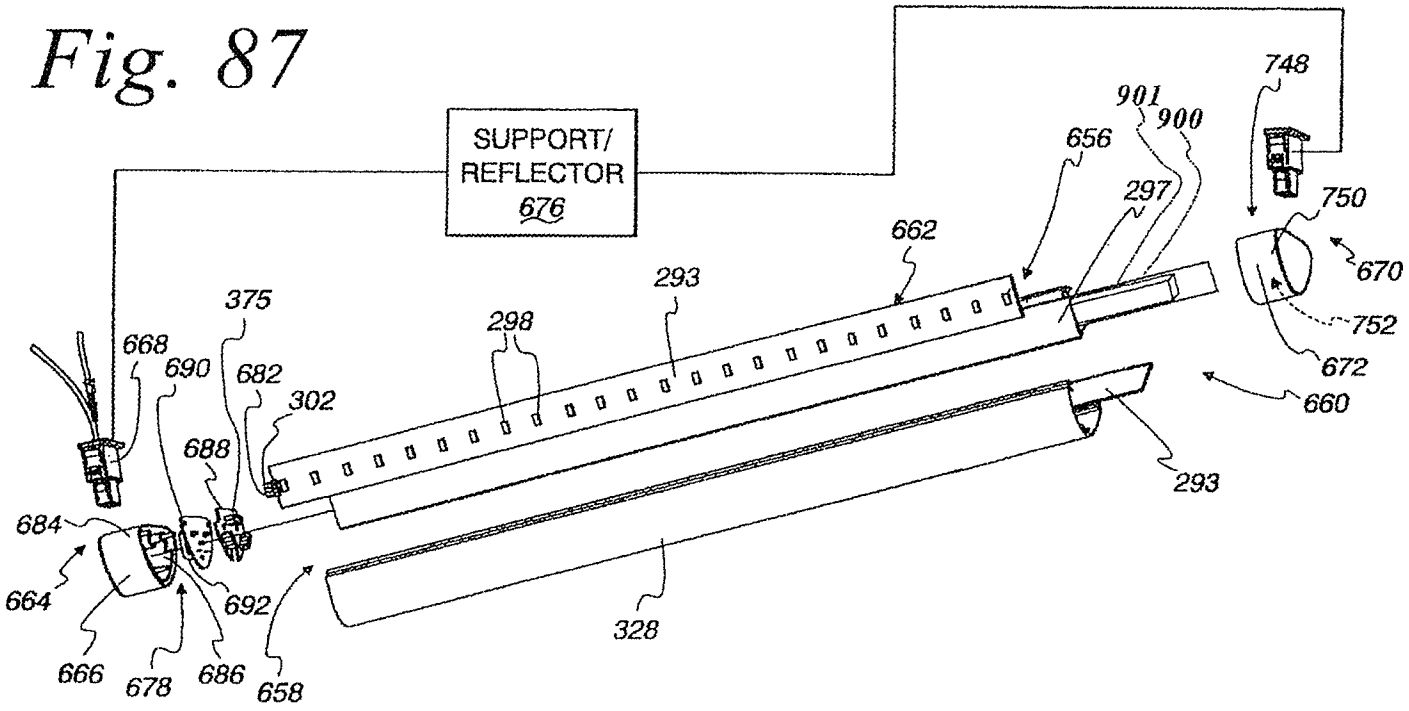
FIG. 87 is an exploded, perspective view of a modified form of the tubular lighting assembly with an uninterruptible power supply positioned within the heat sink, according to the invention.

As a way to overcome these and other problems associated with conventional EM lighting systems, the multi-sided LED light bar of the invention may also be provided in the form of a self-contained LED luminary with its own internal stand-alone UPS battery backup system. FIG. 87 illustrates an example of such an embodiment. The body 656 has the basic components of the illuminating assembly/luminary shown in FIG. 82*a* and described hereinabove. Generally, this construction consists of the three-sided delta, or triangularly-shaped, metal heat sink 297 with two LED emitter panels 293 positioned in a generally "V"-shape on the heat sink 297. Each of the LED emitter boards/panels 293 has a plurality of LED emitters 298 spaced at generally uniform intervals along the length thereof between the ends 658, 660 of the body 656. Each of the LED emitter panels 293 has terminals 302 in the form of conductive components 682 projecting in a lengthwise direction from an end of the emitter panels 293.

As described above, the first connector 664 is provided at the first end 658 of the body 656, with the second connector 670 provided at the second end 660 of the body 656. The first connector 664 consists of the first connector part 666, that is part of the first end cap assembly 678, and the second connector part 668. The first end cap assembly 678 consists of a first, cup-shaped component 684 defining a first receptacle 686 opening towards the body 656 and into which the first end 658 of the body extends. The receptacle 686 receives an end connector board 688 which overlies a separate board 690 having L-shaped electrical connector components 692 thereon that cooperate with connector components 694, 696 within wires that extend into the second connector part 668 to establish electrical connection between the boards 688, 690 and the power supply 680. The power supply 680 powers the lighting assembly during normal operations.

In this form, the lighting assembly of the invention further includes UPS battery circuit 900 mounted on an internal PCP 901 as shown within the hollow region defined by multi-sided heat sink 297. As discussed in connection with other embodiments, an internal driver (not shown) may also be mounted internal to the heat sink 297 for converting AC power to DC and directing it the LED emitters 298 of the emitter boards 293. The UPS battery backup circuit is operatively positioned and connected to the driver and includes a charging circuit which provides a charging current to the one or more batteries thereof when power source 680 is in normal operation. In the event that power from power source 680 is interrupted, a control sub-circuit of the UPS battery backup circuit switches the load to the battery back for powering the LEDs 298 of the lighting assembly as emergency lighting. In other embodiments, the circuits may be designed such that the lighting assembly is a dedicated emergency light which is dark during periods of normal power supply but receiving a charging current, and which illuminates under power of the UPS battery backup circuit 900 when the normal power supply is lost.

The available space within heat sink 297 will permit mounting a sufficient number of backup batteries to power the LEDs and provide the required illumination for durations required to meet applicable emergency lighting codes. Currently available UPS batteries sources should provide power for 15 minutes and up to at least 2 hours and potentially longer depending on the number and type of batteries mounted within the hollow void of heat sink 297. It will be understood that this approach may be implemented in numerous other forms of the multi-sided heat sink of the invention, including, for example, four-sided and five-side heat sinks other particular forms.

By providing a tubular lighting assembly with a concealed UPS that can sustain its own source of power in the event of a power outage, this aspect of the invention provides numerous additional benefits. For example, an entire pathway of lighting can be generating to insure the most direct route out of a powerless building simply by installing the UPS emergency lights in conventional ballasts at strategically chosen locations. Because the UPS backup circuit is implemented internal to the lighting assembly, the exiting mounting fixture does not require any additional wiring or foreign components to be installed into the fixture. This aspect of the invention thus allows for buildings to be equipped with emergency safety lighting without the increase of cost of installing dedicated breakers, circuits, emergency lights, specialized ballasts, outside battery sources, generators and other equipment throughout the building, making it easier and more likely that building owners and property managers an abide by the codes requiring adequate lighting in the event of a power loss, Because the UPS is concealed internal to the heat sink, aesthetics are not adversely affected.

Although embodiments of the invention have been shown and described, it is to be understood that various modifications, substitutions, and rearrangements of parts, components, and/or process (method) steps, as well as other uses, shapes, features and arrangements of light emitting diode (LED) illuminating assemblies provided with a multi-sided LED light bar comprising a non-curvilinear LED luminary, other heat sink designs disclosed herein, luminaries utilizing AC-driven LEDs, UPS back-up and/or novel end cap connector assemblies can be made by those skilled in the art without departing from the novel spirit and scope of this invention. Furthermore, one or more of the disclosed features of any of the disclosed embodiments can be combined with, added, or substituted for, one or more features of any of the other disclosed embodiments.

The foregoing disclosure of specific embodiments is intended to be illustrative of the broad concepts comprehended by the invention.

The invention claimed is:

1. A support connector for maintaining an end of a linear LED lamp in an operative state on a lighting fixture, the linear LED lamp having a body with a length between spaced first and second ends, a source of illumination comprising at least one LED emitter board on or within the body, and a first end connector at the first end of the body having an opening bounded by an edge, the support connector comprising:

a first portion comprising an outer housing and including an integral mounting base configured to couple the support connector to a support of the lighting fixture;

a second portion extending from the first portion and configured to be insertable through the opening as an incident of the first end connector moving relative to the support connector from a position fully separated from the support connector in a path that is transverse to the length of the body into an engaged position;

the second portion having first and second retractable parts on which respective second surfaces are defined, the second surfaces configured to engage corresponding first surfaces of the first end connector;

the retractable parts configured so that the second surfaces can be placed into confronting relationship with the first surfaces to prevent separation of the first end connector and the support connector with the second portion residing within the first end connector in the engaged position.

2. The support connector according to claim 1, wherein the second portion is configured so that the first end connector moves against the second portion as the first end connector moves toward the engaged position thereby causing the first and second retractable parts to reconfigure to allow the second surfaces to be placed into confronting relationship with the first surfaces.

3. The support connector according to claim 2, wherein the second portion has generally parallel first and second sidewalls, the first retractable part associated with the first sidewall and the second retractable part associated with the second sidewall, the second portion configured so that the first and second retractable parts: a) are each engaged by a portion of the edge of the opening and progressively cammed from a holding position, in which the first and second retractable parts reside with the first end connector in the fully separated position, towards an assembly position as the first end connector is moved towards the engaged position; and b) move from the assembly position back towards the holding position with the first end connector in the engaged position.

4. The support connector according to claim 3, wherein the first and second retractable parts are each joined to another part of the support connector part through a live hinge.

5. The support connector according to claim 1, wherein the first end connector has a wall through which the opening is formed, the first surfaces defined by the wall inner surface and being adjacent opposite ends of the opening, the wall having a third surface of its opposite side, and a fourth surface on the second portion of the support connector, the wall residing captively between the second and fourth surfaces with the first end connector in the engaged position.

6. The support connector according to claim 1, further comprising a first actuator operatively coupled to the first retractable part and a second actuator operatively coupled to the second retractable part, the support connector configured so that with the first end connector part in the engaged position the actuators can be repositioned to thereby move the first and second retractable parts towards their respective assembly positions to allow the first end connector to be separated from the support connector.

7. The support connector to claim 1, wherein the second portion is configured to cooperate with the edge of the opening to consistently align the second portion with the opening as the second portion is directed into the opening as the first end connector is moved from the fully separated position to the engaged position.

8. The support connector according to claim 1, further comprising conductive connector components extending within the first portion and the second portion and configured to be electrically connected with a power supply.

9. The support connector according to claim 8, wherein the conductive connector components are configured to be electrically connected to conductive components of the first end connector as an incident of the first end connector moving from the fully separated position into the engaged position.

10. The support connector according to claim 8, wherein the second portion further comprises third and fourth sidewalls extending between the first and second sidewalls, and a leading end wall extending between the sidewalls, the leading end wall defining a plurality of openings.

11. The support connector according to claim 10, wherein the openings are configured so that each opening receives a first portion of one of a plurality of conductive pins of the first end connector extending in a direction traverse to the length of the body and towards the support connector when said first end connector is moved towards the support connector and into the engaged position.

12. The support connector according to claim 11, wherein the conductive connector components each comprise a contact portion generally aligned with one of the openings and configured to engage at least part of the first portion of one of the conductive pins received through the opening with the first end connector and support connector in the engaged position.

13. The support connector according to claim 8, wherein the support connector is configured to be held together with the first end connector independently of the conductive connector components to thereby maintain the body in the operative state.

14. The support connector according to claim 1, wherein the second portion has a reduced profile relative to the first portion.

15. The support connector according to claim 14, further comprising a shoulder portion at the juncture of the first portion and the second portion.

16. The support connector according to claim 15, wherein the first end connector has a wall through which the opening is formed, the first surfaces defined by the wall inner surface and being adjacent opposite ends of the opening, the wall having a third surface of its opposite side, and a fourth surface on the shoulder portion of the support connector, the wall residing captively between the second and fourth surfaces with the first end connector in the engaged position.

17. The support connector according to claim 1, wherein the mounting base of the first portion comprises a flange, a lower facing surface of the flange engaging an upper facing surface of the lighting fixture support with the support connector coupled to the lighting fixture support.

18. The support connector according to claim 1, wherein first portion comprises first and second oppositely facing sidewalls and the mounting base comprises an externally facing slot in each sidewall adapted to engage an edge portion of an opening in the lighting fixture support.

19. The support connector according to claim 1, wherein the lighting fixture support comprises a reflector and the support connector is a component separate from the reflector and the support connector is configured to be press connected to the reflector.

* * * * *